US012779311B2

(12) United States Patent
Timm et al.

(10) Patent No.: US 12,779,311 B2
(45) Date of Patent: Nov. 3, 2026

(54) GOLFING DISTANCE CALCULATOR DEVICES AND METHODS

(71) Applicant: FlagD Golf, Inc., Solana Beach, CA (US)

(72) Inventors: Dale Timm, Solana Beach, CA (US); Troy L. Parish, San Diego, CA (US)

(73) Assignee: FLAGD Golf, Inc., Solana Beach, CA (US)

( * ) Notice: Subject to any disclaimer, the term of this patent is extended or adjusted under 35 U.S.C. 154(b) by 809 days.

(21) Appl. No.: 18/089,371

(22) Filed: Dec. 27, 2022

(65) Prior Publication Data

US 2023/0211225 A1 Jul. 6, 2023

Related U.S. Application Data

(60) Provisional application No. 63/295,440, filed on Dec. 30, 2021.

(51) Int. Cl.

| | |
|---|---|
| ***A63B 69/36*** | (2006.01) |
| ***A63B 57/00*** | (2015.01) |
| ***A63B 71/06*** | (2006.01) |

(52) U.S. Cl.

CPC ..... *A63B 71/0622* (2013.01); *A63B 57/00* (2013.01); *A63B 69/3605* (2020.08); *A63B 2071/0694* (2013.01); *A63B 2220/12* (2013.01); *A63B 2225/50* (2013.01)

(58) Field of Classification Search

CPC . A63B 71/0622; A63B 57/00; A63B 69/3605; A63B 2071/0694; A63B 2220/12; A63B 2225/50; A63B 69/3623; A63B 69/3691; A63B 2209/08; A63B 2209/10; A63B 2225/74; A63B 2220/13; A63B 2220/14; A63B 2220/20; A63B 2225/20; A63B 2225/54

USPC ..... 473/131, 404, 407, 409

See application file for complete search history.

(56) References Cited

U.S. PATENT DOCUMENTS

| | | | | |
|---|---|---|---|---|
| 5,364,093 | A * | 11/1994 | Huston | G01S 19/51 473/409 |
| 5,438,518 | A | 8/1995 | Bianco et al. | |
| 5,636,844 | A | 6/1997 | De Buys | |
| 5,664,880 | A | 9/1997 | Johnson et al. | |
| 5,685,786 | A | 11/1997 | Dudley | |
| 5,772,534 | A | 6/1998 | Dudley | |
| 6,093,923 | A | 7/2000 | Vock et al. | |
| 6,466,162 | B2 | 10/2002 | Boman | |

(Continued)

FOREIGN PATENT DOCUMENTS

| | | |
|---|---|---|
| DE | 10021984 | 11/2018 |
| WO | WO 08/111854 | 9/2008 |
| WO | WO 19/023380 | 1/2019 |

OTHER PUBLICATIONS

International Search Report and Written Opinion dated: Oct. 15, 2018 in International Application No. PCT/US2018/43752, published as: WO 2019/023380 on: Jan. 31, 2019.

(Continued)

*Primary Examiner* — Nini F Legesse

(74) *Attorney, Agent, or Firm* — Schmeiser Olsen PLLC

(57) ABSTRACT

Distance display systems and methods are included which may be used to display an accurate range from a cup of a golf hole to a plurality of tee hitting positions.

36 Claims, 33 Drawing Sheets

(56) References Cited

U.S. PATENT DOCUMENTS

| | | | | |
|---|---|---|---|---|
| 7,942,762 | B2 * | 5/2011 | Balardeta | G01S 19/19 463/2 |
| 8,070,628 | B2 | 12/2011 | Denton et al. | |
| 8,355,869 | B2 | 1/2013 | Balardeta et al. | |
| 10,814,201 | B2 * | 10/2020 | Timm | G01S 19/19 |
| 2002/0052750 | A1 | 5/2002 | Hirooka | |
| 2002/0082122 | A1 | 6/2002 | Pippin et al. | |
| 2002/0085131 | A1 | 7/2002 | Sladen | |
| 2006/0271289 | A1 | 11/2006 | Piekarz et al. | |
| 2009/0075761 | A1 | 3/2009 | Malardeta et al. | |
| 2009/0079625 | A1 | 3/2009 | Denton et al. | |
| 2009/0082139 | A1 | 3/2009 | Hart | |
| 2010/0174480 | A1 | 7/2010 | Trenkle et al. | |
| 2010/0309220 | A1 | 12/2010 | Balardeta et al. | |
| 2011/0022314 | A1 * | 1/2011 | Balardeta | A63B 51/00 701/469 |
| 2012/0069501 | A1 | 3/2012 | Lai | |
| 2012/0071277 | A1 * | 3/2012 | Denton | A63B 69/36 473/407 |
| 2013/0144778 | A1 * | 6/2013 | Jo | G01S 19/19 473/409 |
| 2014/0191902 | A1 | 7/2014 | Kim | |
| 2022/0111280 | A1 | 4/2022 | Timm et al. | |

OTHER PUBLICATIONS

Notice of Allowance dated: Jul. 1, 2020 in U.S. Appl. No. 16/566,755, filed Sep. 10, 2019 and published as: 2020/0070030 on: Mar. 5, 2020.

Non-Final Office Action dated: Mar. 27, 2020 in U.S. Appl. No. 16/566,755, filed Sep. 10, 2019 and published as: 2020/0070030 on: Mar. 5, 2020.

Notice of Allowance dated: Jan. 13, 2020 in U.S. Appl. No. 16/566,755, filed Sep. 10, 2019 and published as: 2020/0070030 on: Mar. 5, 2020.

Notice of Allowance dated: Oct. 1, 2021 in U.S. Appl. No. 17/035,303, filed Sep. 28, 2020 and published as: 2021/0008429 on: Jan. 14, 2021.

Non-Final Office Action dated: Sep. 7, 2022 in U.S. Appl. No. 17/506,097, filed Dec. 22, 2021 and published as: 2022/0111280 on: Apr. 14, 2022.

Non-Final Office Action dated: Dec. 19, 2023 in U.S. Appl. No. 18/199,811, filed May 19, 2023 and published as: 2023-0285829 on: Sep. 14, 2023.

* cited by examiner

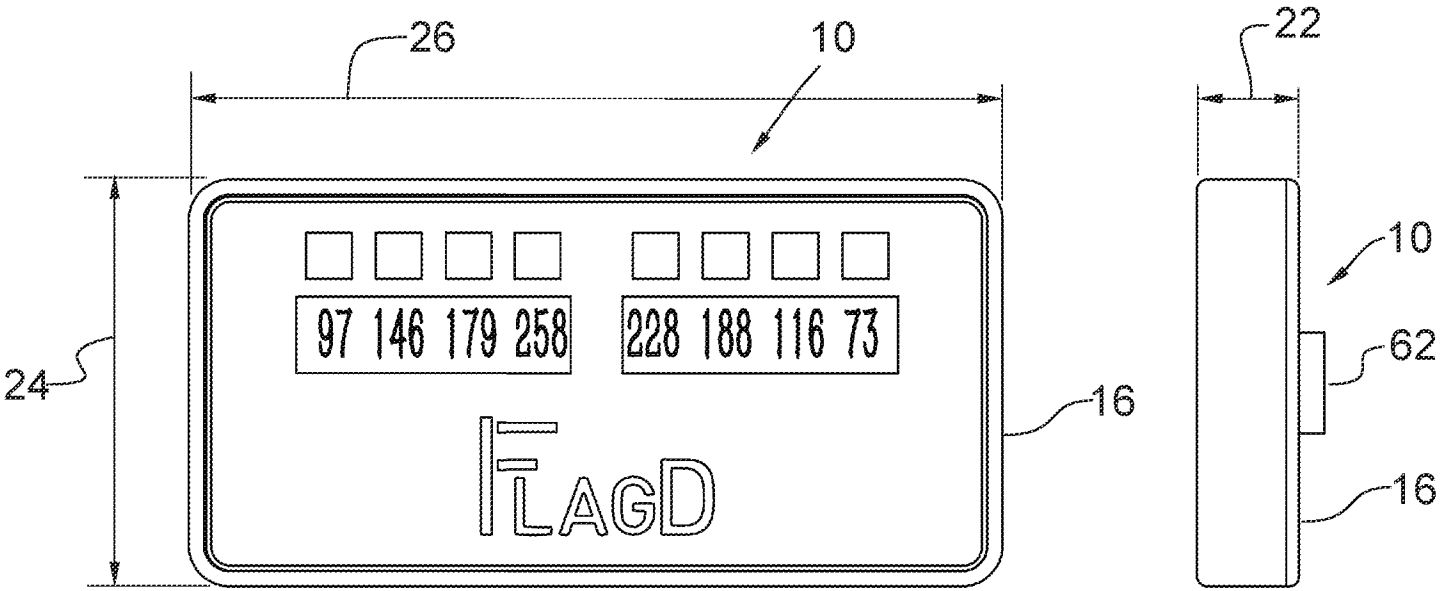
FIG. 2
FIG. 4
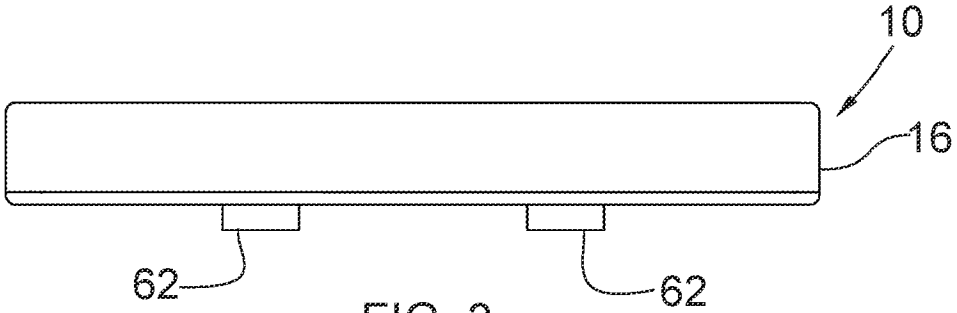
FIG. 3

GOLFING DISTANCE CALCULATOR DEVICES AND METHODS

RELATED APPLICATIONS

This application claims priority under 35 U.S.C. section 119(e) from U.S. Provisional Patent Application No. 63/295,440, filed Dec. 30, 2021, by D. Timm et al. and titled "GOLFING DISTANCE CALCULATOR DEVICES AND METHODS", which is also incorporated by reference herein in its entirety. This application is also related to U.S. Pat. No. 10,814,201, filed Sep. 10, 2019, by Dale Timm et al. titled "Distance Calculator Devices and Methods for Golf Practice Ranges," which is also incorporated by reference herein in its entirety.

BACKGROUND

In general, a greenskeeper maintaining a golf course will typically reconfigure the cup position and various hitting positions of a golf hole to keep the golf course fresh for participating golfers and to prevent excessive wear of the sod in any one particular area. This may be particularly true for short holes of a course, such as par 3 holes. The cup of a hole is generally repositioned on the green and the various tee hitting positions, which may include 2, 3, 4 or more tee hitting positions, may also be repositioned at the same time. Currently, on many golf courses, the range from each of the hitting positions of a particular hole to the cup is displayed on a fixed placard at the entrance to the tee hitting area in order to assist golfers in making the correct golf club selection for the tee hitting position that they will use for the hole.

Typically, the greenskeeper that maintains such a course will drive a cart out to the cup on the green of the hole that is to be reconfigured and move the cup/flag of the hole to a new position on the green. The groundskeeper then returns to the tee hitting area and repositions each of the tee hitting positions if warranted. The various tee hitting positions of the hole may be placed in a variety of respective locations that provide various levels of difficulty for reaching the repositioned cup on the green. Once each of the tee hitting positions have been repositioned (or any subset thereof) the greenskeeper may then determine the range to the repositioned cup from each of the respective repositioned tee hitting positions and post those measured range values on the respective display site on the placard. A respective display site on the placard may be marked with an identifier that corresponds to an identifier on the respective tee hitting position. For example, a first tee hitting position may have a numerical identifier such as the number "1" disposed adjacent thereto for example and the corresponding display site on the placard will then also include the number "1" adjacent thereto. Color coding identifiers may also be used for distinguishing each of the plurality of tee hitting positions wherein both the tee hitting position and the respective display site on the placard will have a blue marker, such as a blue dot, square or the like to indicate the correlation between the tee hitting position and the respective display site on the placard.

These methods currently used by the greenskeeper to determine and display each of the respective ranges may vary, but would generally include the use of a laser range finder or the like. This results in a time consuming process whereby each of the tee hitting positions for each of the holes on the golf course must be "shot" with a laser range finder to determine the distance between each of the tee hitting positions and the respective cup of the hole. If such a process is not performed before play begins each day, each golfer that is participating on the reconfigured hole will either have to guess at the range from their selected tee hitting position to the cup or perform their own range measurement that once again is time consuming and may result in holding up the play of other golfers on the course.

What have been needed are efficient devices and methods for reconfiguring a suitable golf hole of a golf course and conveniently displaying the range from the cup to the various tee hitting positions of a reconfigured hole.

SUMMARY

Some embodiments of a distance display system for simultaneously displaying respective distances from a cup of a golf hole to a plurality of tee hitting positions of the golf hole, may include a primary display that includes a plurality of display sites, a display indicator disposed adjacent each of the respective display sites, a processor, an actuator interface, and a communication interface in operative communication with the processor. Such a distance display system may also include a plurality of locator pucks, each locator puck including a position measuring system configured to determine the position of the locator puck, a cup position memory, a tee hitting position memory, an actuator interface and a communication interface configured to communicate with the wireless communication interface of the primary display.

Some embodiments of a method of displaying distances from a plurality of tee hitting positions to a cup of a golf course hole may include selecting a primary display and a plurality of locator pucks of a distance display system and placing a first locator puck on the ground adjacent to a cup position on a green of the golf course hole. Thereafter, a GPS receiver of the first locator puck may be actuated to capture cup position data and then storing the cup position data into a puck memory of the first locator puck. The first locator puck may then be transported to a tee hitting area corresponding to the cup of the golf course hole and placed adjacent a first tee hitting position of the tee hitting area. The GPS receiver of the first locator puck may then be actuated thereby capturing first tee hitting position data with the GPS receiver and then storing the first tee hitting position data into a tee hitting position memory of the first locator puck. The method may also include placing a second locator puck adjacent a second tee hitting position of the tee hitting area, actuating a GPS receiver of the second locator puck and capturing second tee hitting position data with the GPS receiver of the second locator puck. The second tee hitting position data may then be stored into a tee hitting position memory of the second locator puck. The method may further include positioning a primary display of the distance display system in a desired position near the first and second tee hitting positions, actuating an actuator interface of a controller of the primary display which then queries the first locator puck and second locator puck for position data. Thereafter, cup position data from the first locator puck may be transmitted to the controller of the primary display and first hitting position data may also be transmitted from the first locator puck to the controller of the primary display. In addition, second hitting position data may be transmitted from the second locator puck to the controller of the primary display. The transmitted position data may be stored in a display memory of the primary display and a first distance from the first hitting position to the cup calculated with the controller of the primary display and the first distance displayed on a first display site of the primary display. A second distance from the second hitting position to the cup may also be calculated with the controller of the primary display and the second distance displayed on a second display site of the primary display.

Certain embodiments are described further in the following description, examples, claims and drawings. These features of embodiments will become more apparent from the following detailed description when taken in conjunction with the accompanying exemplary drawings.

BRIEF DESCRIPTION OF THE DRAWINGS

FIG. 2 is a front view of the distance calculator embodiment of FIG. 1.

FIG. 3 is a top view of the distance calculator embodiment of FIG. 1.

FIG. 4 is a side view of the distance calculator embodiment of FIG. 1.

Figure 1:
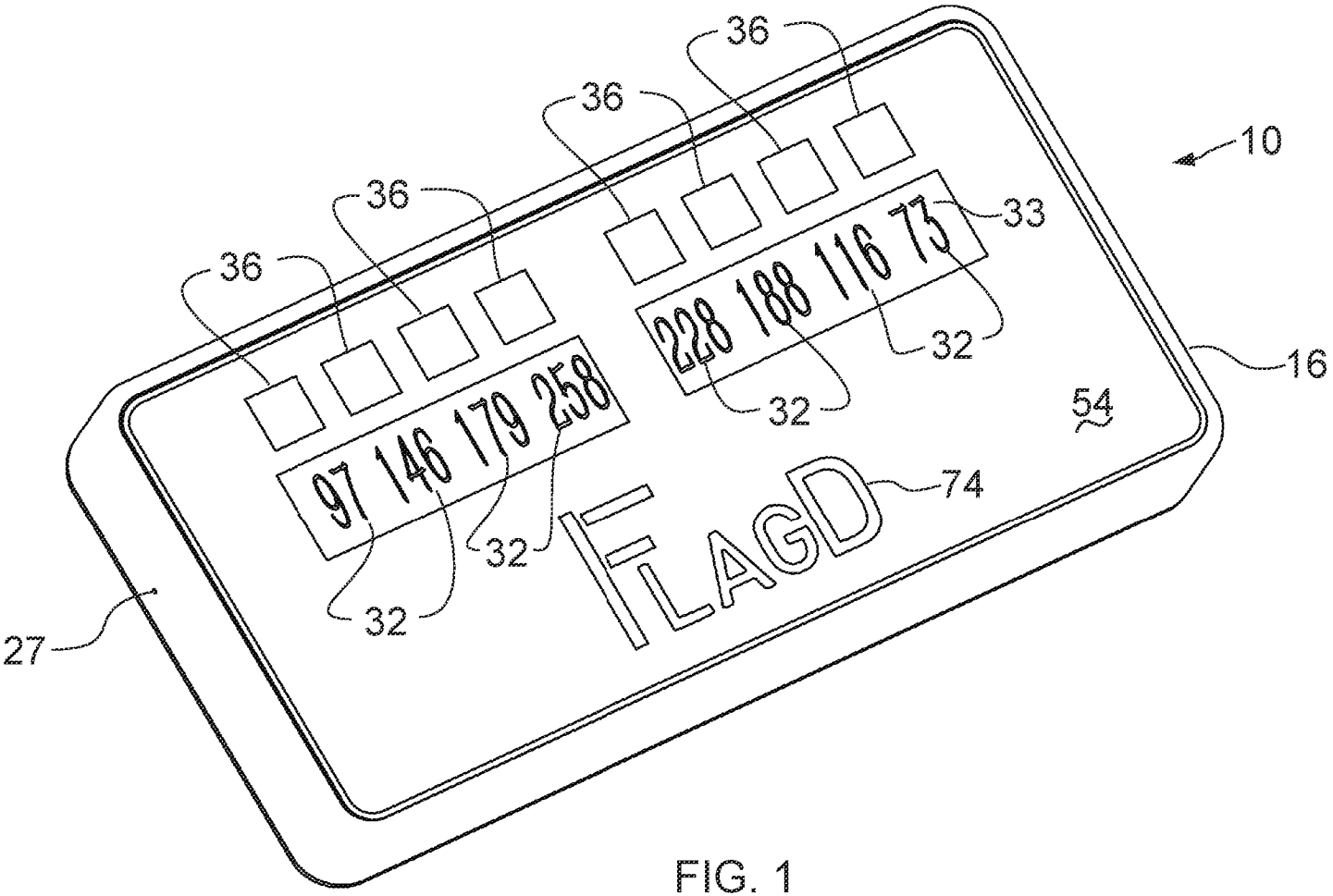
FIG. 1 is a perspective view of a distance calculator embodiment.
Figure 5:
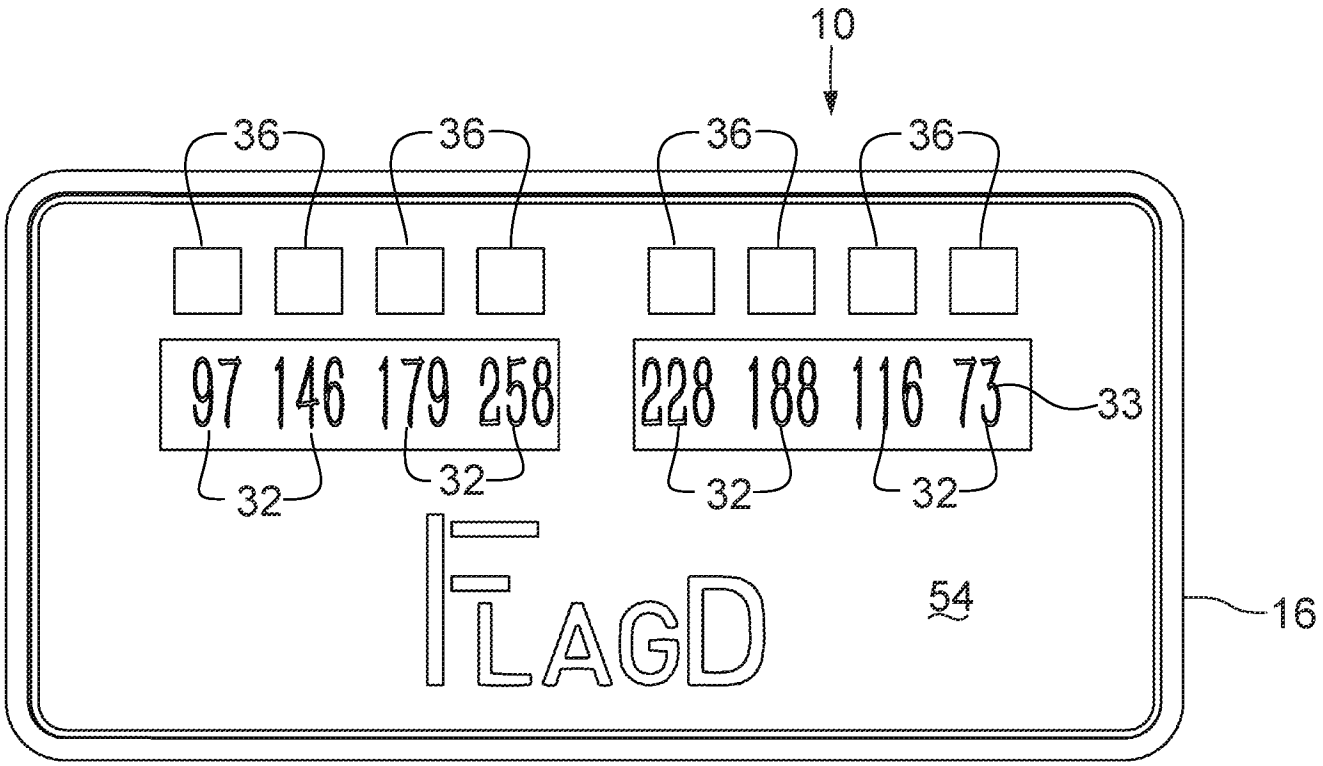
FIG. 5 is a front view in elevation of the distance calculator of FIG. 1.

The drawings are intended to illustrate certain exemplary embodiments and are not limiting. For clarity and ease of illustration, the drawings may not be made to scale, and in some instances, various aspects may be shown exaggerated or enlarged to facilitate an understanding of particular embodiments.

DETAILED DESCRIPTION

As discussed above, there is a need for devices that are designed specifically for use at a golf practice range that automatically and efficiently measure and display the plurality of distances from such a device to the multiple targets on the golf practice range. Generally speaking, golfers at practice ranges either guess at distances, pace off distances from a yardage plaque or board with hand adjusted numbers, or utilize a golf range finder, such as laser range finders, to "shoot" the distance to a target from their hitting position each time. These methods and systems generally don't work well for a variety of reasons including inaccuracy and a requirement for human interaction in order to make measurements each time. In addition, these methods are analog solutions that are not simple to use and rely on a person to either step off distances from a certain position (such as where a yardage plaque is placed) to where they are hitting from, and they require too much time for the average golfer to use effectively during golf practice sessions.

Other handheld devices such as laser range finders offer the perception of point and shoot convenience however at a considerable monetary expense and usability is often considered awkward. The distance calculator embodiments discussed herein makes this distance measuring and displaying process extremely simple and accurate for players of all ages and ability by automatically displaying accurate distances from the hitting area to the target with no golfer activation required during the golf practice session. Typically, such hitting positions discussed above in the context of a golf practice range are locations from which a golfer will hit multiple practice shots as opposed to a hitting position on a regulation golf course where the object of the game incentivizes minimizing the number of hits from the same hitting position, with the normal practice being a single hit from each different hitting position on the golf course.

Distance calculator embodiments discussed herein which may be battery powered, may be configured to attach to golf bag stands or other similar surfaces near the golfer while the golfer is standing at a hitting position. In some cases, such distance calculator embodiments display the respective distances from the distance calculator to the various targets located on the golf practice range (typically flags) using GPS technology or the like. In some cases, such distance calculator embodiments may include distance displays having an electrophoretic display (EPD) screen on the top or outer surface to constantly and simultaneously show the plurality of accurate distances being measured. This allows the golfer to accurately gauge their distances to their multiple targets regardless of the hitting position from which they are hitting once the distance calculator has been set for that hitting position. The golfer need only read the display value corresponding to the target flag of interest which is a very simple method from the golfer's perspective to have accurate distance measurements.

In use, embodiments of the distance calculator may determine the location coordinates of the housing of the distance calculator itself using data acquired from the GPS receiver. That location data may then be compared to stored target position data which may be stored within the memory storage within the housing for targets of interest and the distance from the housing of the distance calculator to each target is displayed. In a typical application, a separate distance calculator may be located at each hitting position such as the tee at a golf practice range. When the location of a hitting position is moved as discussed above, the distance from the distance calculator to the targets is also generally changed. In these situations, the distance calculator may be updated to display the new display distances by using a golf tee or other elongated object capable of pressing a recessed update interface button that will cause a controller of the distance calculator to automatically determine a new position of the housing using the GPS receiver, recalculate the distances to each target, and update the display of each display distance corresponding to each flag. Typically, the hitting positions are set up by greenskeepers in the morning at which time they will update all of the distance calculators with no further updates required for the day.

Embodiments of the distance calculators discussed herein, such as the distance calculator embodiment 10 shown in FIGS. 1-7, may be directed to embodiments for simultaneously displaying distances to a plurality of targets 12 (see FIG. 12) at a golf practice range 14. Such distance calculator embodiments may include a housing 16, a controller 18 disposed on the housing 16, and memory storage 20 such as, for example, electrically erasable programmable read-only memory (EEPROM) which may be disposed within an interior volume of the housing 16 in operative communication with the controller 18. For elements of distance calculator embodiments 10 discussed herein which are referred to as being in operative communication, operatively coupled or the like, such elements may be coupled by any suitable conduit or conduits such as conductive wires, fiber optic cables, wireless links or the like. The memory storage 20 may be configured to store a plurality of stored target positions as well as other data. The housing 16 of such distance calculator embodiments 10 may have an enclosed hollow configuration with a rectangular shape having a thickness as indicated by arrow 22 in FIG. 4 that is less than a height as indicated by arrow 24 or width as indicated by arrow 26 as shown in FIG. 2. For some embodiments, the housing 16 may have a height 24 of about 80 mm to about 120 mm, a width 26 of about 150 mm to about 300 mm and a thickness 22 of about 15 mm to about 40 mm.

The enclosed hollow configuration of the housing 16, which may be weatherproof or sealed in some cases, may also include a vent hole 27 that provides communication between the interior volume of the housing 16 and the ambient atmosphere surrounding the housing 16 to enable equalization of air and/or water vapor pressure between the air inside the interior volume of the housing 16 and the outside ambient. Such pressure equalization may be useful in order to reduce stress on sealing materials of the housing 16 in some instances. In some cases, in order to maintain a waterproof or weatherproof configuration, the vent hole 27 may include a hydrophobic breathable cover material 67 (see FIG. 7) that is sealed to the structure of the housing 16 over the vent hole 27 on an interior wall of the case top plate of the housing 16. Waterproof breathable materials such as expanded polytetrafluoroethylene (Gortex®) or the like may be used for the cover material 67.

Figure 7:
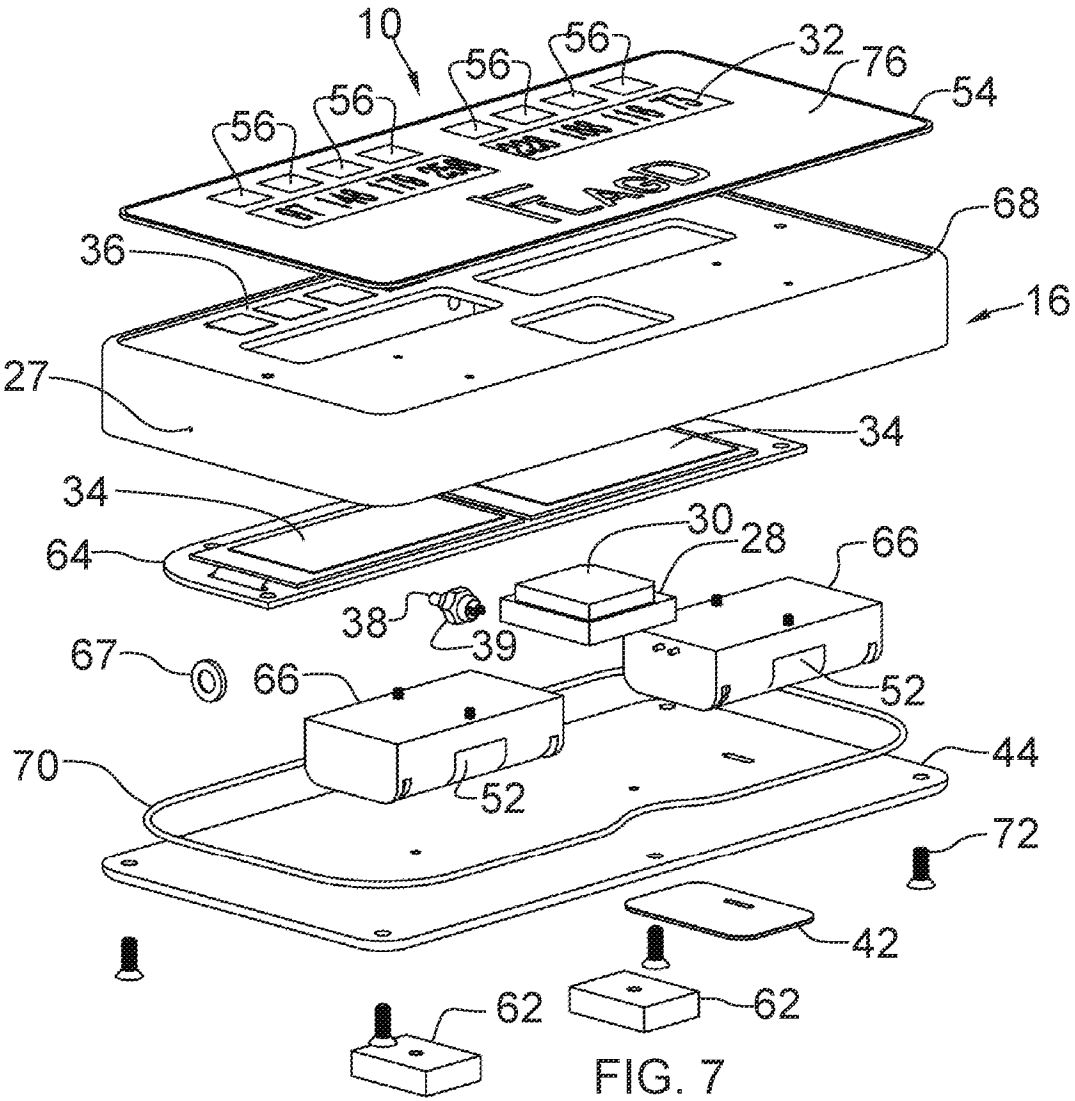
FIG. 7 is an exploded view of the distance calculator embodiment of FIG. 1.
Figure 8:
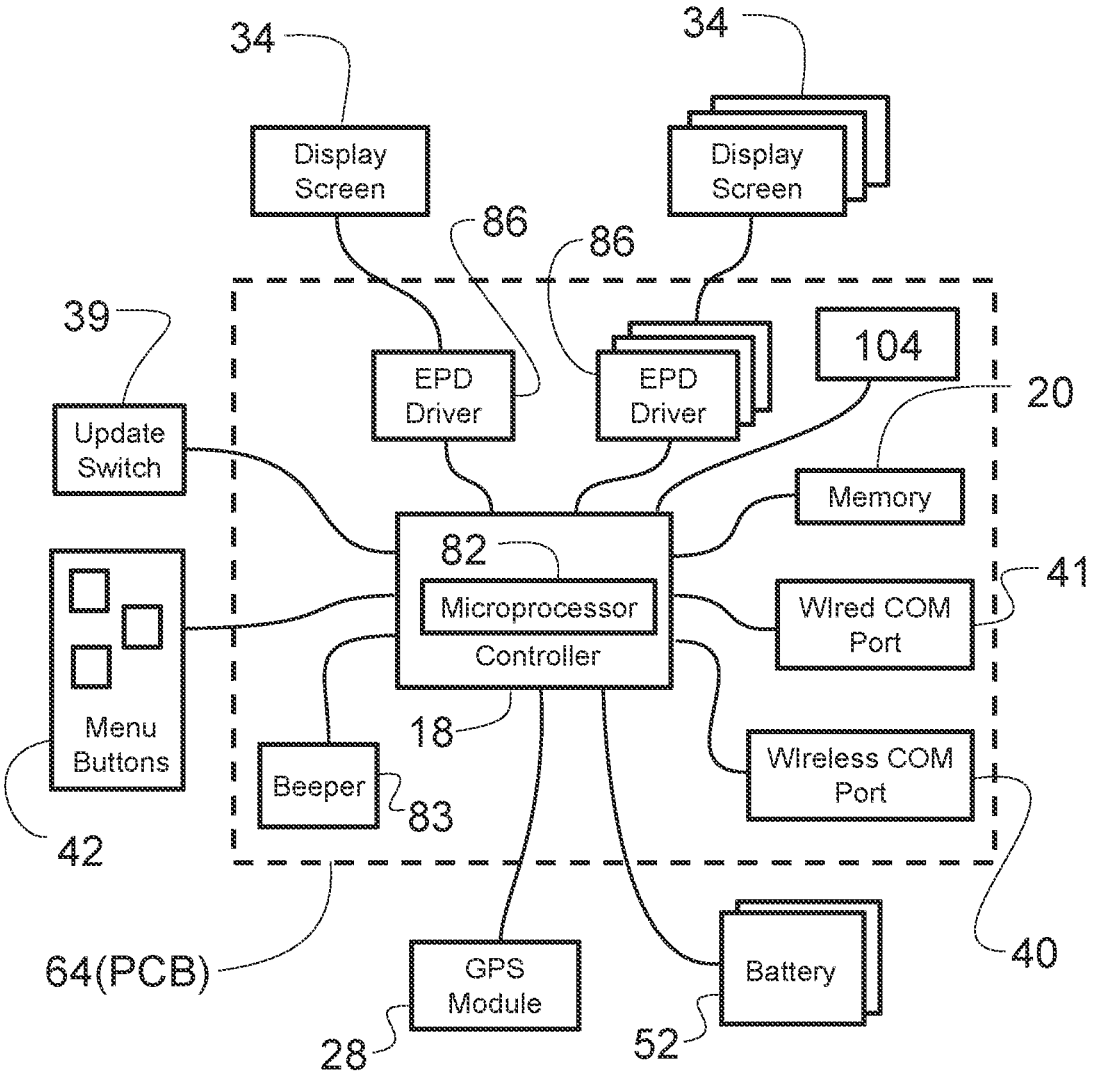
FIG. 8 is a schematic view of certain electronic components of the distance calculator of FIG. 1 including a PCB embodiment, display screen embodiment and GPS receiver embodiment of the distance calculator embodiment of FIG. 1.

Referring to FIGS. 7 and 8, a GPS receiver 28 which is in operative communication with the controller 18, may be used determine a position of the distance calculator 10, or housing 16 thereof, by receiving GPS satellite signal data from GPS satellites with an antenna 30 of the GPS receiver 28, which may be an integrated antenna 30. In some instances, the GPS receiver 28 may receive GPS satellite signal data from one or more GPS satellites. In some cases, the GPS receiver may receive GPS satellite signal data from at least three GPS satellites in order to generate reliable position data. An example of such a GPS receiver 28 may include a model EM 506 manufactured by Globalsat World-Com Corporation located in New Taipei City, Taiwan. Although the distance calculator embodiments 10 discussed herein include the use of a GPS receiver 28 in order to acquire position data from an external signal received by such devices, other location systems and methods such as radiofrequency triangulation including Bluetooth/WiFi® triangulation, cell phone tower signal triangulation, or acoustic or optical signal time of flight method and the like are also contemplated and may be used as substitutes for the GPS receiver embodiments 28 discussed herein.

The distance calculator 10 may also include a plurality of distance displays 32 which are each in operative communication with the controller 18, which are each in secured relation to the housing 16, which each display a display distance value 33 corresponding to a stored target position of a respective target 12 and which each are readily visible to a user from a position outside of the housing 16. For some embodiments, the distance displays 32 may be part of a zone or subset of a larger display screen 34 as shown in FIG. 7. A target indicator 36 may be disposed on the housing 16 adjacent each of the plurality of distance displays 32 and may provide a visual reference to a user that facilitates correlation of a given distance display 32 with a corresponding target 12.

An update interface 38 which is operatively coupled to the controller 18 may be used to prompt the controller 18 to initiate calculation or recalculation of the position of the distance calculator 10 by the GPS receiver 28. The update interface 38 may also be used to prompt the controller to initiate calculation or recalculation of distances between each of the stored target positions to the position of the distance calculator 10, or housing 16 thereof. Such calculations may be carried out by the microprocessor 82 of the controller 18 in some cases. The update interface 38 may also be used to prompt the controller 18 to update the display distance values 33 (see FIG. 1) on each of the distance displays 32 based on the recalculated distances between the distance calculator 10 and targets 12 for which target position values are stored in the memory storage 20 or any other suitable location within the distance calculator 10. For such distance calculator embodiments 10, the update interface 38 may include an update switch 39 disposed on the housing 16 as shown in FIGS. 7 and 8. In some cases, the update switch 39 of the update interface 38 disposed on the housing 16 may be a recessed switch 39 which is positioned within the housing 16 so as to permit actuation of the recessed switch 39 with a point of a golf tee or similar instrument as shown in FIG. 7.

Figure 6:
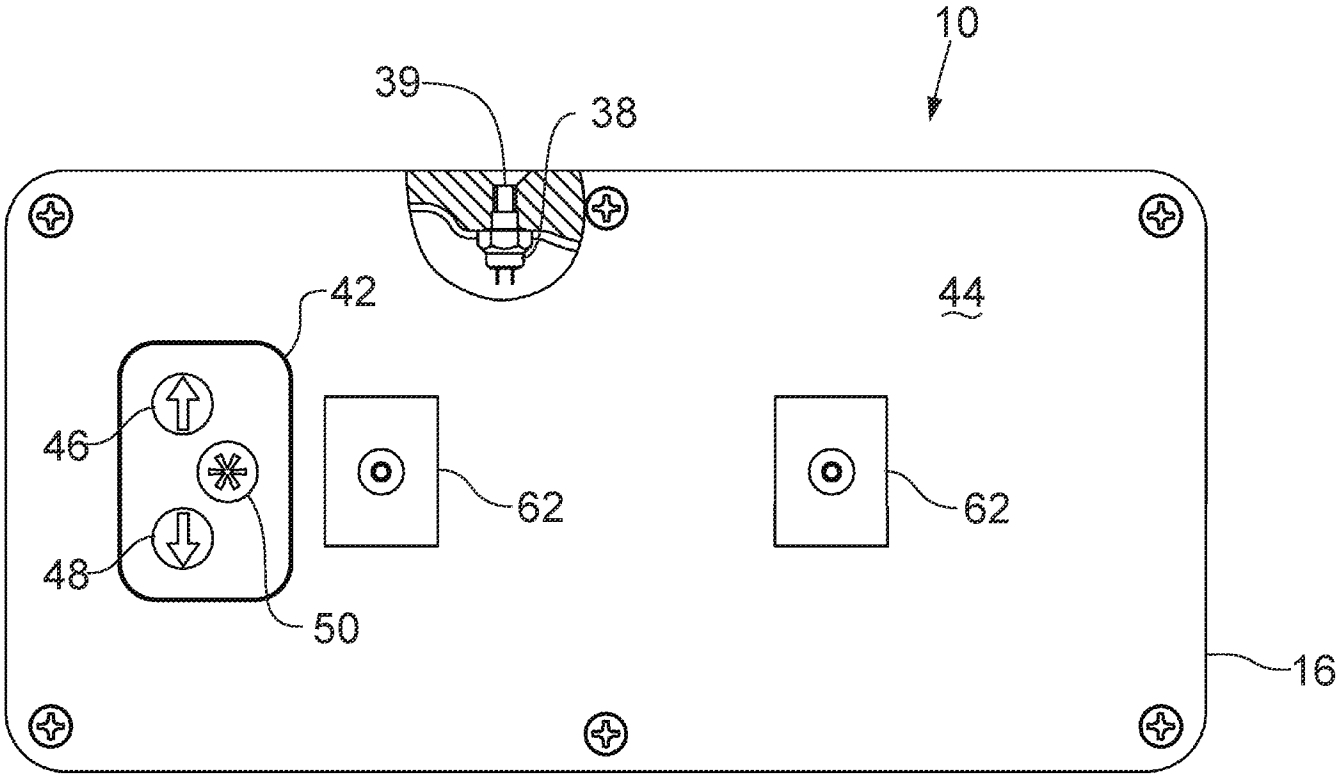
FIG. 6 is a rear view of the distance calculator embodiment of FIG. 1

In some instances, the update interface 38 may include a remote control (not shown) which utilizes a wireless link, such as the wireless communication link 40 shown in FIG. 8 which may be in operative communication with the controller 18 and in wireless communication with the remote control. Some distance calculator embodiments 10 may further include an auxiliary user interface 42 which may also be operatively coupled to the controller 18. For the distance calculator embodiment 10 shown in FIG. 8, the auxiliary user interface includes a membrane switch 42 as shown in FIG. 6 disposed on the rear or bottom plate 44 of the housing 16. The membrane switch 42 may include several different buttons that may be used for toggling through various menu selections and selecting menu choice options. For the membrane switch embodiment 42 illustrated in FIG. 6, an "up" button 46, "down" button 48 and "enter" button 50 may be included on the membrane switch 42. The up button 46 and down button 48 may be used to advance through menu options and the enter button 50 may be used to select displayed menu choices in some cases.

As discussed above, in some instances, each distance display 32 may have an associated target indicator 36 disposed adjacent thereto. The target indicators 36 may be used as a quick reference label by an end user of the distance calculator 10 for each distance display 32 so that the user of the distance calculator 10 can determine at a glance which target 12 distance is being displayed by each respective distance display 32. In some cases, each target indicator 36 may include a color coded emblem such as a sticker, painted block or the like. For such embodiments 36, each color coded emblem may correspond to a color coding of an actual physical flag of a target 12 on the golf practice range 14 corresponding to a stored target position for which the distance has been displayed. In other cases, each target indicator 36 may include a pattern such as stripes or a checkerboard that represents a matching pattern of a corresponding flag of a target 12. In other cases, each target indicator 36 may include a written character that represents a matching written character of a corresponding target or flag 12. For example, such written characters may include numbers, letters, symbols or the like as shown, for example, in FIG. 12, where each target flag 12 is labeled with a number and the range calculator 10 includes a distance display 32 for each target 12 with a target indicator 36 having a number corresponding the respective target flag 12. In addition, symbols representing natural or man-made features on the golf practice range 14 may be used such as symbols representing trees, out buildings, water features or the like. In this way, certain target locations and corresponding distance displays 32 may be identified by the feature they are close to rather than an identifier disposed directly on the target 12. Such features may be extended to creating a scaled down spatial representation of the entire golf practice range 14 or portions thereof on the face plate 54 of the distance calculator 10. For such distance calculator embodiments 10, a scaled down map or visual representation of the golf practice range 14 may be printed onto the face plate 54 with the relative positions of the distance displays 32 on the face plate 54 correlating to the relative positions of the targets 12 on the golf practice range 14 at which the distance calculator 10 will be used. This scaled down representation of the golf practice range 14 could also be electronically displayed on a single display screen 34 for some embodiments.

In certain circumstances, power management for the distance calculator embodiments 10 may be very useful in order to extend the life of a stored power source such as a battery 52 including rechargeable batteries that may be used to power the electronic or electrical components of the distance calculator 10. Extending battery life may be useful to reduce maintenance time and cost for a commercial end user that may be using a large number of the distance calculators 10 for a particular golf facility. As such, for some embodiments 10, each of the distance displays 32 may include a screen that continues to display a display distance yardage value 33 even after power to the distance display 32 has been shut off or eliminated. Examples of such distance display embodiments 32 may include a microencapsulated electrophoretic displays or the like. A specific example of such an electrophoretic display may include a model E2287CS091 manufactured by Pervasive Displays Company located at Tainan City, Taiwan. Such electrophoretic type of distance displays 32 may also be amenable to outdoor use because they may be visible to a user wearing polarized eyewear which is common to golfers and other outdoor sports enthusiasts. For some distance calculator embodiments 10, the plurality of distance displays 32 may be disposed on a single display screen 34. That is, a single display screen 34 may include a plurality of display fields, with a separate display distance value being displayed in each of these fields.

For the distance calculator embodiment 10 shown in FIG. 7, there are two separate display screens 34, each of which includes four distance displays 32. In order to further conserve power during operation, the controller 18 may be configured to update the display distance values 33 for each of the distance displays 32 of a first display screen 34 while a second display screen 34 is powered down and then shut off the power to the first display screen 34. Power may then be supplied to the second display screen 34 while the first display screen 34 is powered down, the display distance values 33 of the distance displays 32 of the second display screen 34 updated and then power shut off to the second display screen 34. A similar sequence may also be used for instances wherein each distance display 32 is disposed on a separate display screen 34.

In order to include an associated target indicator 36 for such an arrangement, an outer face plate 54 as shown in FIG. 7 with a plurality of display windows 56 having positions corresponding to a position that is disposed over each of the respective distance displays 32 of the display screen or screens 34 may be disposed over such a display screen or screens 34. In addition, a plurality of display screens 34 may be used such that the plurality of distance displays 32 are disposed on a plurality of display screens 34 as shown in FIG. 7. In some cases, the plurality of distance displays 32 may be each disposed on a separate display screen 34. For the distance calculator embodiment 10 shown in FIG. 5, there are a total of two display screens 34 with each of the two display screens 34 including four associated distance displays 32 for a total of eight distance displays 32 and eight associated target indicators 36 printed onto the face plate 54 adjacent the associated transparent display windows. In some cases, the distance calculator 10 may include about 2 distance displays 32 to about 20 distance displays 32, more specifically, about 5 distance displays 32 to about 10 distance displays 32. In addition, a corresponding number of target indicators 36 may be associated with such numbers of distance displays 32.

In many cases, the distance calculator embodiments 10 discussed herein may be repeatedly mounted to and removed from a surface in order to make the distance calculator 10 available for use during hours of operation of the golf practice range 14 but then brought back inside the clubhouse during hours of non-operation in order to minimize exposure to the elements even though the housing 16 of the distance calculator embodiments 10 discussed herein may be configured to be weatherproof, waterproof etc. In some cases, the distance calculator embodiments 10 may be removably mounted to a surface of an object such as a golf bag stand 11 or the like that is disposed directly adjacent a hitting position 60 of the golf practice range 14 as shown in FIGS. 13-16, and then later removed from such a surface and brought back indoors during hours of non-operation. In some cases, the distance calculator embodiments 10 may be robustly mounted to a surface to discourage theft. As such, some distance calculator embodiments 10 may include a mount 62 such as a mounting screw, mating hook and loop surfaces or materials, a magnetic mount, a spring latch and mating slotted boss mount or the like. An example of a magnetic mount embodiment 62 that may be removably secured to a mating surface such as a magnetic plate 63, such as a steel magnetic plate 63, or any other suitable surface. Such a magnetic plate 63 may be secured to a surface of the golf bag stand 11 with an angled mounting bracket 61 that provides a predetermined tilt for the distance calculator 10 that facilitates reading of the display distance values 33 and may further prevent pooling of rain or irrigation water on the distance calculator embodiments 10.

As discussed above, some embodiments of the distance calculator 10 may include a communication link 40 that is operatively coupled to the controller 18. Such a communication link 40 may be configured to transmit stored target position data stored within the memory storage 20 to a communication link 40 of another distance calculator 10. The other distance calculator 10 or any of the distance calculator embodiments 10 discussed herein may be configured to receive such stored target position data with such a communication link 40. For some embodiments, the communication link 40 may include a wireless link such as a Bluetooth® wireless link or the like, for example or an optical wireless link using LEDs and photodetectors such as irDA for example.

Referring again to FIGS. 7 and 8, and as discussed above, distance calculator embodiments 10 discussed herein may include the GPS receiver 28, one or more microencapsulated electrophoretic display screens 34, and a processor such as a microprocessor 82 which may be operatively coupled to a main printed circuit board (PCB) 64 of the controller 18. Two battery holders 66 with two pairs of AA batteries 52 may also be connected to the PCB 64 to provide power for operation of the electrical and electronic components of the distance calculator 10. Additional connections to the PCB 64 may include the externally mounted membrane switch 42 and a mechanical update switch 39 that may be secured to the PCB 64 in some cases or in other cases secured directly to the case top 68, case bottom 44 or any other suitable location. Components such as the GPS receiver 28 and battery holders 66 may be mounted inside of the housing 16 or on the external surface of the housing 16. The housing 16 may be waterproof, weatherproof or water resistant generally and may include the case bottom 44, a case top 68, a case assembly O-ring 70, outer face plate 54, vent hole 27, hydrophobic breathable cover 67 and six case assembly screws 72. The faceplate 54 with transparent display windows 56 and artwork 74 may be affixed to the outer surface 76 of the case top 68. The assembled unit may be mounted to an external surface using the mount 62 such as the magnetic mount shown, a unit mounting screw threaded into the bottom case or any other suitable detachable securement method. In some cases, functions of the membrane switch 42 and the update switch 38 may be merged thereby eliminating one of them, but usability may be altered. Potential modifications could include adding or changing the type of battery 52, such as including rechargeable batteries 52, and/or size and/or adding a solar cell (not shown) to charge the batteries 52, and/or adding a connector interface to charge batteries using an external charger.

Figure 9:
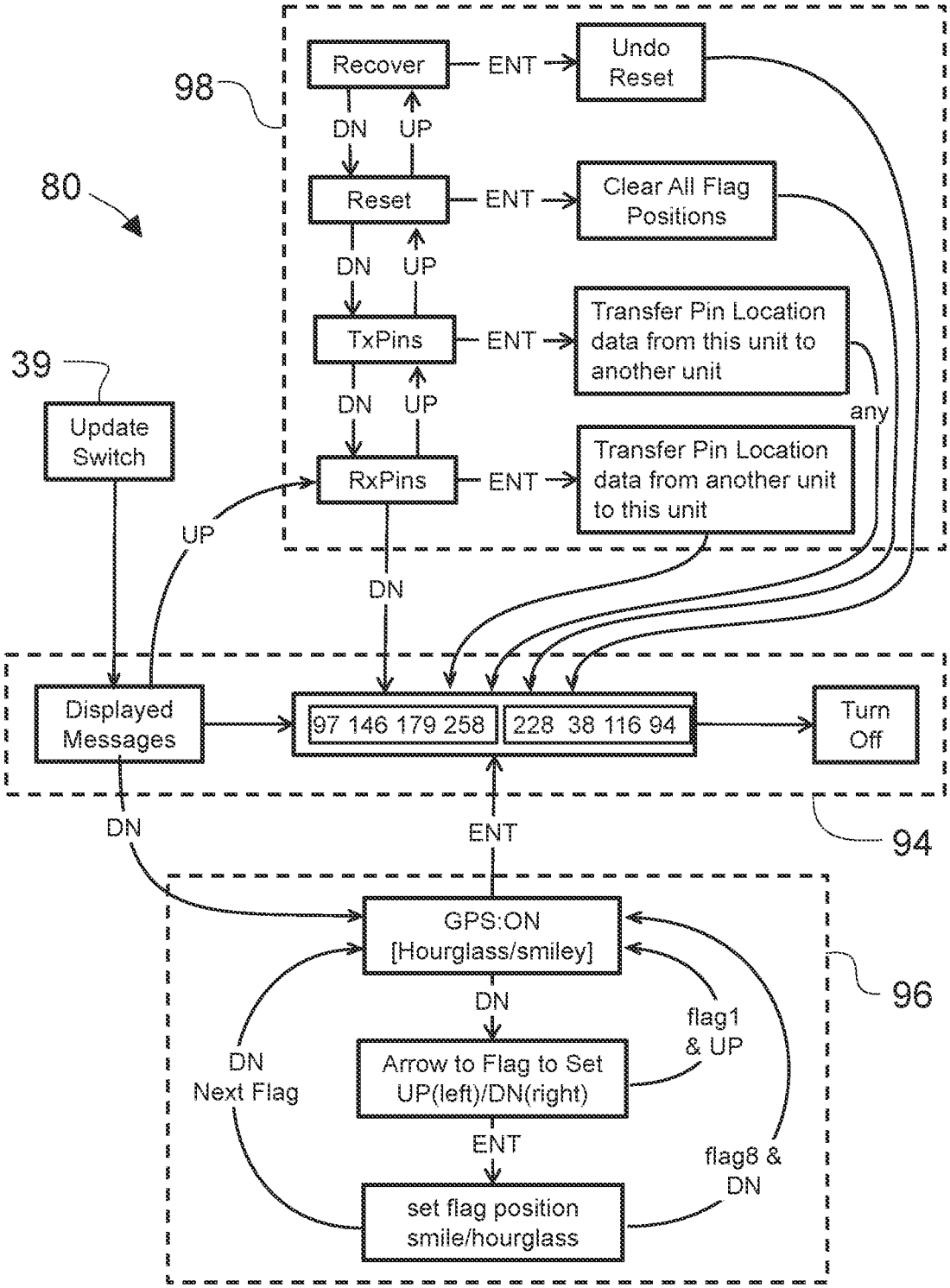
FIG. 9 is a flow chart indicating menu control by with the update interface switch and auxiliary interface buttons of the membrane switch.

The distance calculator 10 may also have additional functionality which may be accessible using the membrane switch 42 disposed on the housing 16 and a menu structure visible on the screens of the distance displays 32 as shown in the menu function flow chart embodiment 80 shown in FIG. 9. The additional functionality may enable the distance calculator 10 to acquire and store the location coordinates of each remote fixed target position (flag) 12 and to initiate wireless transfer of these stored target position coordinates to other distance calculator units 10 for initialization. The additional functionality may also enable altering the configuration of the distance calculator 10 by changing internal algorithm parameters and/or changing user interface settings such as display font type.

As discussed above, some distance calculator embodiments 10 may be powered by two pairs of AA batteries 52 and the electronic components may be specifically chosen and configured for low power consumption with the objective of very long product operation between battery changes. The microencapsulated electrophoretic display embodiments 34 are typically well suited for this application due to the extremely low energy required to update and maintain the display distance values 33. To further prevent unnecessary power consumption, additional circuitry may be provided in controller 18 to electrically shut off and decouple functional circuit elements when not in use.

Figure 12:
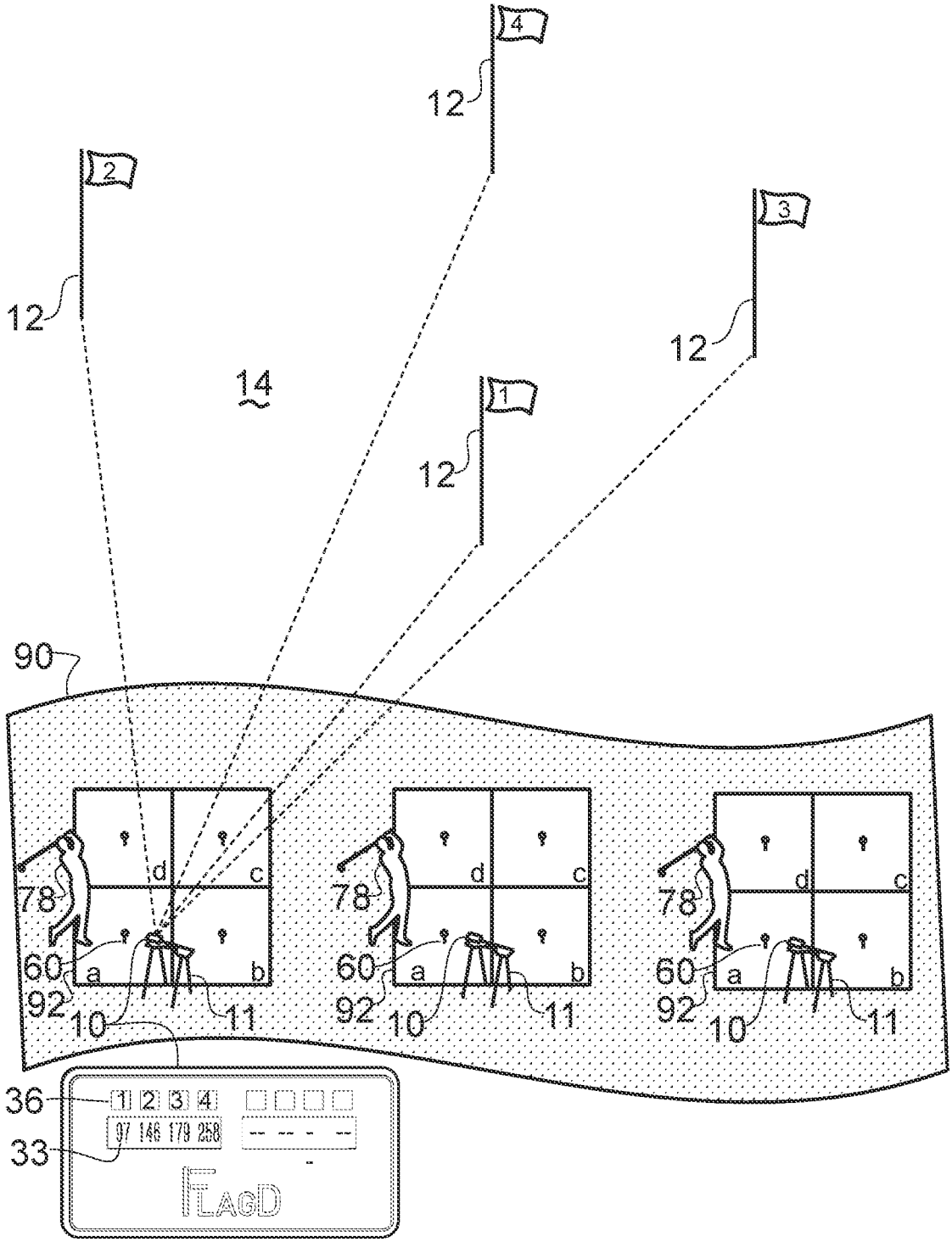
FIG. 12 is a schematic representation of a golf practice range with multiple distance calculator embodiments disposed adjacent hitting positions thereof.
Figure 13:
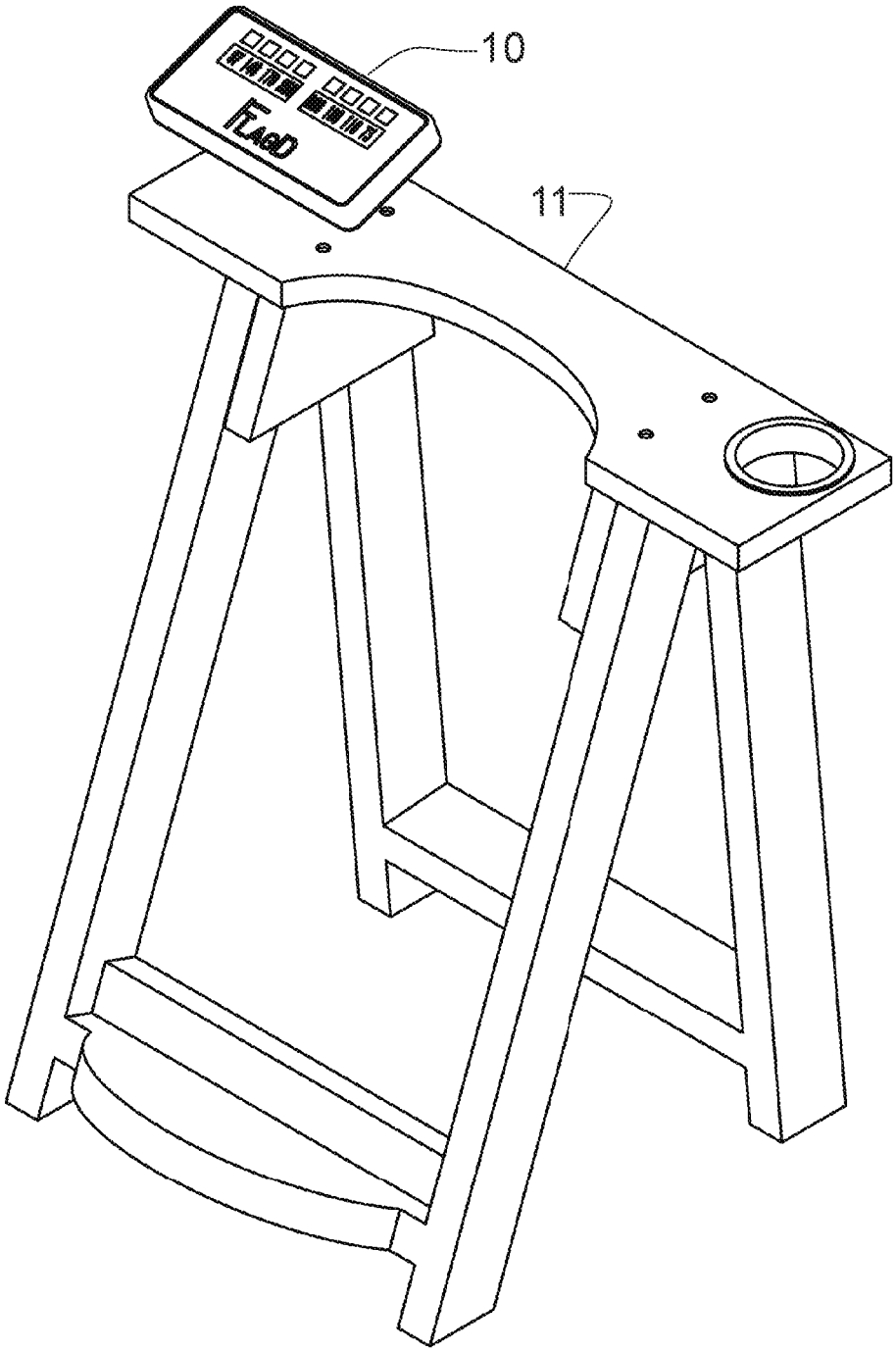
FIG. 13 is a perspective view of the distance calculator embodiment of FIG. 1 releasably secured to a golf bag stand embodiment.
Figure 14:
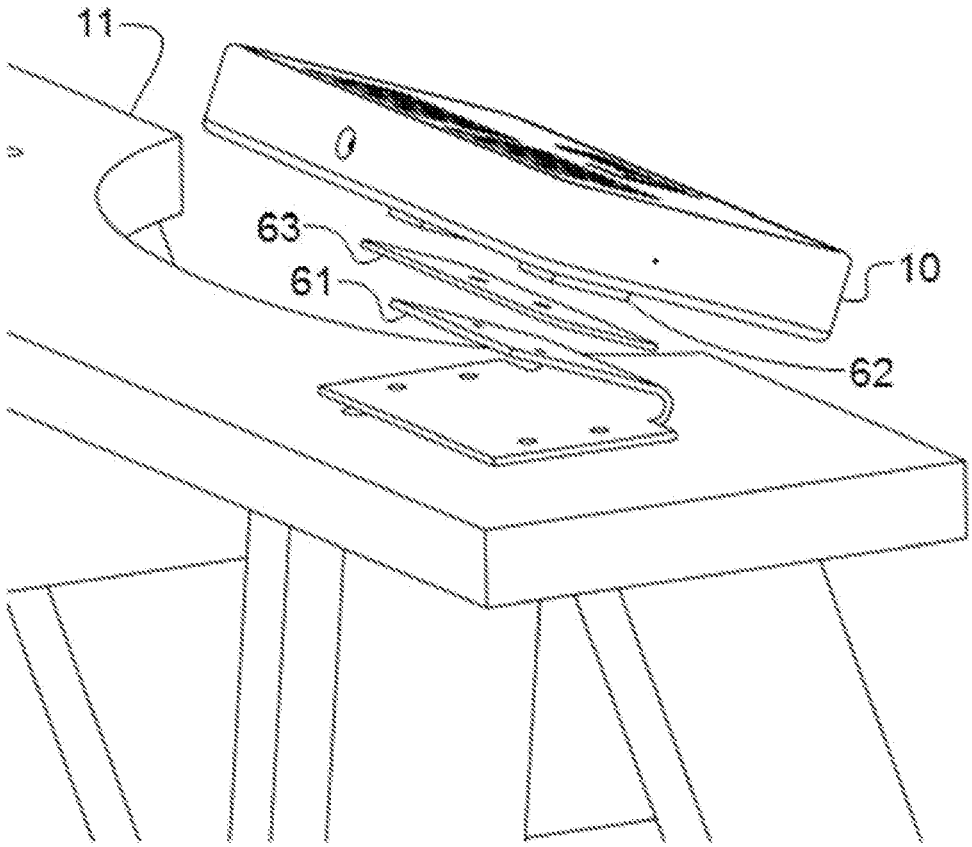
FIG. 14 is an exploded view of the golf bag stand embodiment of distance calculator embodiment of FIG. 13.
Figure 16:
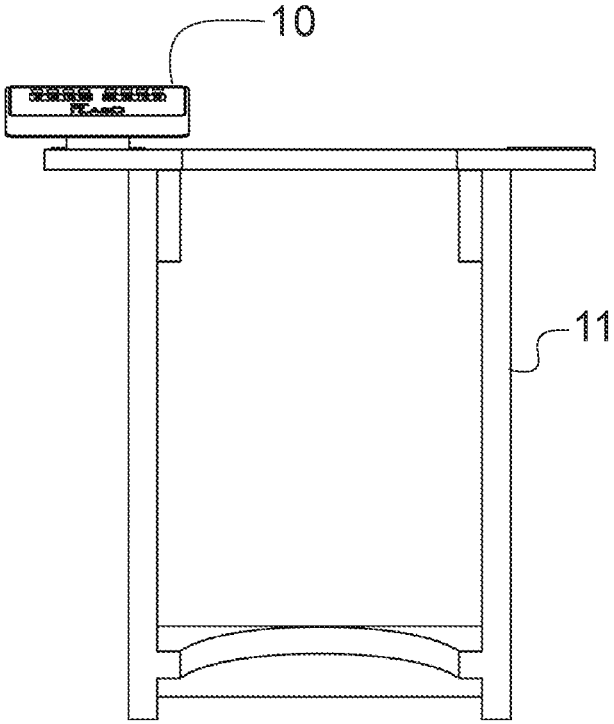
FIG. 16 is an elevation view of the golf bag stand embodiment of distance calculator embodiment of FIG. 13
Figure 15:
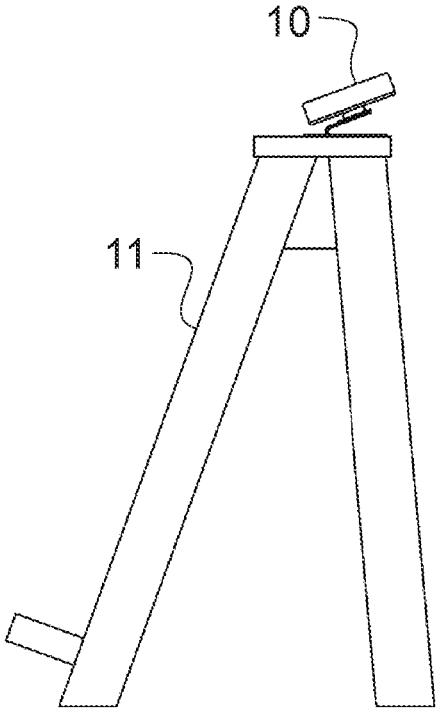
FIG. 15 is a side view of the golf bag stand embodiment of distance calculator embodiment of FIG. 13

In some cases, much of the functionality of the distance calculator 10 may be accomplished via electrical components disposed on the PCB 64 as shown in FIG. 8. For example, the PCB 64 may be populated with the processor such as a microprocessor 82 of the controller 18, external memory 20, power conditioning and regulation circuitry 104, display driver components 86 (shown in FIG. 8), and the wireless communication transceiver module 40 to enable wireless data transfer from one distance calculator 10 to another distance calculator 10. The housing 16 of the distance calculator 10 may be configured with water and weather resistance for continuous use in an outside environment. The microencapsulated electrophoretic display screens 34 are typically well suited for outside use due to the high contrast quality of the display when viewing in direct sunlight. In use at a golf practice range, such as a driving range, an embodiment of the distance calculator 10 may generally be mounted at or close to each hitting position 60 as shown in FIG. 12. Each distance calculator 10 may thus display the display range values from that distance calculator 10 to each fixed target flag 12 of the golf driving range 14.

In general, power management and extended battery life may be desirable features of some distance calculator embodiments 10 discussed herein. As such, for some distance calculator embodiments 10, the controller 18 may include a circuit configured to effectively disconnect the batteries from all electronics of the distance calculator 10 when the distance calculator 10 is in an inactive state where display distance yardages 33 are being displayed but no calculations or data acquisition is occurring within the device 10. When the update interface 38 is actuated by being momentarily pressed by a user, the update switch 39 completes a circuit between the batteries 52 and the PCB 64 thereby providing initial power to the microprocessor 82. During such an initialization process, the microprocessor 82 may set up a general purpose input/output (GPIO) output on a latch circuit in order to maintain power from the batteries 52 to the microprocessor 82 as well as other components of the distance calculator 10. At this point, an audible beep sound is emitted from a beeper 83 when power has been latched indicating to the user that the distance calculator 10 has been activated and the update switch 39 no longer needs to be pressed. In some cases, a user will interpret the audible beep as occurring immediately after pressing the update switch 39.

In normal operation, the GPS receiver 28 will be powered up and the microprocessor 82 will monitor incoming serial data from the GPS receiver 28 until a location fix is achieved and the incoming serial data indicated to be valid. A data collection algorithm includes a specific multi-step sequence that includes optional delays and multiple GPS receiver electrical connect/disconnect cycles to ensure that the location values for a current position of the distance calculator 10 are stable. When the current position acquisition stage is complete using the GPS receiver 28, the distances from the current position to each stored target position are calculated in the microprocessor 82 and the distance results displayed on the respective distance displays 32. After the distance displays 32 have all been updated with updated display distance values 33, the microprocessor 82 clears the GPIO output to release the battery power latch switch and the batteries 52 are then effectively disconnected from all electronics of the various circuits of the distance calculator 10 to preserve batter life.

In addition to the function of the update interface 38 discussed above, additional functionality may be accessed using the menu buttons 46, 48 and 50, to enable storing and changing the stored location data of targets 12, selecting pre-stored target locations, establishing wireless links with another distance calculator 10, changing the fonts of display distance values 33, as well as other utility features. Display fonts, target position data, and diagnostic data may be stored in the memory storage 20. The wireless link port 40 may enable wireless communication with other distance calculators 10 as well as other external devices for target position data transfer, file updates, firmware updates etc. without opening up the housing 16 of the distance calculator 10. The wired communication port 41 may be used to transfer initial factory data during a production process as well as other diagnostic functions.

Referring to FIG. 9, exemplary menu option sequences are shown for some of the functions discussed above. In particular, some embodiments of the distance calculator 10 may be operated in one of three different modes at any time. The three modes include a "default mode" which is schematically indicated by the dashed box 94, a "set target positions mode" which is schematically indicated by dashed box 96, and "menu options mode" which is indicated by dashed box 98, as shown in FIG. 9. As discussed above, when the update switch 39 is actuated, the microprocessor 82 will execute a routine to determine the location of the distance calculator 10, update the distances to all the stored target positions, and display the updated results on the distance displays 32. The microprocessor 82 will then disconnect the batteries 52 to the electronics of the distance calculator 10. In some cases, this sequence is performed automatically so the user of the distance calculator 10 can simply press the update switch 39 and walk away from the device. That is, this arrangement provides a set it and forget it type configuration for such embodiments.

In order to acquire and store target position data using the "set target positions mode" 96, a user takes the distance calculator 10 to the physical location of a target 12 and presses the update switch 39 to power up the microprocessor 82 and enter the "default mode" 94. Thereafter, the "down" button 48 of the membrane switch 42 is depressed to exit the "default mode" 94 and to enter the "set target positions mode" 96. The user then waits till an hourglass icon on one of the distance displays 32 changes from the hourglass icon to a fix icon. This change in icon status indicates that the GPS receiver has achieved a valid position data condition. The "down" button 48 is then depressed again until an indicator arrow is shown on the correct distance display 32. The correct distance display 32 would generally be the distance display 32 that is adjacent the flag indicator 36 that corresponds to the target 12 at which the distance calculator 10 is located during this process. The "up" button 46 may also be used at this stage to properly position the indicator arrow under the appropriate target indicator 36. The "enter" button 50 may then be depressed in order to store the current position data acquired by the GPS receiver into the memory storage 20 at an address that corresponds to the selected distance display 32.

The distance calculator may then be moved to the position of the next target 12 to be programmed into the distance calculator 10 and the process above repeated until the target positions of all desired targets 12 are properly stored in the memory storage 20 of the distance calculator 10. After acquiring and storing the final target position into the memory storage 20, a menu exit protocol may then be executed such as by pressing the "enter" button 50 and update switch 39 at the same time or any other designated button sequence to power down the entire distance calculator 10. Thereafter, at any desired time, the user may then take the distance calculator 10 to any desired hitting position 60 and execute the "default mode" sequence by simply pressing the update switch 39. The microprocessor 82 will then capture the current position of the distance calculator 10, calculate the distances from that current position to each of the stored target positions and then update the display distances 33 displayed on each of the programmed distance displays 32. The stored target position data acquired and stored by the preceding steps may also be transferred to other non-programmed distance calculators 10 by wireless link 40 or any other suitable method.

The "menu options mode" enables a user to execute certain other functions for utility purposes and the like. For some embodiments, the "menu options mode" include a "RxPins", "TxPins", "Reset", and "Recover" options. The "menu options mode" may be activated by pressing the update switch 39 followed by pressing the "up" button 46 of the auxiliary interface 42 in order to exit the "default mode" and enter the "menu options mode". Access to the different functions within the "menu options mode" may be achieved by using the "up" button 46 and "down" button 48 as shown in FIG. 9.

Selection of the "TxPins" option enables transmission of stored target position data to other distance calculators 10. Pressing the "enter" button 50 in this menu option causes the distance calculator 10 to "listen" for wireless requests from other distance calculator units 10. If a wireless request command is received, the microprocessor 82 will then transmit the stored target position data to the distance calculator 10 that made the request and then wait for the other unit to echo back the transmitted dataset. The returned dataset will be compared to the sent dataset and if there is a match, a confirmation acknowledgement string will be sent. If there is not a match, the microprocessor 82 will repeat the transmit/verify cycle until no errors are detected or until a maximum number of retries have been executed. To exit the "TxPins" mode, any key may be pressed. The microprocessor will update the distance displays 32 then power down as discussed above.

The "RxPins" mode enables the distance calculator 10 to receive stored target position data from another distance calculator 10. To receive stored target position data from another distance calculator 10 in "TxPins" mode, the "enter" button 50 may be pressed while in the "RxPins" mode. The wireless transfer process discussed above may then be executed. The "Reset" menu option will clear all stored target position data from the memory storage 20 of the distance calculator 10. Pressing the "enter" button 50 while in the "Reset" menu option will clears all stored target position data, updates the distance displays 32 and powers down the distance calculator 10. Actuation of the "Recover" menu option will undo the "Reset" function, update the display then power down the distance calculator 10.

For some distance calculator embodiments 10, an order of assembly of the distance calculator 10 may be as follows. Initially, firmware may be downloaded to the microprocessor 82 on the PCB 64 and data downloaded into the external memory storage 20 on PCB 64. The two microencapsulated electrophoretic display screens 34 are then attached and operatively coupled to the PCB 64 and the two battery holders 66 coupled to the case bottom 44. The membrane switch 42 may be attached to the case bottom 44. The PCB 64 is secured to the case bottom 44. The faceplate 54 is attached to the case top 68 and four AA batteries 52 installed into the battery holders 66. The GPS receiver 28 is secured to the non-metallic backside surface of the faceplate 54 centered inside the opening in the top case 68. Connectors from the two battery holders 66, the membrane switch 42, the update switch 39, and the GPS receiver 28 are operatively coupled to mating connectors on the PCB 64. The case sealing O-ring 70 is secured to the case bottom 44 and the case top 68 (shown in FIG. 7) attached to the case bottom 44 using a plurality of case assembly screws 72. Finally, the mount magnets 62 may be secured to the case bottom 44 with screws or any other suitable fastener.

Since the purpose of some distance calculator embodiments 10 may typically include displaying distances from the distance calculator 10 to a distant target 12 (such as a flag on a golf practice range), a golfer 78 that is a client or customer of a golf practice facility may use the distance calculator 10 by simply reading the display distance yardage values 33 displayed on the distance displays 32 of the distance calculator 10 for the target 12 of interest with the distance calculator 10 disposed at or near the hitting position 60 of the golfer 78. The golfer 78 may then select the appropriate golf club and swing intensity to hit a golf ball to the target 12 of interest based on the displayed distance yardage value of the target 12. A "service oriented" user, such as a greenskeeper of a golf practice range, may use embodiments of the distance calculators 10 discussed herein to reduce the amount of time and energy required to supply their customers with accurate distance measurements to the multiple targets 12 of the golf practice ranges 14 that they operate.

Figure 10:
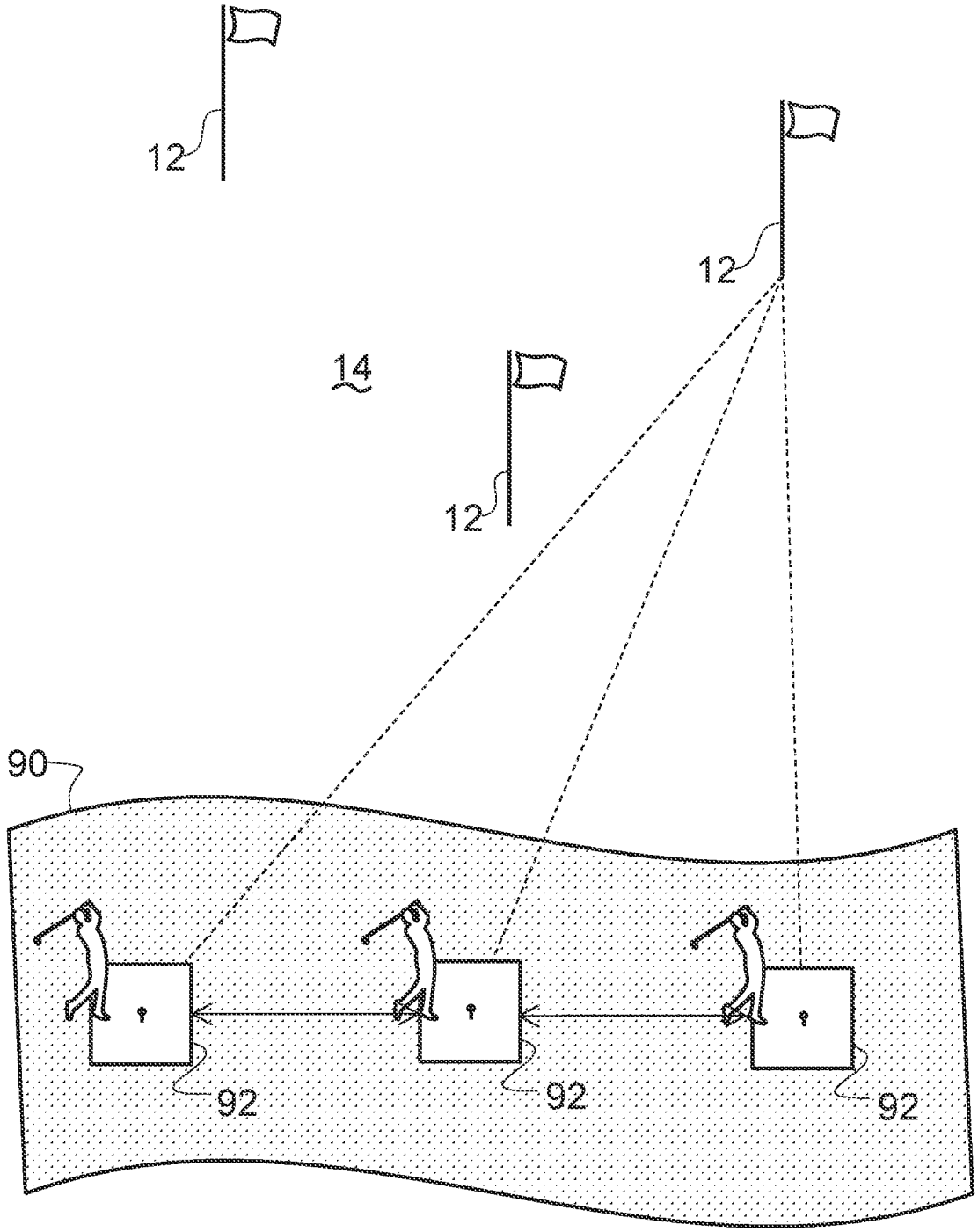
FIG. 10 is a schematic view of a golf practice range embodiment illustrating a varying effective distance to a single target from three different hitting stations located at different positions.

Referring to FIG. 10, it can be seen that at a typical golf practice range 14, designated hitting stations 92 may be arranged in a substantially equidistant side by side linear formatting along a hitting line which keeps the golfers 78 aligned with the targets 12 of the golf practice range 14 and avoids golfers 78 from hitting towards each other. However, this linear arrangement results in each hitting station 92 being disposed at distances from the targets 12 that are different than the distances from the targets 12 of other hitting stations 92. As such, each hitting station has a unique set of distance yardage values relative to each of the targets 12 of the golf practice range 14. As such, it is desirable for the distance yardage values used by a golfer 78 at a given hitting station 92 to be calculated specifically for that particular hitting station 92.

In addition, as discussed above, the hitting position 60 of a golfer 78 in the context of a golf practice range will be a position from which a golfer 78 will typically take multiple practice shots such as by hitting a bucket of range balls often with a variety of clubs from that same hitting position 60. In some cases, a golfer 78 may take 10 or more shots from such a single hitting position 60 of a golf practice range 14. Sometimes, at least 20, 50 or 100 shots or more may be taken by a golfer 78 at a single hitting position 60 at a golf practice range 14 depending on a particular golfer's stamina, goals, perseverance etc. This is generally in contrast to play carried out on a regulation golf course where it is anticipated (and desirable) for the golfer 78 to take no more than one shot from a given hitting position 60 on the regulation golf course during play.

Figure 11:
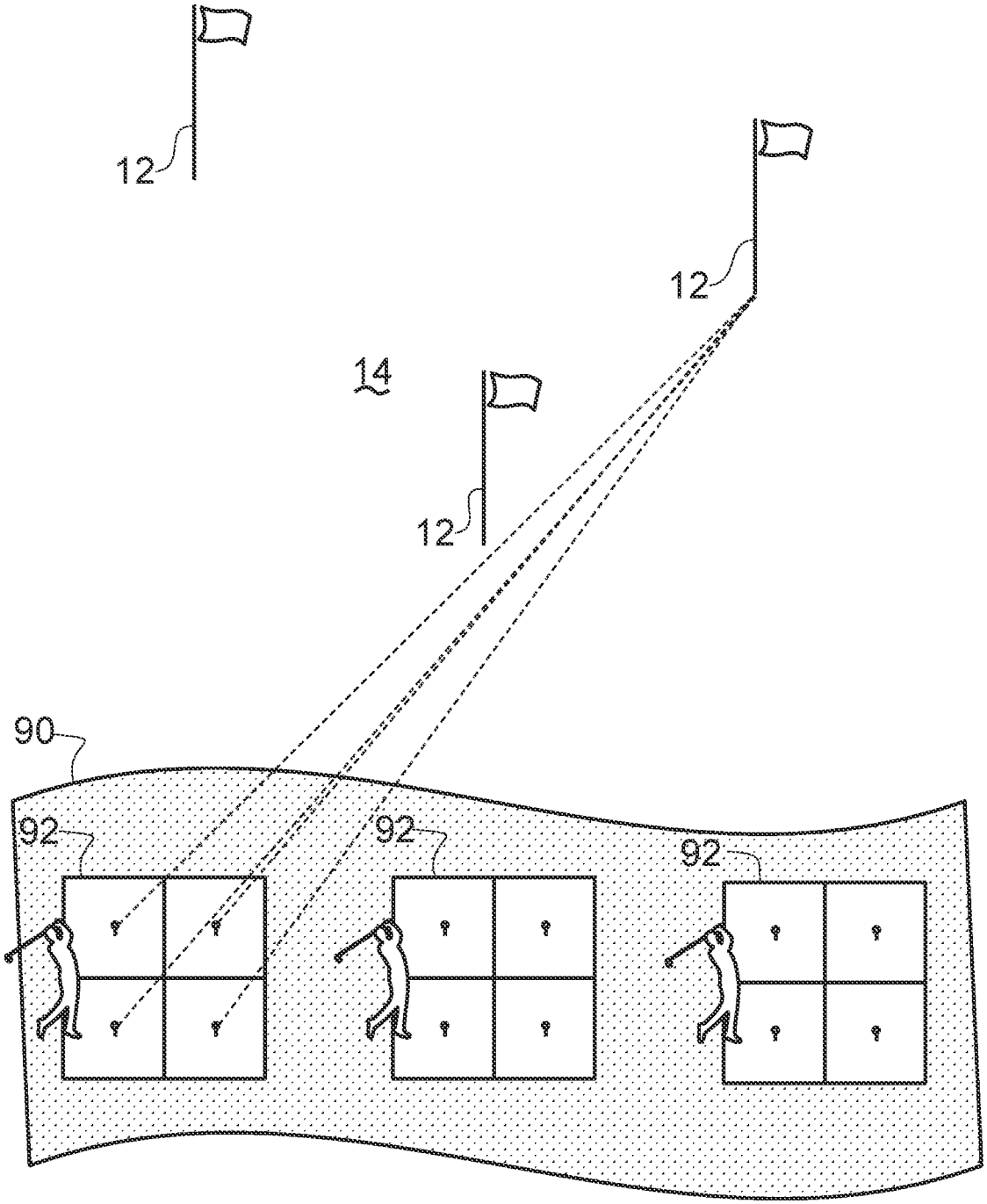
FIG. 11 is a schematic view of golf practice range embodiment illustrating varying effective distance to a single target from four different hitting zones "a", "b", "c", and "d" of the same hitting station.

As such, when multiple hits such 10 or more hits are deliberately taken from a single hitting position 60 on a golf practice course 14, it may be desirable to rotate and reposition the hitting position 60 at regular intervals, particularly where the hitting position 60 is disposed on a natural living grass surface 90, as shown in FIG. 11. This rotation of the hitting position 60 may be performed in order to let the natural grass surface 90 of a hitting station 92 recover and rejuvenate at the position of the most recent hitting position 60. It should be noted that the location of the hitting positions 60 of a golf practice range 14 may also be relocated or otherwise moved for any other reason such as a course redesign and the like.

FIG. 11 shows a grass practice area that includes multiple hitting stations 92. Each hitting station for the practice area shown includes four exemplary hitting zones which are labeled a, b, c and d within which the hitting position 60 and distance calculator 10 may be disposed. As such, if on day one the hitting positions at the hitting stations 92 or any subset thereof are all disposed within respective hitting zones "a", the following day, or interval of multiple days, those same hitting positions 60 and associated distance calculators 10 may be relocated to respective hitting zones "b" and so on until the grass quality in the "a" hitting zones has recovered and the hitting positions 60 and associated distance calculators 10 may be rotated back to the "a" hitting zones and the process then started over. In some cases, the hitting positions 60 may just be moved front to back ("a" to "d", then "d" to "a" for example) or side to side ("a" to "b" then "b" to "a" for example), but they may also be rotated around the entire hitting station 92 such as in an "a" to "b", "b" to "c", "c" to "d" and back to "a" pattern.

Referring to FIG. 12, upon such relocation, each of the distance calculators 10 disposed at each of the respective relocated hitting positions 60 on the golf practice range 14 may then be updated by simply actuating the update interface 38. Upon such actuation of the update interface 38, the GPS receiver 28 will acquire the position of the distance calculator 10 at the new hitting position 60 and then recalculate and update the displayed distance yardage values 33 on the respective distance displays 32. It should be noted that this step of updating the displayed yardage distances 33 for the new relocated location of the hitting position 60 and corresponding distance calculator 10 is made more efficient and convenient with regard to time and power consumption by virtue of the microprocessor reusing the previously acquired position/coordinate data for each of the plurality of stored target positions of some or all of the targets 12 of the golf practice range 14. As such, upon actuation of the update interface 38, the GPS receiver 28 temporarily uses stored energy from the batteries 52 to reacquire the new position of the distance calculator 10, and the microprocessor 82 uses stored energy from the batteries 52 to recalculate the updated display distance yardage values 33, however, no stored energy is required in order to reacquire the position data for each of the targets 12 for which display distance yardage values 33 are being displayed. In addition, once the updated display distance yardage values 33 have been displayed on the respective distance displays 32 of the distance calculator 10, power to the entire electrical and electronic system may be shut off automatically to eliminate any further power consumption once updated.

Another efficiency associated with the system of the use of multiple distance calculator embodiments 10 discussed herein, is that they may be essentially interchangeable for the golf practice range management or any other user or owner of multiple distance calculators 10. For example, at the end of operating hours of a golf practice range facility that utilizes about 5 distance calculators to about 30 distance calculators or more, the greenskeeper or other person in charge of maintaining the golf practice range may physically gather the multiple distance calculator embodiments 10 from the respective multiple hitting positions 60 and return the devices to the clubhouse in a suitable container. The following day, prior to opening, the greenskeeper may take the container of multiple distance calculators 10 out to the hitting stations 92, and re-secure any of the distance calculators in the container to the golf bag stand 11 of any of the respective hitting positions 60 on the range and then updating each of the re-secured distance calculators 10 by actuation of the update interface 38 of each. The distance calculators 10 are completely interchangeable because they each have the same stored target position data/coordinates stored in the memory storage 20. As such, there is no need for the greenskeeper to keep track of which distance calculator 10 is associated with a particular hitting station 92.

Another feature that may produce similar convenience and efficiency for a commercial user of multiple distance calculator embodiments 10 is the ability to store target position data for targets 12 that are stored in an inactive state and for which no yardage distance calculations are made by the microprocessor 82 upon actuation of the update interface 38. This allows the golf practice course management to store target position data for the targets 12 of multiple practice range configurations and then having the option of whether or not to calculate and display distances based on this stored data depending on whether or not the stored data is set to an active state or inactive state. This feature may be useful for golf facilities that put on special events on occasion that require an alternative configuration to the golf practice range 14. Youth events, certain weather changes or patterns or the like may be exemplary scenarios requiring an alternative configuration or layout of various targets 12.

Also as discussed above, some embodiments of a method of calculating and simultaneously displaying a plurality of yardage distances measured from a plurality of targets 12 on a golf practice range 14 to a distance calculator 10, may include positioning the distance calculator 10 at a first target 12 of a golf practice range 14 and initiating GPS calculation by the GPS receiver 28 the distance calculator 10 of a first target position by receiving GPS satellite signal data from at least three GPS satellites with the antenna 30 of a GPS receiver 28 of the distance calculator 10 and determining the coordinates of the first target position while the distance calculator 10 is positioned at the first target 12. Thereafter, the first target position may be stored into the memory storage 20 of the distance calculator 10 in a storage location or address associated with a first distance display of the distance calculator 10.

After storing the first target position, the distance calculator 10 may be positioned at a second target 12 of a golf practice range 14. After so positioning the distance calculator 10, GPS calculation may be initiated by the GPS receiver 28 of the distance calculator 10 to determine a second target position by again receiving GPS satellite signal data from at least three GPS satellites with the antenna 30 of the GPS receiver 28 of the distance calculator 10 and thereafter determining the coordinates of the second target position while the distance calculator 10 is positioned at the second target 12. Once the second target position has been determined, the second target position may be stored into the memory storage 20 of the distance calculator 10 in a storage location or address associated with a second distance display 32 of the distance calculator 10. In some cases, about 2 target positions to about 20 target positions may be determined by the GPS receiver 28 and stored in the memory storage 20, however, any suitable or desirable plural number of target positions may be acquired and so stored. For example, in some cases, about 3 target positions to about 12 target positions may be determined and stored in the memory storage 20.

After storing the second target position, the distance calculator 10 may then be positioned at a hitting position 60 on the golf practice range 14 and an update command of the distance calculator 10 initiated by actuation of the update interface switch 39. The determination of the hitting position 60 is made by initiating GPS calculation of the hitting position 60 and again receiving GPS satellite signal data from at least three GPS satellites with the antenna 30 of the GPS receiver 28 of the distance calculator 10 and determining the hitting position 60 with the distance calculator 10 disposed at the hitting position 60. Once the hitting position 60 has been determined by the GPS receiver 28, a first display distance value 33 measured between the first target position 12 and the hitting position 60 may be calculated with the microprocessor 82 of the distance calculator 10. A second display distance value 33 measured between the second target position 12 and the hitting position 60 may also be calculated with the microprocessor 82 of the distance calculator 10. Thereafter, the first display distance value 33 may be displayed on the first distance display 32 of the distance calculator 10 and the second display distance value 33 may be displayed on the second distance display 32 of the distance calculator 10. In some cases, in order to conserve stored power and increase battery life, power to the first distance display 32 and the second distance display 32 may be discontinued after displaying the first display distance value 33 on the first distance display 32 and displaying the second display distance value 33 on the second distance display 32.

In some instances, for distance calculator embodiments that include a communication link 40, the stored target positions through the communication link 40 of the distance calculator 10 to a communication link 40 of a second distance calculator 10. For embodiments wherein the respective communication links 40 include wireless communication links, the stored target positions may be transmitted wirelessly. It should be noted that such transmission of stored target positions may be transmitted through respective communication links 40 from any distance calculator 10 to any number of other distance calculators 10 that are suitably equipped with a communication links 40 which are configured to transmit and receive from the host distance calculator 10. It should also be noted that the transmission of stored target positions and/or other internal data may be carried out between one or more distance calculators and an external data aggregator, data processor, or network communication link.

As discussed above and illustrated in FIG. 9, embodiments of an update procedure for updating display distances of a distance calculator may include the following steps. After the distance calculator embodiment is moved to a different hitting position, an update sequence may be initiated by depressing the recessed switch using a golf tee or by any other suitable method. The controller of the distance calculator may then automatically re-calculate the new distances and update the display distances. Embodiments of an initial setup of a single distance calculator may include the following steps. To determine the positions of the targets (such as flags on the golf driving range), a single distance calculator may be physically taken to a target. The position coordinates of the target are then captured by the GPS receiver using menu commands on the display accessed by pressing the buttons on the membrane switch. This procedure may be repeated to capture the remote position coordinates for each fixed flag target. This single distance calculator may then be returned and mounted back to its reference location (such as on the golf bag stand 11) near the hitting position of the golfer 78. The update procedure described above may then performed and the distance calculator will display the display distances to the plurality of target flags.

Embodiments of methods for initial setup of multiple distance calculators may include the following procedure. When multiple distance calculators are utilized (as would be the typical case of providing at least one distance calculator at each of a plurality of hitting positions at a golf practice range), the location coordinates of each desired target may be stored into the memory storage of multiple distance calculators. This may be accomplished by first initializing a single distance calculator as discussed above. The stored target positions stored in the single initialized distance calculator may then be wirelessly transferred to each additional distance calculator using menu commands accessed by pressing the appropriate buttons on the membrane switch.

The distance calculator embodiments 10 discussed above are generally configured to display the respective distances from the distance calculator 10 to various multiple targets (such as a flag 12) located on the golf practice range 14 using GPS technology or the like. Such distance calculator embodiments 10 allow the golfer 78 to accurately gauge their distances to the multiple targets 12 regardless of the hitting position 60 from which they are hitting once the distance calculator 10 has been set and updated for each hitting position 60. The golfer 78 need only read the display value corresponding to the target flag 12 of interest which is a very simple method from the golfer's perspective to have accurate distance measurements. However, as discussed above, what has also been needed are efficient devices and methods for reconfiguring a suitable golf hole of a golf course rather than a practice range and conveniently displaying the range from the cup of the golf hole, which may be marked with a flag, to the various respective tee hitting positions of a golf hole which may include a reconfigured golf hole. That is, what has been needed are efficient systems and methods for establishing and displaying the distance from a single target, such as a golf cup, to one or more tee hitting positions of the golf hole.

Some embodiments of distance display systems for displaying distances between one or more tee hitting positions and a target such as a cup on the green of a golf hole of a golf course may include a primary display, also referred to herein as a "big board" or "placard" as well as one or more locator pucks, also referred to herein as "tee box pucks" or "pucks". In general, the primary display may be mounted at an entrance or pathway adjacent to the tee boxes also referred to herein as tee hitting positions of a golf hole of a golf course, such as a par 3 hole. In general, the primary display may be positioned in a location that would conveniently provide the golfer with the distance measurement information while the golfer is still in close proximity to their parked golf cart so that the distance information may be used for club selection prior to hitting from the selected tee hitting position. One or more locator pucks may be mounted to or adjacent to respective tee hitting positions marked with tee box markers also referred to as tee box indicators. Typically, such distance display system embodiments are configured to measure and display distances between one or more locator pucks and a single target, although such distance display system embodiments are also contemplated which may be configured to measure and display distances between one or more locator pucks and multiple targets, such as cups of a golf hole or golf holes which may be marked with a flag. The distance display system embodiments discussed herein may have some functions or components which may be similar in many respects to those of the distance calculator embodiments discussed above and may include any of the suitable features, dimensions or materials of any of the distance calculator embodiments discussed above.

Figure 17:
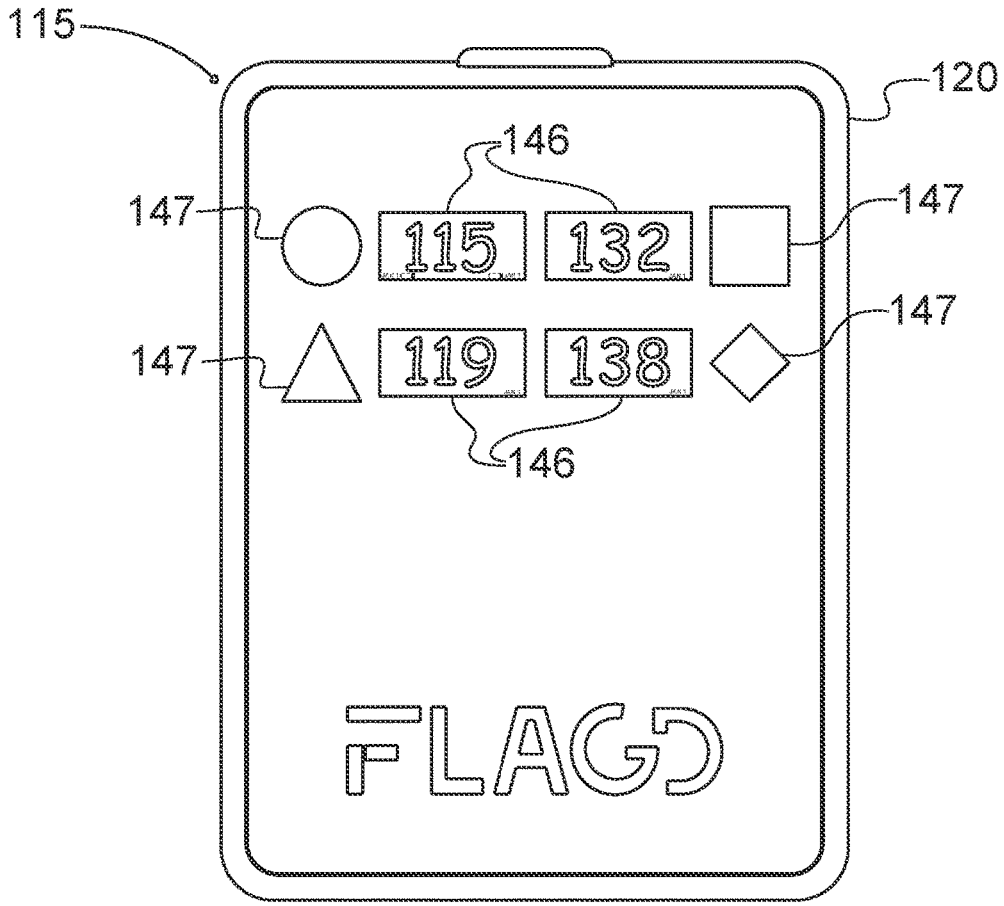
FIG. 17 is an elevation view of a distance display system including a primary display and four locator pucks.
Figure 17:
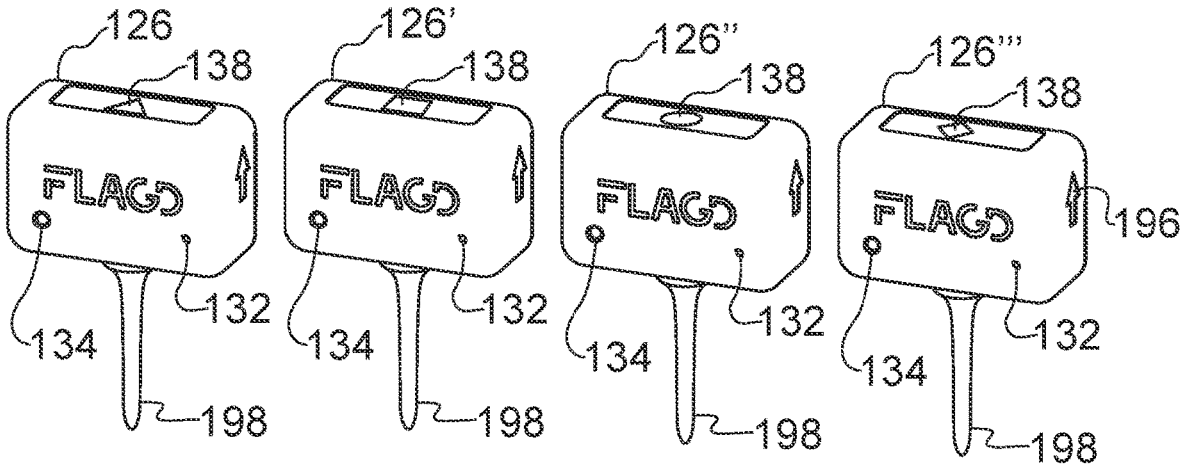
Figure 18:
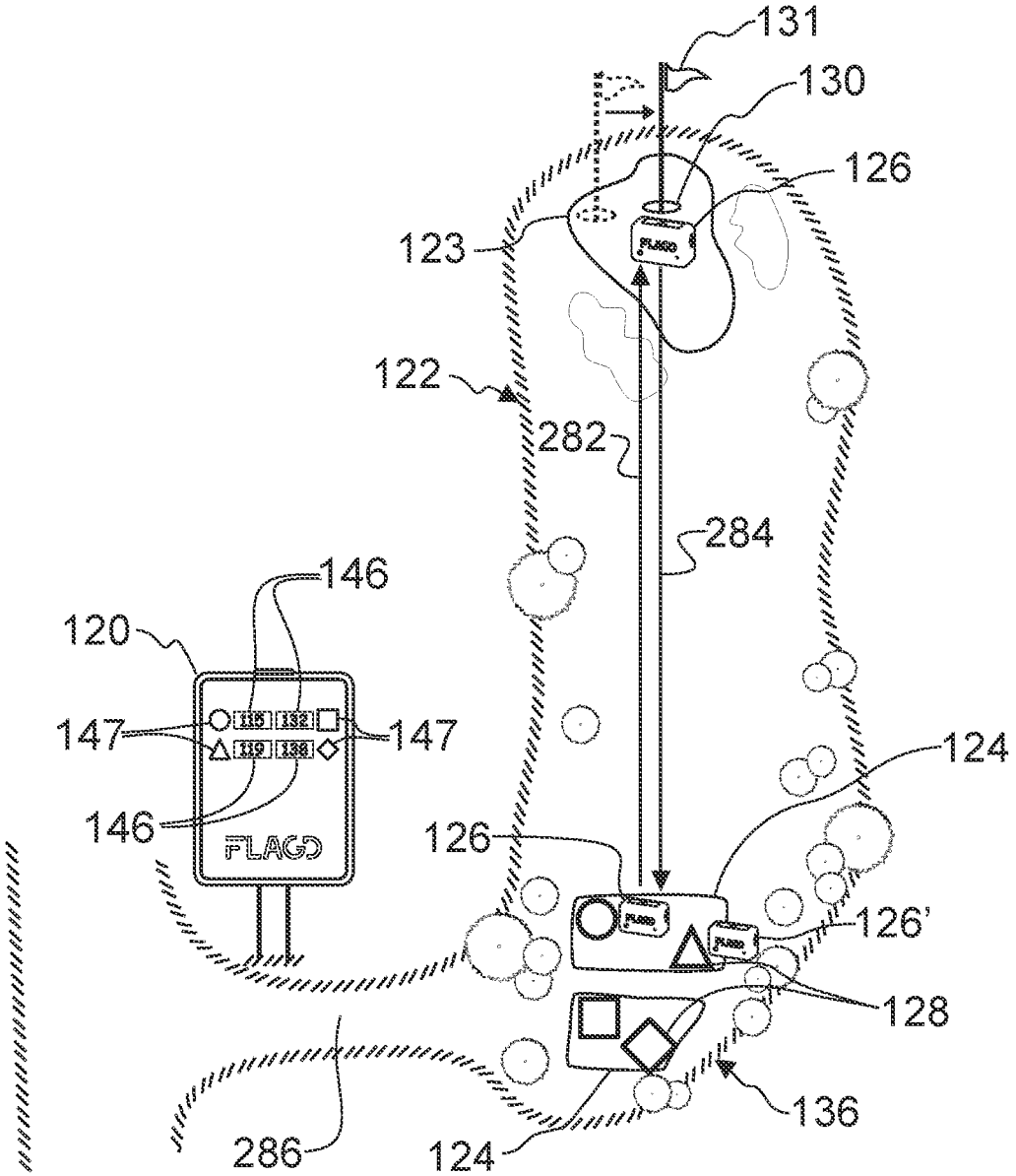
FIG. 18 is a schematic representation of a method of distance calculation and display using an embodiment of a distance display system.
Figure 19:
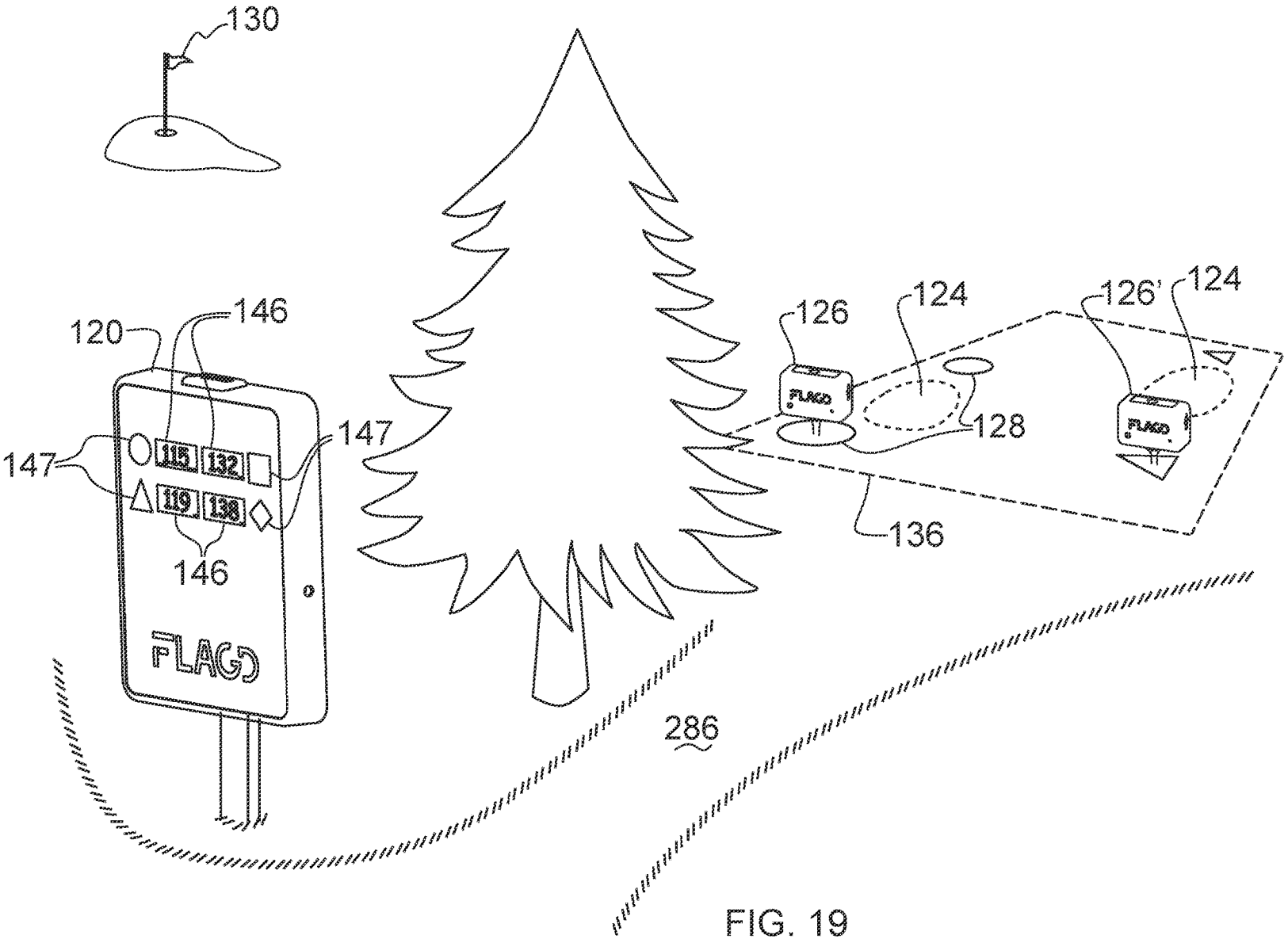
FIG. 19 is a perspective view of a primary display embodiment of a distance display system embodiment disposed adjacent an access path of a tee hitting position that includes a plurality of locator puck embodiments and associated tee box indicators of a golf hole.
Figure 20:
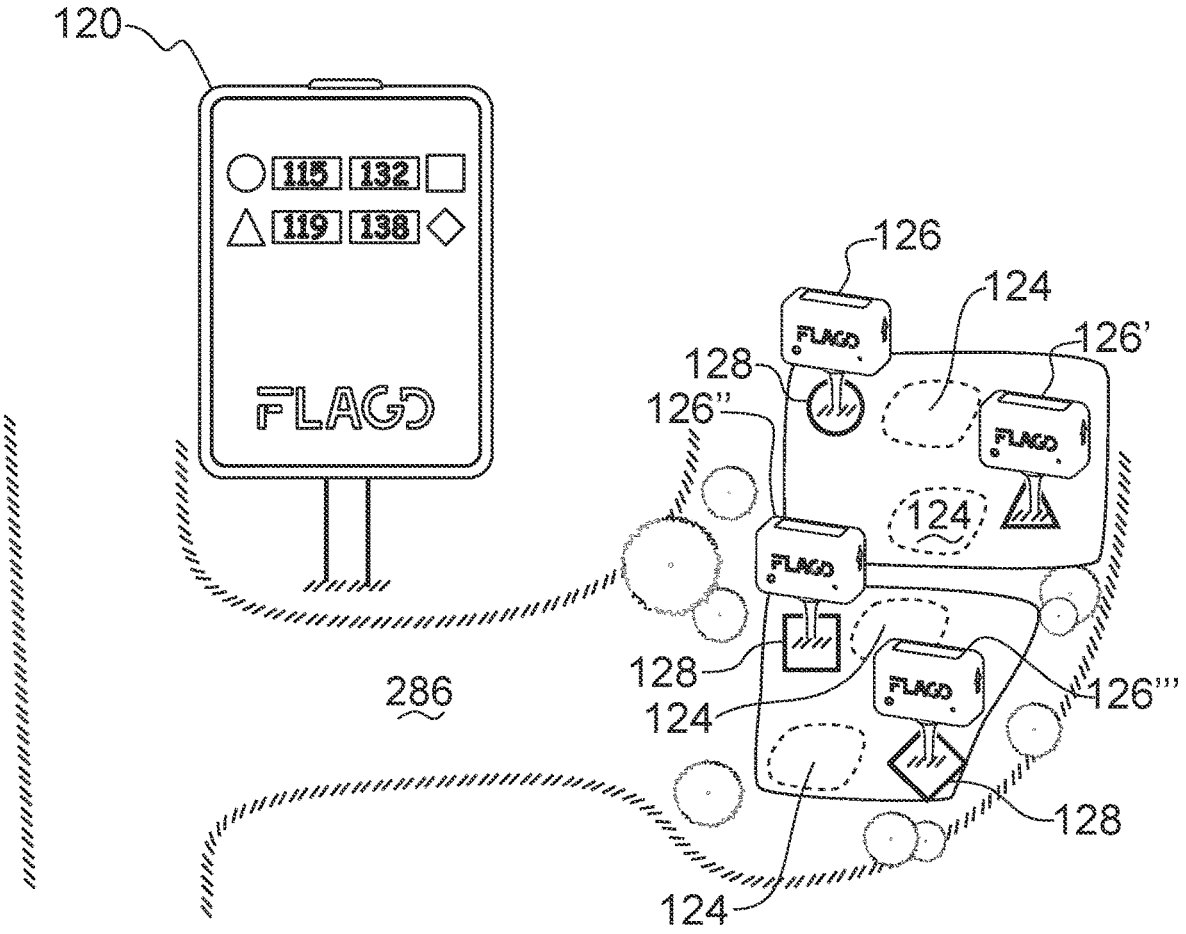
FIG. 20 is a perspective view of a primary display embodiment of a distance display system embodiment disposed adjacent an access path of a tee hitting position that includes a plurality of locator puck embodiments and associated tee box indicators.
Figure 21:
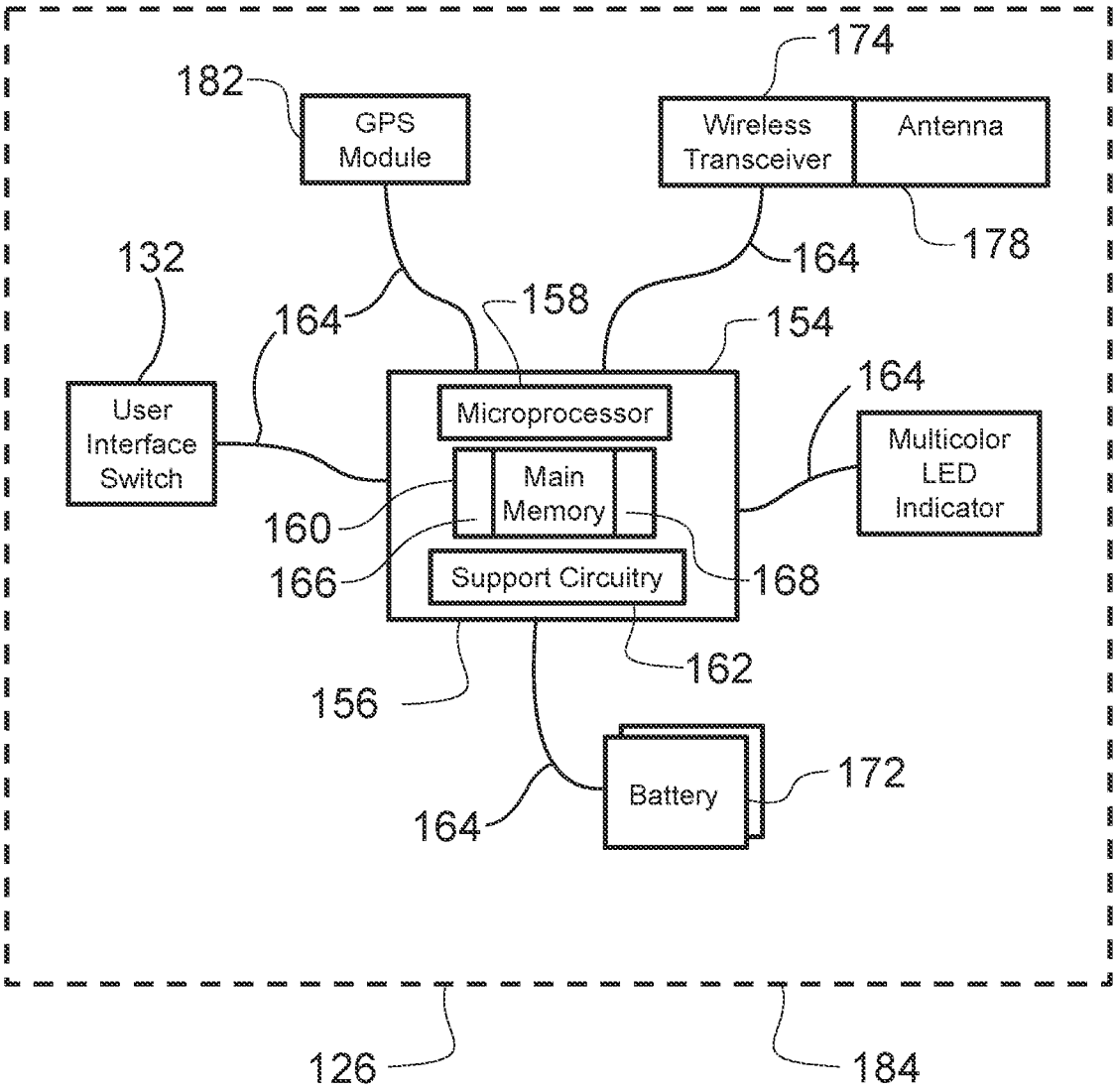
FIG. 21 is a schematic illustration of the internal electronic components of a locator puck embodiment.

A distance display system embodiment 115 for simultaneously displaying respective distances from a cup 130 of a golf hole 122 to one or more (including a plurality of) tee hitting positions 124 of the golf hole 122 is shown in FIGS. 17 and 18. In general, each cup target 130 may be marked with a vertically oriented flag 131 that includes a pole that extends vertically upward from a center of the cup 130. Each tee hitting position 124 may be disposed on or immediately adjacent a corresponding optional tee box marker or indicator 128, with such tee box indicator 128 matching a corresponding puck indicator 138 of a respective locator puck 126 of the distance display system 115. The distance display system embodiment 115 includes a primary display 120 that includes a plurality of display sites 146, and a separate respective display indicator 147 disposed adjacent each of the display sites 146. The distance display system embodiment 115 also includes one or more (including a plurality of) locator pucks 126, including the first locator puck 126, second locator puck 126', third locator puck 126" and fourth locator puck 126''' being included with the embodiment shown in FIG. 17. Locator puck 126 is shown in more detail in FIGS. 21, 23A-28.

Referring to FIGS. 21 and 23A-28, each locator puck 126 may include a puck controller 154 which may, in some cases, be disposed on a printed circuit board (PCB) 156. The puck controller 154 of the locator puck 126 may include a processor such as a microprocessor 158, a main puck memory 160 which is in operative communication with the processor 158 and certain support circuitry 162 which may also be in operative communication with the processor 158. For elements of distance display system embodiments 115 discussed herein which are referred to as being in operative communication, operatively coupled or the like, such elements may be coupled by any suitable information or energy conducting or transmitting conduit or conduits 164 such as conductive wires, fiber optic cables, wireless links or the like. The main puck memory 160 of the locator pucks 126 may also include a cup position memory 166 and a tee hitting position memory 168 included within a main memory 160.

For some embodiments, the locator pucks 126 also include a power source 172 such as a battery disposed in operative communication with the controller and a communication interface such as a wireless communication interface or transceiver 174 which is disposed in operative communication with the controller 154 and configured to communicate with a communication interface such as a wireless communication interface or transceiver 176 of the primary display 120. Such a mutual communication between the wireless transceiver 174 of the locator pucks 126 and the wireless transceiver 176 of the primary display 120 may also be affected by any suitable information or energy conducting or transmitting conduit or conduits 164 such as conductive wires, fiber optic cables, wireless links or the like as discussed above. In addition, in some embodiments of the distance display system 115 where wireless transceivers such as wireless transceivers 174, 176 are being used, there may be an issue of cross interference of wireless communication signals if two or more separate distance display systems 115 are being updated on the same golf course at the same time. As such, for some embodiments, the distance display system 115 may include a feature to enable simultaneous operation/updating of multiple distance display systems 115 even if the wireless communication signals between components of one distance display system 115 are overlapping with those of another. Such a feature may include an optional "group" configuration whereby one more distance display systems 115 of a first group are configured to transmit wireless communication signals at a different frequency or using different addresses relative to wireless communication signals of a second group of distance display systems 115.

Locator pucks 126 and primary displays 120 of the same group for such embodiments can only communicate with each other and not with locator pucks 126 or primary displays 120 of other groups. In such cases, the distance display systems 115 of a same group transmitting at the same wireless frequency or using the same predetermined set of addresses during update/setup can be positioned away from each other on the golf course to avoid interference or cross communication and distance display systems 115 of dissimilar groups may be positioned adjacent each other on the golf course. In some embodiments, the distance display system 115 may be set to a desired group by putting each locator puck 126 of the chosen distance display system 115 into a COM or communication mode whereby the controller 154 of each of the locator pucks 126 is awaiting instructions. In some cases, this may be initiated by a long press on the actuator interface 132 and indicated by a flashing red light indicator 134. All locator pucks 126 of the distance display system 115 being configured may be in this communication mode.

The primary display 120 of the distance display system 120 may then be actuated via the actuator interface 144 to set the primary display 120 to a desired group number, which may include selecting a predetermined group number from a number of groups such as about 2 groups to about 10 groups in some cases. One of such groups may then be selected using the buttons of the auxiliary user interface 264 or any other suitable user interface. When the desired group number for the distance display system 115 is so entered, the controller 222 configures itself to the selected group and sends selected group information to the respective controllers 154 of the locator pucks 126 (which are in COM mode) to also so configure themselves to the selected group. The controller 222 may also send instructions to the controllers 154 to shut down after so configuring themselves. The selected group number may be stored for the locator pucks 126 and primary display 120 and they will operate under the transmission and reception parameters of the selected group thereafter.

The wireless transceiver 174 may include an antenna, such as in integral antenna 178, for transmitting and receiving wireless electromagnetic signals. The locator puck 126 may also include a position measuring system 182 which may be configured to determine the position of the locator puck 126. The position measuring system 182 of each of the locator pucks 126 may include a global positioning system receiver which determines a position of the locator puck 126 by receiving global positioning system satellite signal data.

Each of these components may also be disposed within or otherwise on a puck housing 184 which may have enclosed walls in the form of an enclosed container. The enclosed hollow configuration of the puck housing 184, which may be weatherproof or sealed in some cases, may also include a vent hole 186 that provides communication between the interior volume of the puck housing 184 and the ambient atmosphere surrounding the puck housing 184 to enable equalization of air and/or water vapor pressure between the air inside the interior volume of the puck housing 184 and the outside ambient. Such pressure equalization may be useful in order to reduce stress on sealing materials of the puck housing 184 in some instances. In some cases, in order to maintain a waterproof or weatherproof configuration, the vent hole 186 may include a hydrophobic breathable cover material 67 (see FIG. 7) that is sealed to the structure of the puck housing 184 over the vent hole 186 on an interior wall of the puck housing 184. Waterproof breathable materials such as expanded polytetrafluoroethylene (Gortex®) or the like may be used for the cover material 67. The puck housing 184 may include a case bottom 188, a case top 190, an outer face plate 192, a rear cover 193 and four or more case assembly screws 194. A puck orientation indicator, such as the arrow 196, may be disposed on the puck housing and used to assist an operator of the distance display system 115 to properly place and orient the locator puck 126 during deployment.

The locator pucks 126 may also include an actuator interface 132 such as a button which may be disposed in operative communication with the puck controller 154. The actuator interface 132 may be disposed at or near an outer surface of the outer face plate 192 and accessible to an operator from outside the puck housing 184. A lighted indicator such as a multicolor LED indicator 134 may also be disposed in operative communication with the controller 154 and disposed on or near an outer surface of the outer face plate 192 of the locator puck embodiments 126. The lighted indicator 134 may be used in order to indicate to an operator or user a state of a programming step or the like. A puck indicator 138, that may include a visually distinct configuration, may also be disposed on the puck housing 184, such as on the case top 190 of the locator puck 126. The puck indicator 138 may optionally correspond to a respective tee box indicator 128 of the tee hitting area 124.

Figure 43:
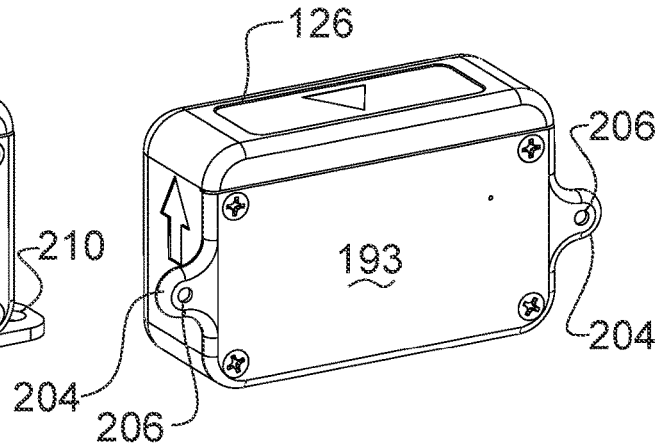
FIG. 43 is a rear perspective view of a locator puck embodiment that includes a pair of opposed mounting tabs extending laterally from a rear panel of the locator puck embodiment, each mounting tab including a respective mounting hole.
Figure 42:
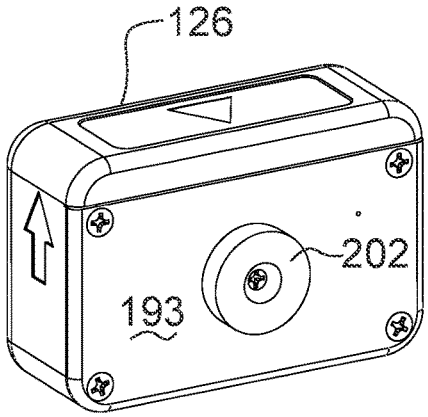
FIG. 42 is a rear perspective view of a locator puck embodiment that includes a magnetic mount disposed on a rear panel of the locator puck embodiment.
Figure 42A:
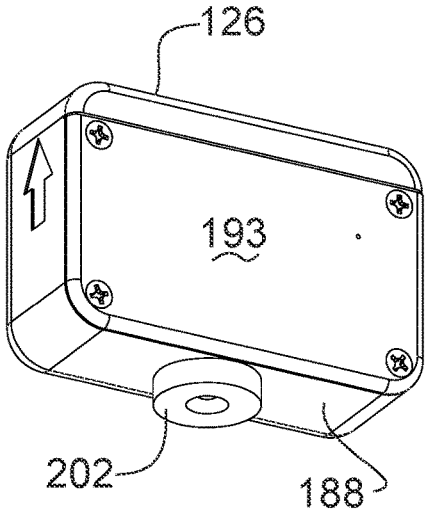
FIG. 42A is a rear perspective view of a locator puck embodiment that includes a magnetic mount disposed on a bottom panel of the locator puck embodiment.

The locator pucks 126 may be secured to an available surface at a desired position in any number of ways. An optional mounting spike 198 may be secured to and extend from the case bottom 188 of the puck housing 184 and be configured to penetrate sod or other fibrous or soft to intermediate materials to conveniently and removably secure the locator puck 126 to the surface of the tee hitting area 136. In addition, a wide variety of brackets may be used depending on the type of mounting surface. For example, FIG. 42 is a rear perspective view of a locator puck embodiment 126 that includes a magnetic mount 202 disposed on the rear panel 193 of the locator puck embodiment 126. FIG. 42A is a rear perspective view of a locator puck embodiment 126 that includes the magnetic mount 202 disposed on a bottom panel 188 of the locator puck embodiment 126. FIG. 43 is a rear perspective view of a locator puck embodiment 126 that includes a pair of opposed mounting tabs 204 extending laterally from the rear panel 193 of the locator puck embodiment 126, each mounting tab 204 including a respective mounting hole 206.

Figure 44:
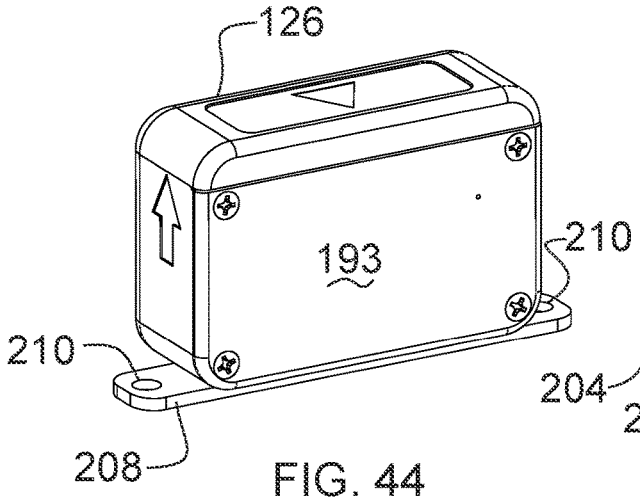
FIG. 44 illustrates a rear perspective view of an embodiment of a locator puck with a mounting bracket secured to a bottom panel of the locator puck embodiment.
Figure 48:
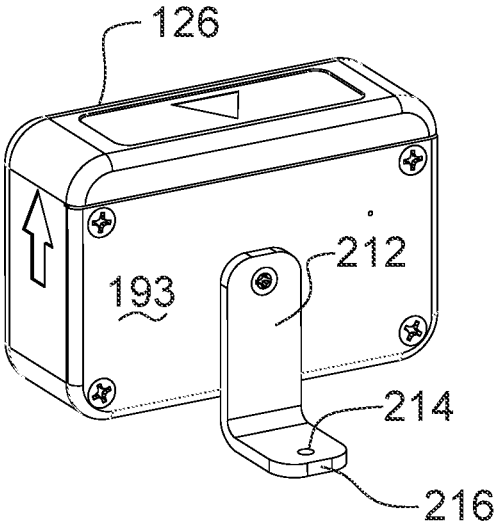
FIG. 48 is a rear perspective view of a locator puck embodiment that includes a 90 degree mounting bracket secured to a rear panel of the locator puck embodiment.
Figure 46:
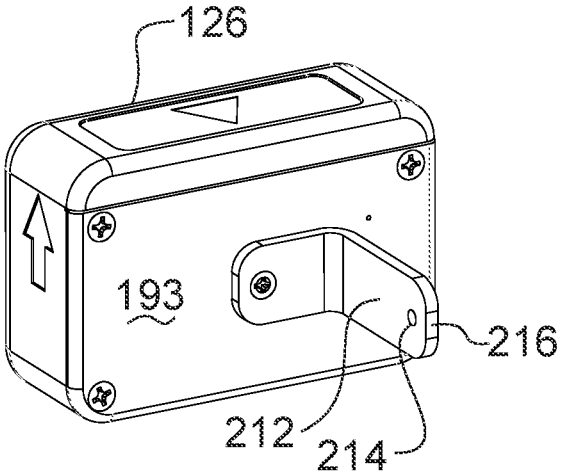
FIG. 46 is a rear perspective view of a locator puck embodiment that includes a 90 degree mounting bracket secured to a rear panel of the locator puck embodiment.
Figure 47:
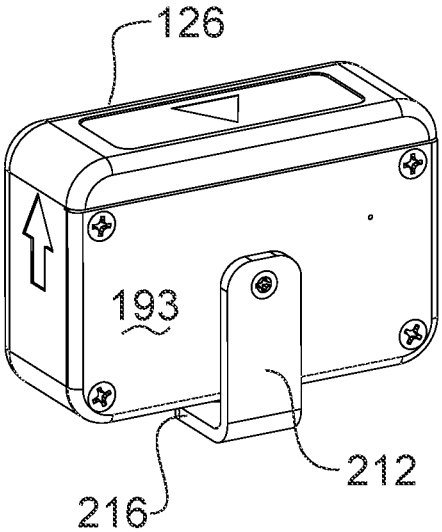
FIG. 47 is a rear perspective view of a locator puck embodiment that includes a 90 degree mounting bracket secured to a rear panel of the locator puck embodiment.
Figure 45:
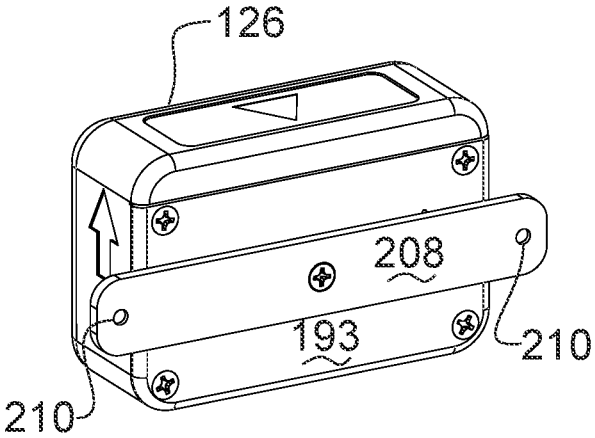
FIG. 45 illustrates a rear perspective view of an embodiment of a locator puck with a mounting bracket secured to a rear panel of the locator puck embodiment.
Figure 49:
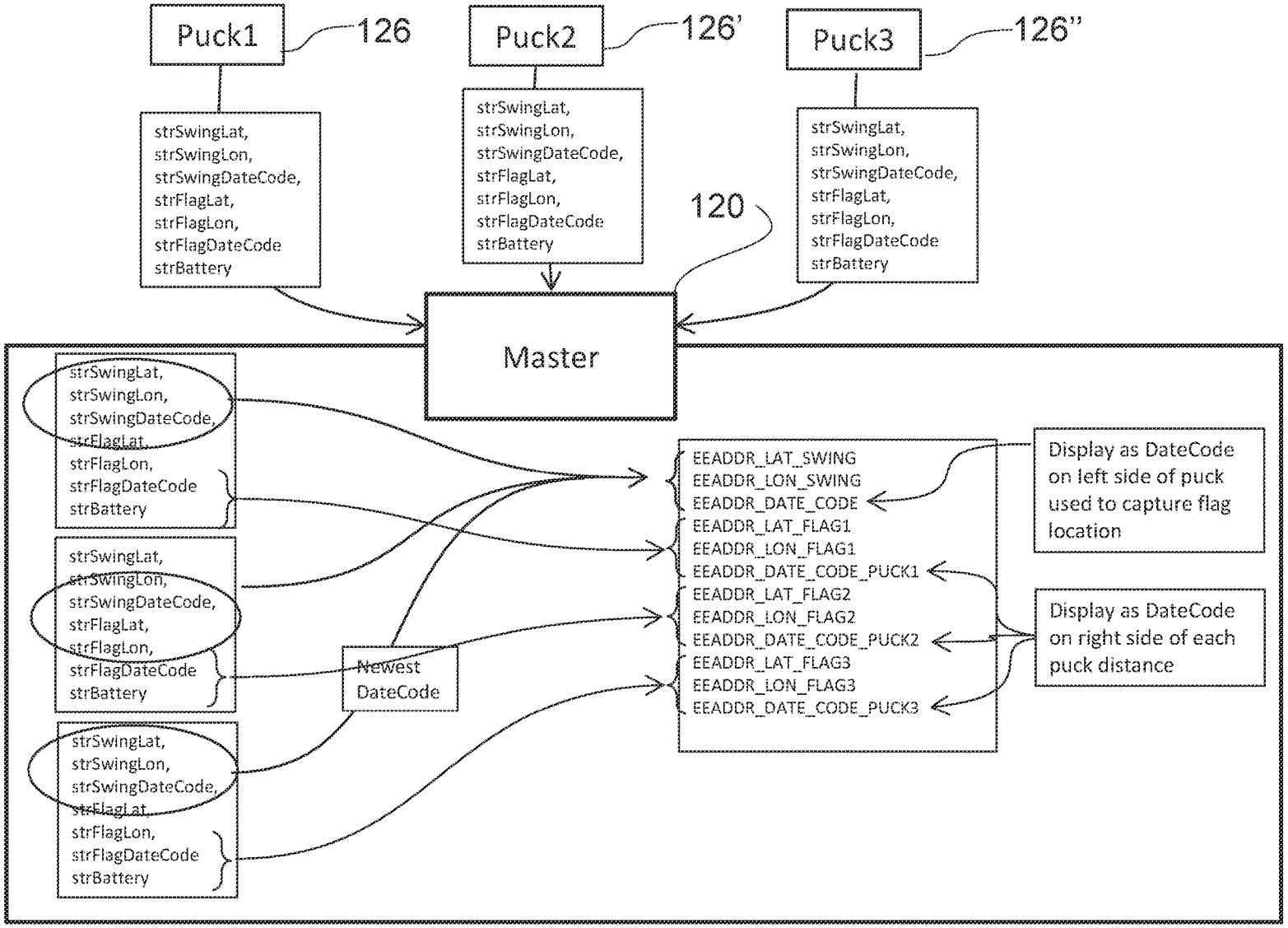
FIG. 49 is a schematic representation of the operation and communication between a primary display embodiment and three locator puck embodiments of a distance display system embodiment.
Figure 50:
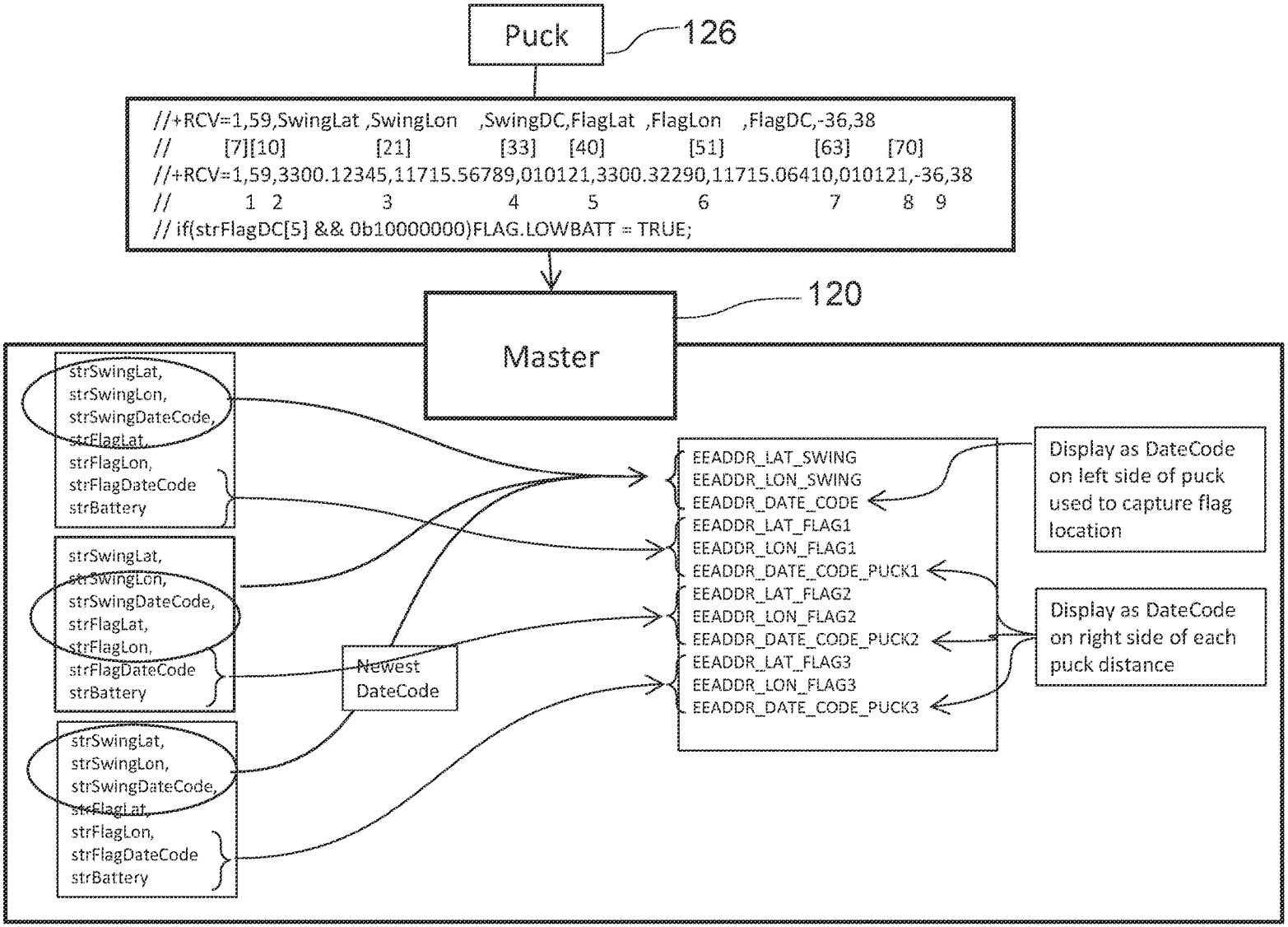
FIG. 50 is a schematic representation of the operation and communication between a primary display embodiment and a locator puck embodiment of a distance display system embodiment.

FIG. 44 illustrates a rear perspective view of an embodiment of a locator puck 126 with a mounting bracket 208 secured to a bottom panel 188 of the locator puck embodiment 126. The mounting bracket 208 includes a straight flat configuration with a mounting hole 210 disposed at each end thereof. FIG. 45 illustrates a rear perspective view of an embodiment of a locator puck 126 with the mounting bracket 208 secured to a rear panel 193 of the locator puck embodiment 126. FIG. 46 is a rear perspective view of a locator puck embodiment 126 that includes a 90 degree mounting bracket 212 secured to the rear panel 193 of the locator puck embodiment 126. FIG. 47 is a rear perspective view of a locator puck embodiment 126 that includes the 90 degree mounting bracket 212 secured to the rear panel 193 of the locator puck embodiment 126 at a different orientation compared to that of the 90 degree mounting bracket of the locator puck embodiment of FIG. 46. FIG. 48 is a rear perspective view of a locator puck embodiment 126 that includes the 90 degree mounting bracket 212 secured to the rear panel of the locator puck embodiment 126 at yet another angular orientation.

Figure 22:
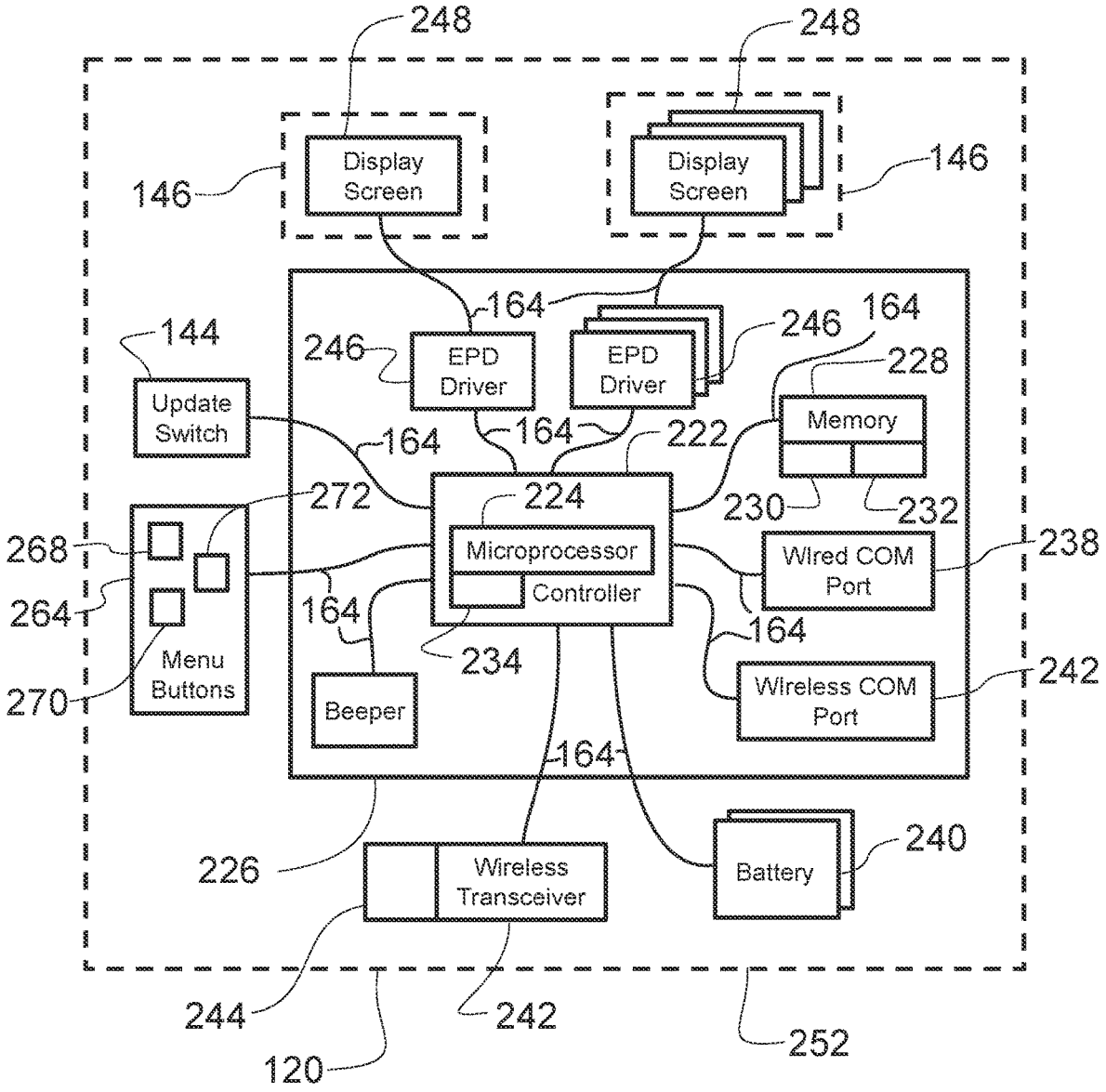
FIG. 22 is a schematic illustration of the internal electronic components of a primary display embodiment.
Figure 30:
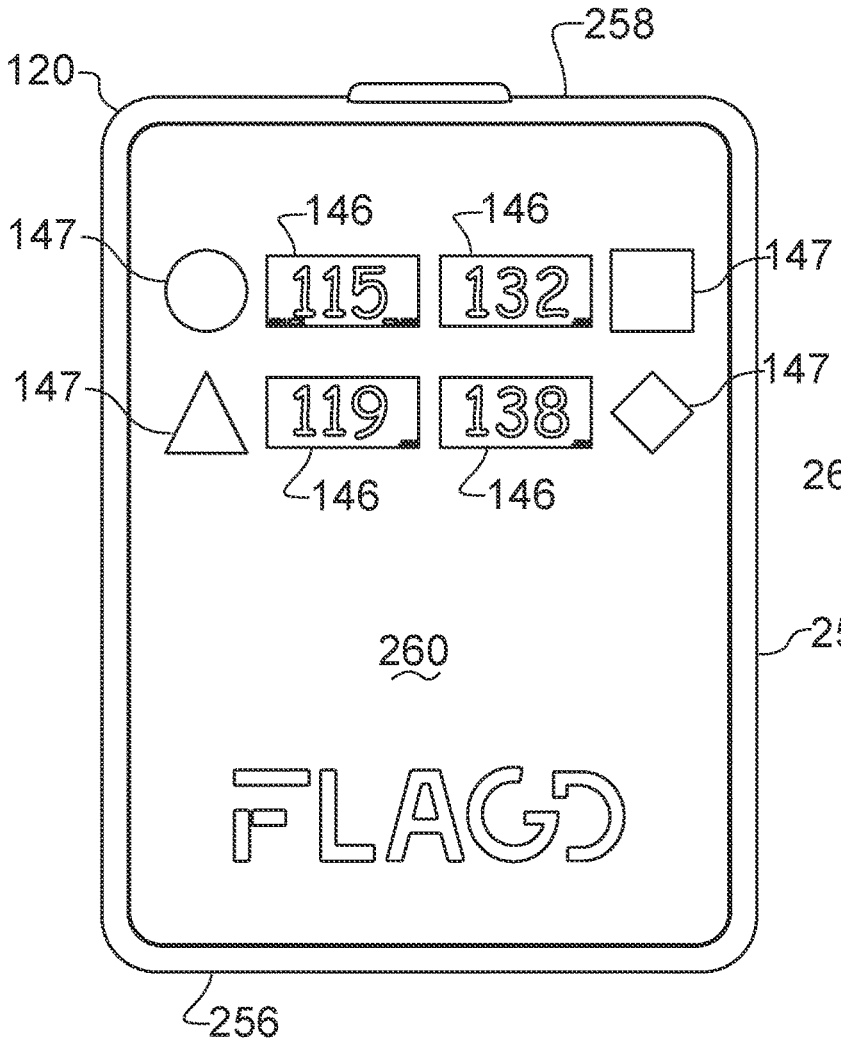
FIG. 30 is a front view of the primary display of the distance display system embodiment of FIG. 17.
Figure 29:
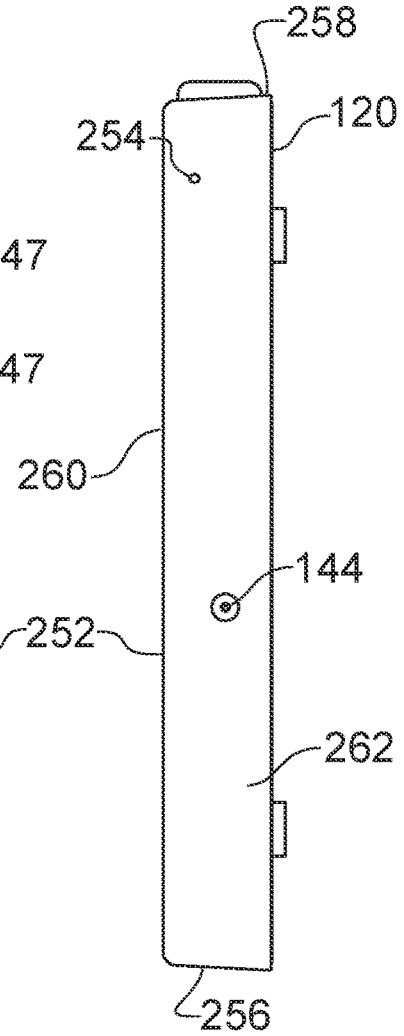
FIG. 29 is a side view of the primary display of the distance display system embodiment of FIG. 17.
Figure 31:
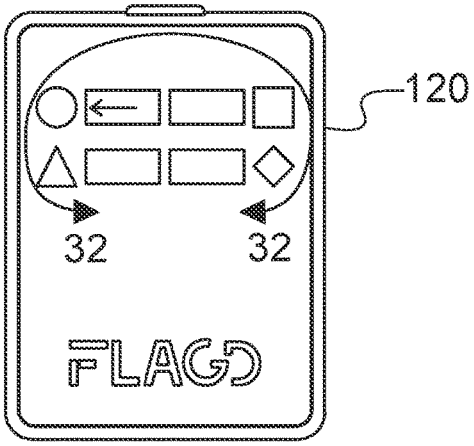
FIG. 31 is a front view of the primary display of the distance display system embodiment of FIG. 17 during a programming sequence embodiment of the primary display.

Referring to FIGS. 22 and 29-30, the primary display 120 may include a display controller 222 having a display processor 224 such as a microprocessor disposed on a printed circuit board (PCB) 226. The controller 222 of the primary display 120 may also include a main display memory 228 which is in operative communication with the processor 222. The main memory 228 of the primary display 120 may also include a cup position memory 230 and one or more tee hitting position memories 232 included within a main memory 228. The display controller 222 is also configured to include a distance calculator module 234 that may be configured to calculate the distance between two positions, the position data of which are stored in the main memory 228. An auditory signal generator such as a beeper 236 may also be part of the display controller 222 and be disposed on the PCB 226 and in operative communication with the display controller 222.

An additional interface component of the display controller 222 may include a wired communication port 238 disposed in operative communication with the display processor 224 of the display controller 222 in some instances. For some embodiments, the primary display 120 also includes a power source 240 such as a battery disposed in operative communication with the controller 222 and a wireless communication interface or transceiver 242 which is disposed in operative communication with the display controller 222. The wireless transceiver 242 may be configured to communicate with the wireless communication interface or transceiver 176 of the one or more locator pucks 126. The wireless transceiver may include an antenna, such as in integral antenna 244, for so transmitting and receiving wireless electromagnetic signals. A video driver 246 such as an "EPD" driver may be disposed in operative communication with the display controller 222 and also with a respective video display 248 of a corresponding display site 146 of the primary display 120.

Referring to FIGS. 29 and 30, each of these components may also be disposed within or otherwise on a display housing 252 which may have enclosed walls in the form of an enclosed container which may be weatherproof or sealed in some cases, may also include the vent hole 254 that provides communication between the interior volume of the display housing 252 and the ambient atmosphere surrounding the display housing 252 to enable equalization of air and/or water vapor pressure between the air inside the interior volume of the display housing 252 and the outside ambient environment. Such pressure equalization may be useful in order to reduce stress on sealing materials of the display housing 252 in some instances. In some cases, in order to maintain a waterproof or weatherproof configuration, the vent hole 254 may include a hydrophobic breathable cover material 67 that is sealed to the structure of the display housing 252 over the vent hole 254 on an interior wall of the housing 252. Waterproof breathable materials such as expanded polytetrafluoroethylene (Gortex®) or the like may be used for the cover material 67. The display housing 252 may include a case bottom 256, a case top 258, outer face plate 260, and four or more case assembly screws 194.

The primary display may also include an actuator interface 144 such as a button which may be disposed in operative communication with the display controller 222. The actuator interface 144 may be disposed at or near an outer surface of a right side plate 262 and accessible to an operator from outside the display housing 252. In some instances, the actuator interface 144 may include a remote control (not shown) which utilizes a wireless link, such as the wireless communication link 242 shown in FIG. 22 which may be in operative communication with the display controller 222 and in wireless communication with the remote control. Some distance display system embodiments 115 may further include an auxiliary user interface 264 which may also be operatively coupled to the display controller 222. For the distance display system embodiment 115 shown in FIG. 17, the auxiliary user interface may include a membrane switch as shown in FIG. 22 disposed on a rear panel 266 or the bottom plate 256 of the display housing 252. The membrane switch 264 may include several different buttons that may be used for toggling through various menu selections and selecting menu choice options. For the membrane switch embodiment 264 shown in FIG. 22, an "up" button 268, "down" button 270 and "enter" button 272 may be included on the membrane switch 264. The up button 268 and down button 270 may be used to advance through menu options and the enter button 272 may be used to select displayed menu choices in some cases.

The primary display 120 includes one or more display sites 146 which are configured to display distance information corresponding to a particular tee hitting position 124 of tee hitting area 136 to a target such as a cup or associated flag of a golf hole 122. In some instances, the display sites 146 include the electronic screen 248 which may be disposed in operative communication with the display controller 222 and/or video driver 246 thereof. The primary display sites 146 of any of the embodiments discussed herein discussed herein may display distance information and any other suitable data in human readable form (such as characters or text) or machine readable forms such as bar codes, matrix code, 2-D bar codes such as "QR" codes or the like or any suitable combination thereof. For some display site embodiments, 146, the screen thereof may be sized and configured to be easily readable from a distance of a few feet to several or more yards such that a golfer 78 arriving in a cart to a tee hitting area 136 may readily read the display distances in the display sites 146 while still close enough to the cart to make a club selection based on the appropriate displayed distance. For some embodiments, the screen of the display sites may have a generally rectangular configuration with a height of about 1 inch to about 4 inches, and a width of about 3 inches to about 12 inches. Some typical display sites may have a rectangular dimension of about 1 inch by 3 inches, about 4 inches by about 12 inches or the like. Such display site embodiments 146 may be configured to display characters or symbols having a height of about 1 inch to about 4 inches.

Figure 39:
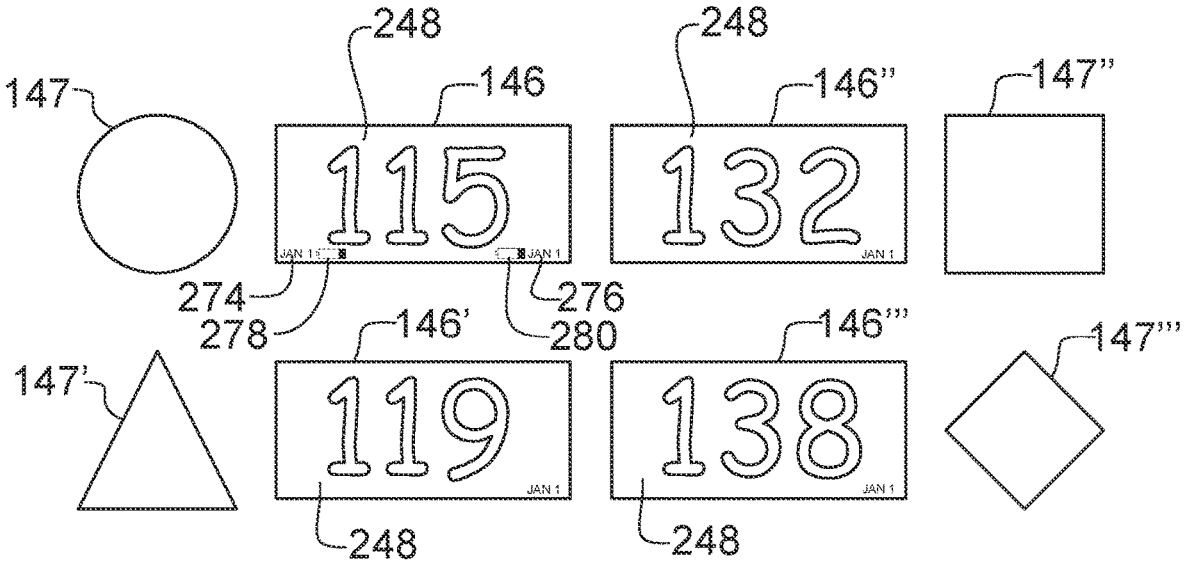
FIG. 39 is an enlarged view of the display area of the primary display of FIG. 38 illustrating certain status information disposed within the primary display sites of the primary display embodiment.

For some embodiments, each of the display sites 146 of the primary display 120 may include a screen configuration 248 that continues to display a display distance after power to the display site 146 has been stopped. Such a "no power" permanent display screen may include a microencapsulated electrophoretic type of display. In addition to the distance data displayed, the display sites 146 may also be used to display date and/or time information such as the date 274 the displayed position data for the cup 130 was acquired and optionally time when the displayed position data was acquired. The date 276 when the locator puck position data was captured may also be displayed on the video display 248. System status information may also be displayed such as the battery charge state 278 of the primary display 120 and/or the battery charge state 280 of the corresponding locator puck 126 as shown in FIG. 39.

Figure 23A:
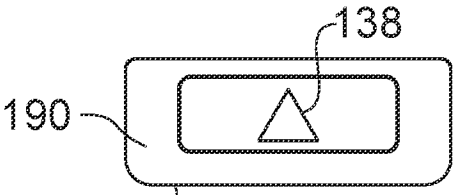
FIG. 23A is a top view of a locator puck embodiment of the distance display system embodiment of FIG. 17.
Figure 23:
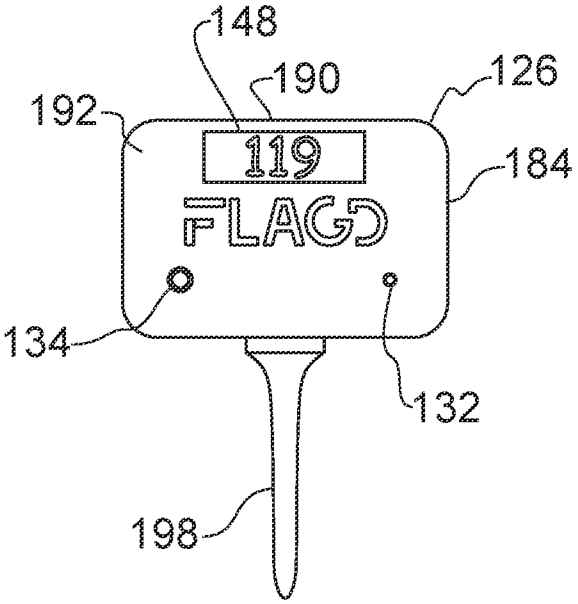
FIG. 23 is a front view of the locator puck embodiment of FIG. 23A.
Figure 24:
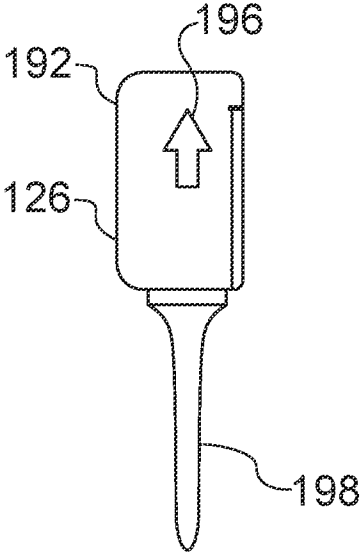
FIG. 24 is a side view of the locator puck embodiment of FIG. 23A.
Figure 25:
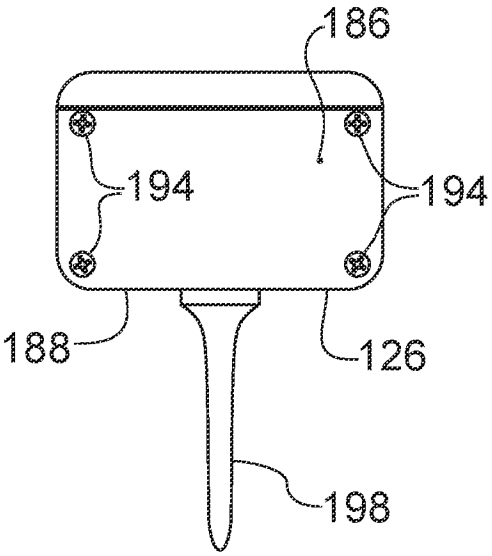
FIG. 25 is a rear view of the locator puck embodiment of FIG. 23A.
Figure 26:
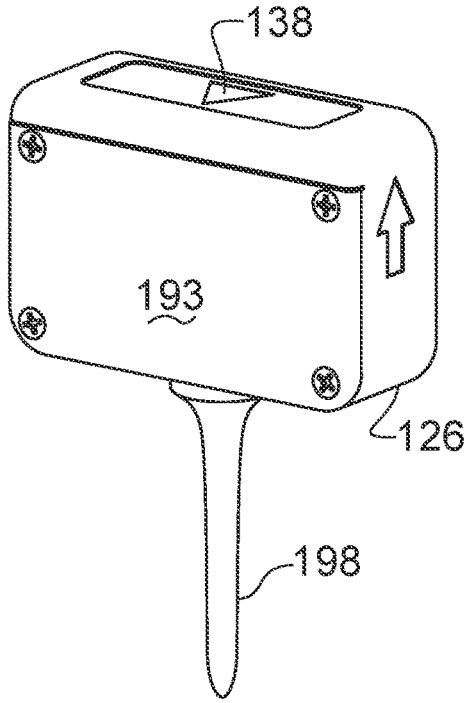
FIG. 26 is a rear perspective view of the locator puck embodiment of FIG. 23A.
Figure 27:
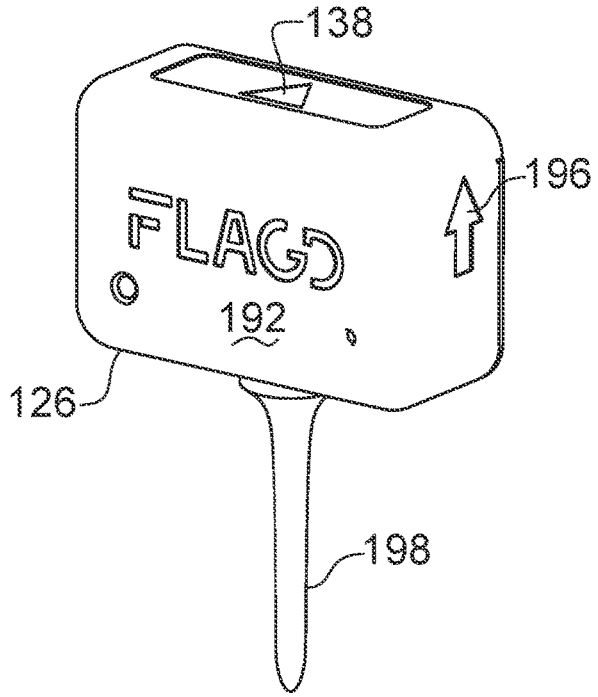
FIG. 27 is a front perspective view of the locator puck embodiment of FIG. 23A.

In addition to the display sites 146 of the primary display 120, for some distance display system embodiments 115, one or more of the locator pucks 126 may also include an optional secondary display site 148 disposed on a puck housing 184 thereof, as shown in FIG. 23, which directly displays the distance from that locator puck 126 to the cup 130 of the golf hole 122. The optional secondary display site 148 may include the same type of display configuration, such as a screen or the like as well as a suitable display indicator 147, as is used for the primary display sites 146 of the primary display 120.

The display indicators 147 of the primary display 120 may be disposed on the housing adjacent display sites 146 and include a visually distinct element such as a color coded emblem corresponding to a similarly visually distinct emblem (such as color coding) of a tee box indicator 128 of a tee hitting position 124 in some instances. Such tee hitting positions 124 may correspond to a stored tee hitting position 124 for which a display distance has been displayed on one of the display sites 146 of the primary display 120. In some cases, the display indicator 147 may include a written character such as a number or letter that represents a matching written character of a corresponding tee hitting position 124. The display indicators 147 may also include distinct shapes that correspond to a matching distinct shape of a corresponding tee box indicator 128 of a tee hitting position 124. Examples of such distinct shapes may include circles, squares, diamonds, triangles, ovals, pentagons, stars, and the like.

Figure 28:
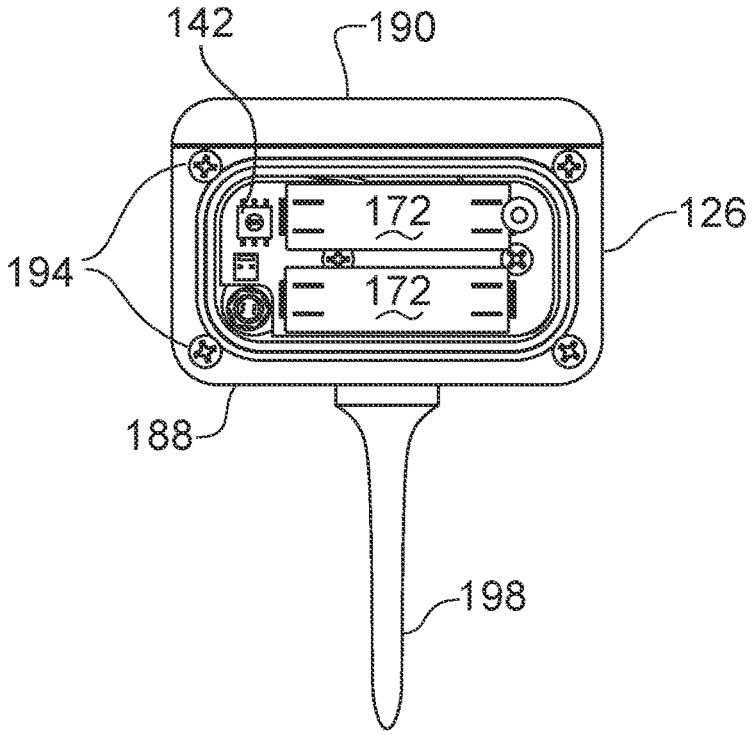
FIG. 28 is a rear elevation view of the locator puck embodiment of FIG. 23A with the rear cover removed for purposes of illustration.

In some cases, in order to ensure that the proper distance from the cup 130 to the corresponding tee hitting location 124 is displayed in a readily recognized format for the golfer 78, each locator puck 126 of a particular distance display system 115 may be set or otherwise mapped to a particular display site 146 of the primary display 120. That is, distance data generated from position data of a particular locator puck 126 will only be displayed on one predetermined display site 146 of the primary display 120. In some cases, this may be set with a display site selector switch 142 of a locator puck 126, as shown in FIG. 28, which may be set by a user to map the distance information of a given locator puck 126 to a particular display site 146 of the primary display 120. In some cases, if a primary display 120 of a distance display system embodiment 115 has 8 different display sites 146, each locator puck 126 of the system 115 may include a display site selector switch 142 having 8 corresponding selection options, each corresponding to a different display site 146. Such display site selector switch embodiments 142 may have any suitable number of selection options, including about 2 to about 10 or more selection options with all or any desired subset of those selection options in actual use for a particular embodiment. In such a case, the display indicator 147 of the selected display site 146 should match the puck indicator 138 of the locator puck 126 set to the same selected display site 146. In addition, the puck indicator 138 of such a configured locator puck 126 should also match the tee box indicator 128 of the tee hitting position 124 disposed adjacent the configured locator puck 126. In this way, the system is configured to always display the proper distance from the tee hitting position 124 to the cup 130 at a display site 146 having a display site indicator 147 which matches that of the tee box indicator 128 disposed adjacent the selected locator puck 126

Referring to FIG. 18 a default "Tee-Press All" distance calculation and display method embodiment is schematically shown. At regular intervals, such as every morning or any other suitable interval the following sequence may be used. Initially, a greenskeeper selects a primary display 120 and the associated locator pucks 126. Any suitable number of locator pucks 126 may be used including about 1 locator puck 126 to about 15 locator pucks 126. In some instances, a distance display system 115 may include about 2 locator pucks 126 to about 10 locator pucks 126, more specifically, about 2 locator pucks 126 to about 4 locator pucks 126. The greenskeeper then drives to the green 123 of a golf hole 122 of a golf course 122 as represented by arrow 282. The greenskeeper selects one locator puck such as the first locator puck 126 (any of the locator pucks 126 may be used for some embodiments), places the locator puck 126 on the ground adjacent to a cup position such as a new cup position 130.

The new cup position 130 may be a position on the green of the golf hole that does not yet include a cup 130 but will have a cup 130 subsequently placed at that position. The new cup position may be disposed a desired distance and direction away from the existing cup position indicated by the dashed representation of the cup 130 and flag 131 shown in FIG. 18. The greenskeeper then presses and holds the actuator interface 132 (see FIG. 24) of the locator puck 126, which for some embodiments includes a tee switch 132, until a green light (or any other suitably identifiable indicator) of the visual indicator 134 comes on. By the time the greenskeeper drills and fills the hole from the previous cup position to move the cup 130, and optionally the associated flag 131, to the new reconfigured position, the selected first locator puck 126 should be done with a GPS position capture sequence initiated by actuation of the actuator interface 132 (which may in some cases be indicated by 1 green flash, 2 flashes, 3 flashes, light off) as well as a cup position data storage sequence storing the cup position data into a cup position memory of the first locator puck 126.

The greenskeeper may then take the selected locator puck 126 that includes the position data from the cup 130 and drive to the corresponding tee hitting area 136 which includes the tee hitting positions (tee boxes) 124 as indicated by arrow 284. The greenskeeper may then place each locator puck 126, 126', 126", 126''' (including the selected first locator puck 126) in the appropriate location based on the appropriate corresponding visual indicator, such as color, or any other suitable type of corresponding visual indicator, such that the puck indicator 138 of each of the locator pucks 126 matches the respective tee box indicator 128 of the tee hitting position 124 it is meant to display. After the greenskeeper places a locator puck 126, the actuator interface 132 of the locator puck 126 may be actuated by a short press thereof with the light indicator 134 (see FIG. 23) of the locator puck displaying a blue LED initiating the GPS capture sequence for the locator puck 126 (1 blue flash, 2 flashes, 3 flashes, blue light on). For some embodiments, the greenskeeper may also leave a locator puck 126 at the position of the cup 130 of the golf hole 122 if desired.

The greenskeeper may then place the primary display 120 in a suitable and/or desired position near the tee hitting positions 124, or at any other suitable position, such as at the entry path 286 to the tee hitting area 136, and then actuates the actuator interface 144 (see FIGS. 29 and 30) of the primary display 120. In some instances, the suitable and/or desired position near the tee hitting positions of the tee hitting area 136 may include positioning the primary display 120 at eye level adjacent a path 286 leading to the tee hitting area 136. In some cases, eye level may be meant to include a position that is about 4 feet to about 6 feet from ground level. In other instances, the primary display may be positioned on a portable type frame, such as a folding frame, that may position the primary display 120 lower than eye level, such as less than about 4 feet from the ground, more specifically, about 2 feet to about 3 feet from the ground.

In some cases, actuation of the actuator interface 144 of the primary display 120 may include tee switching a button of the actuator interface 144 of the primary display 120 wherein the pointy end of a golf tee is pressed into a spring loaded button of the actuator interface 144. The primary display 120 may then query each locator puck 126, 126', 126", 126'" sequentially for data, store the captured data, then update and display the distances from each of the respective tee hitting positions 124 of the tee hitting area 136 to the cup 130 on the green of the golf hole 122 at respective primary display sites 146 disposed adjacent respective display site indicators 147 (see FIG. 32). As noted above, the display site indicators 147 may include a visually distinct character coded or color coded marks that correspond to the respective tee box indicators 128 and/or puck indicators 138.

The primary display sites 146 of any of the embodiments discussed herein or optional secondary display site 148 as shown in FIG. 23 of any of the locator puck embodiments 126 discussed herein may display distance information and any other suitable data in human readable form (such as characters or text) or machine readable forms such as bar codes, matrix code, 2-D bar codes such as "QR" codes or the like or any suitable combination thereof. In addition, for some embodiments, one or more of the locator pucks 126 may also include the secondary display site 148 disposed on a housing thereof which directly displays the distance from that locator puck 126 to the cup 130 of the golf hole 122.

The secondary display site 148 may include the same type of display configuration, such as a screen or the like, as is used for the primary display sites 146 of the primary display 120. In some instances, locator puck position data may also be transmitted to a data aggregator operated by the golf course for integration with other electronic-based features offered by the golf course so that golfing participants 78 can access and use the position data in other applications such as those applications on a smart phone or the like that may display golf hole tee hitting ranges for the various holes and tee hitting positions for which such ranges have been calculated by distance display system embodiments.

Suitable elements of the method above, or any subset thereof, may be combined with elements of any other distance display method embodiment discussed herein. In addition, any suitable elements of other distance display method embodiments discussed herein may be combined with the above method elements.

In some cases, an alternate "no-press" automatic distance calculation and display method embodiment may be used whereby one primary display 120 may be mounted at an entrance to a tee hitting area 136 of any suitable golf hole 122, such as a par 3 golf hole 122. Multiple locator pucks 126 may be mounted to respective tee box markers 128. At a regular interval, and in some cases every morning at an early time before the beginning of play on the golf course, in some cases before 6:00 am the following sequence may be used. Initially, the greenskeeper selects a primary display embodiment 120 and a plurality of locator pucks 126, such as 4 locator pucks 126, 126', 126", 126'" in some cases, and drives to the green 123 of the golf hole 122 of the golf course as indicated by arrow 282 of FIG. 18. The greenskeeper also selects one locator puck 126 from the plurality of locator pucks 126 carried (any of the locator pucks 126 may be used for some embodiments), places it on the ground close and adjacent to a new cup position 130 of the green 123, then presses and holds the actuator interface 132 of the selected locator puck 126, which may include a tee switch or button, until the indicator light 134 (green light in some cases) comes on.

By the time greenskeeper drills and fills the holes to move the cup 130 to the new position, the selected locator puck 126 should be done with the GPS position capture sequence (which in some cases may be indicated by 1 green flash, 2 flashes, 3 flashes, light off of the indicator light 134 of the locator puck 126). The greenskeeper may then drive to the tee hitting area 136 as indicated by arrow 284 and place each locator puck 126 in an appropriate location based on its respective indicator 138 (color coded for some embodiments) that matches the indicator 128 of the adjacent tee hitting position 124. Early in the day, in some cases at 6:00 am or before, all locator pucks 126 and primary display 120 turn power up at a predetermined initial start time. All locator pucks 126 capture their respective position data and positions, synchronize their real-time clocks, then wait for primary display 120 to communicate readiness. The primary display 120 collects data from each of the locator pucks 126 of the distance display system 115 (including time stamp to synchronize primary display real-time clock), updates display of ranges from the cup 130 to each of the respective tee hitting positions 124 of the tee hitting area 136 and sends out "turn off" to all locator pucks 126 before turning itself off. In some cases, the timing of the automatic update may be defined at initial setup, changeable via a primary display menu. Suitable elements of the method above, or any subset thereof, may be combined with elements of any other method embodiment discussed herein. In addition, any suitable elements of other method embodiments discussed herein may be combined with the above method elements.

Figure 32:
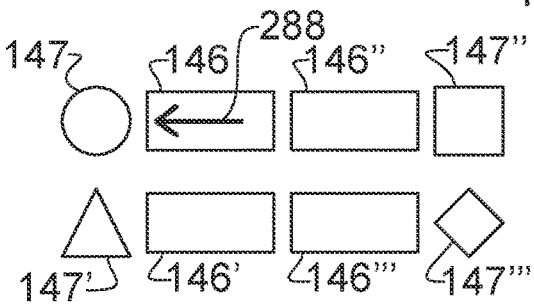
FIG. 32 is an enlarged view of the display area of the primary display of FIG. 31 during a programming sequence embodiment of the primary display.
Figure 33:
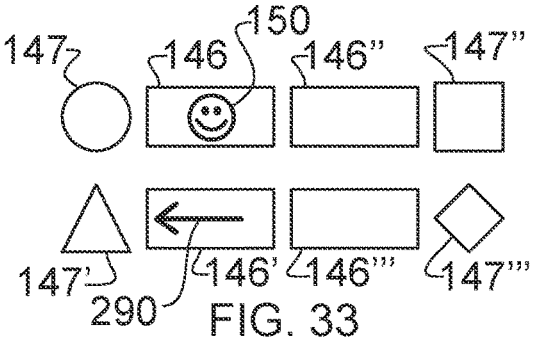
FIG. 33 is an enlarged view of the display area of the primary display of FIG. 31 during a programming sequence embodiment of the primary display.

Referring to FIG. 32, an embodiment of the primary display 120 is shown sending out a data request to a locator puck 126 having a respective round shaped indicator 147 disposed thereon indicated by arrow 288 in the display site 146. Referring to FIG. 33, a smiley face icon 150 displayed in display site 146 is indicating that location data was successfully collected from locator puck 126 having a round shaped indicator 138 disposed thereon. Again referring to FIG. 33, an arrow 290 indicates that the primary display 120 is sending out data request to a second locator puck 126', the second indicator puck 126' being identified by a triangle shaped indicator 138 that matches the triangle shaped display indicator 147' shown. In such a case, if max data attempts are reached and data is not successfully collected, a frowny face or similar type of icon may be displayed and the distance using the last successfully captured locator puck position/data will be displayed including the date code for that time so that a golfer 78 hitting from the associated tee hitting position 124 may be informed that the distance data is out of date and may be inaccurate. A right hand arrow or other suitable visual indicator shown in the display site 146' of FIG. 33 (→) may be used to indicate that a wrong distance that includes an older date code is being displayed in some cases.

Figure 35:
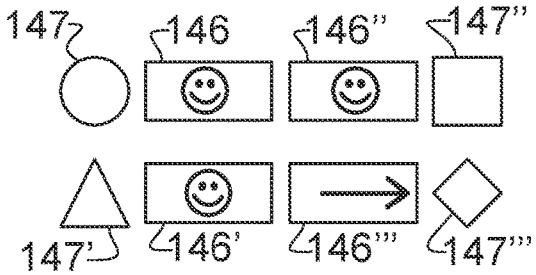
FIG. 35 is an enlarged view of the display area of the primary display of FIG. 31 during a programming sequence embodiment of the primary display.
Figure 34:
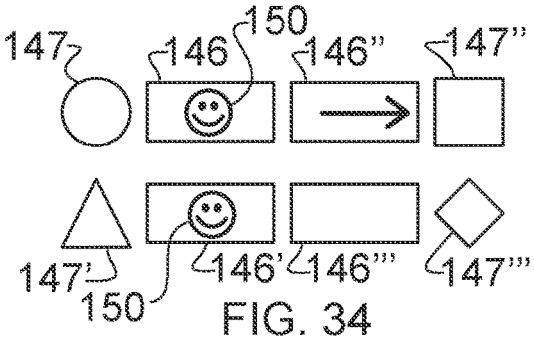
FIG. 34 is an enlarged view of the display area of the primary display of FIG. 31 during a programming sequence embodiment of the primary display.

In FIG. 34, successful position/distance data capture for the first locator puck 126 and the second locator puck 126' is indicated by the smiley face icons 150 displayed in the first display site 146 and the second display site 146'. The arrow 292 in display site 146' indicates that a data request has been sent out by the primary display 120 to the third locator puck 126". In FIG. 35, successful position/distance data capture for the first locator puck 126, second locator puck 126' and the third locator puck 126" is indicated by the smiley face icons 150 displayed in the first display site 146, second display site 146' and the third display site 146". The arrow 292 in the fourth display site 146''' indicates that a data request has been sent out by the primary display 120 to the fourth locator puck 126'''.

Figure 36:
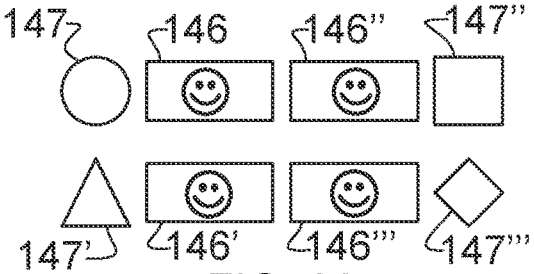
FIG. 36 is an enlarged view of the display area of the primary display of FIG. 31 during a programming sequence embodiment of the primary display.
Figure 37:
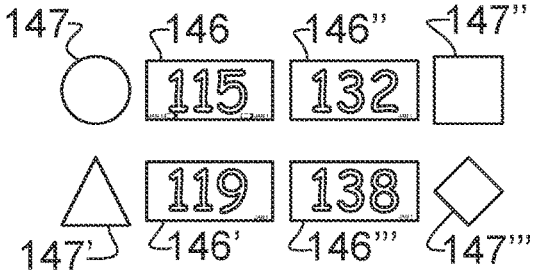
FIG. 37 is an enlarged view of the display area of the primary display of FIG. 31 during a programming sequence embodiment of the primary display.
Figure 38:
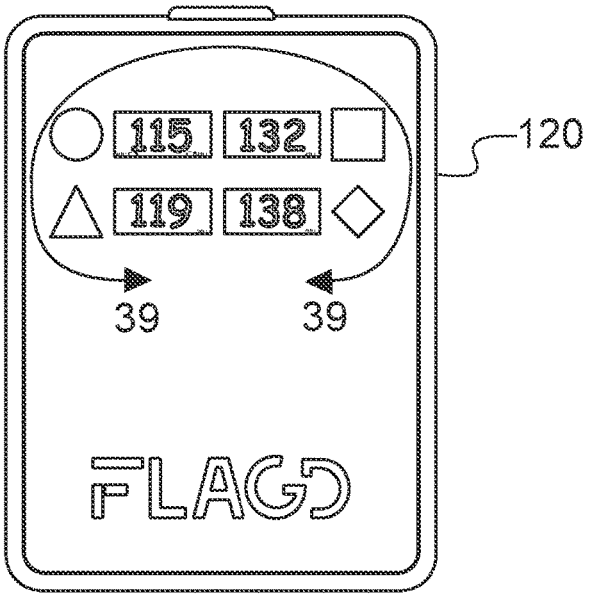
FIG. 38 is a front view of the primary display of the distance display system embodiment of FIG. 17 during a programming sequence embodiment of the primary display.
Figure 40:
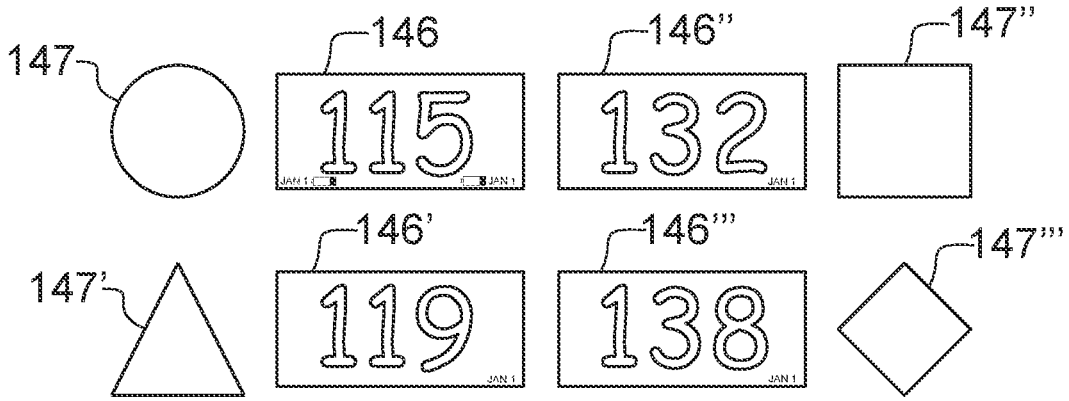
FIG. 40 is an enlarged view of the display area of the primary display of FIG. 38 illustrating certain status information disposed within the primary display sites of the primary display embodiment.
Figure 41:
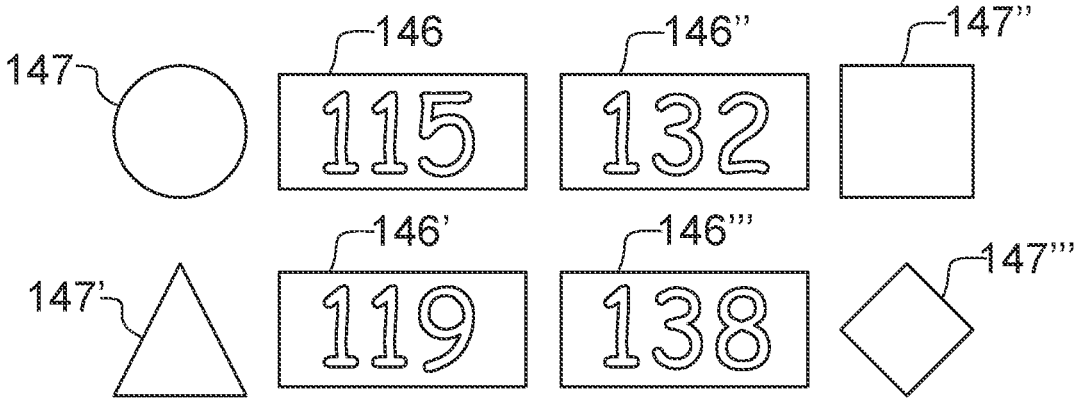
FIG. 41 is an enlarged view of the display area of the primary display of FIG. 38 with the status information no longer displayed within the primary display sites of the primary display embodiment.

Referring to FIG. 36, after all locator puck position data has been collected, as indicated by the smiley face icon 150 displayed in each of the display sites 146, 146', 146", 146''', distances may be calculated and displayed along with date codes and low battery indicator if necessary at the respective primary display sites 146 as shown in FIG. 37. Referring to FIG. 39, pressing the actuator interface 144 on the primary display 120 may toggle between battery low and date code information in some cases (state stored in EEPROM so next actuator interface actuation displays last state). Such display options are also shown in the embodiments of FIGS. 40 and 41. In FIG. 41, the optional date and battery state displays 274, 276, 278 and 280 are no longer active.

FIGS. 51-54 illustrate flowchart sequences of a variety of methods of displaying distances from a plurality of tee hitting positions 128 to a cup 130 of a golf hole 122 with a primary display 120 that includes a plurality of display sites 146 corresponding to a plurality of respective locator pucks 126 of display system embodiments.

Figure 51:
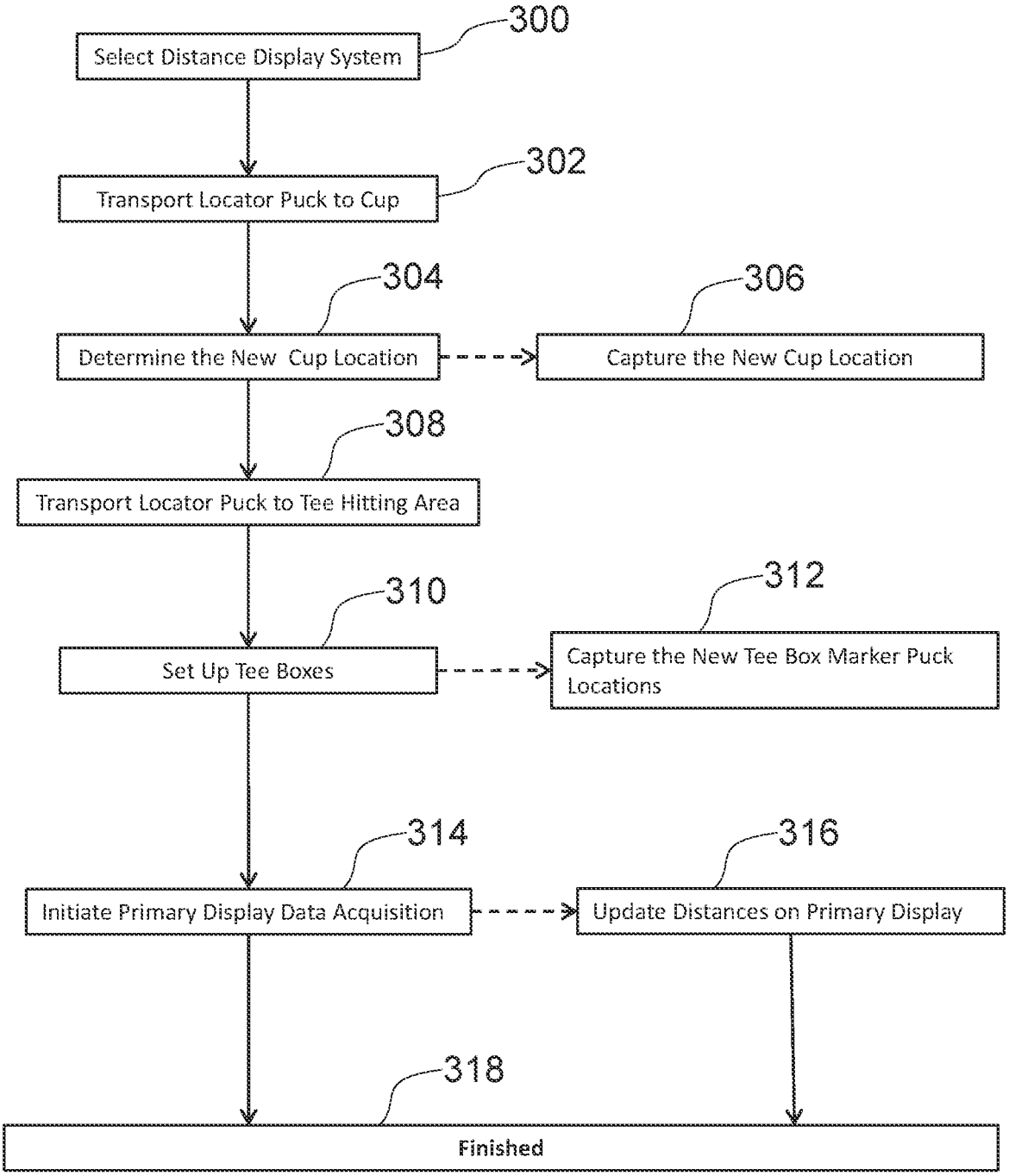
FIG. 51 is a flow chart representation of a method embodiment of using a distance display system embodiment.

FIG. 51 is a flowchart representation of a method of displaying distances from a plurality of tee hitting positions 124 to a cup 130 of a golf course hole 122. For such method embodiments, a distance display system embodiment 115 may be used that includes the primary display embodiment 120 and one or more (including a plurality of) locator puck embodiments 126, such as about 1 locator puck 126 to about 8 locator pucks 126, as indicated by box 300.

Each of the locator pucks 126 of the system 115 may include a puck indicator 138 which corresponds to a respective tee hitting position 124 which may also include a corresponding visual indicator such as the tee box indicator 128. The distance display system 115 may be loaded into a vehicle such as a golf cart or the like (or carried on foot) which may then be driven to a cup 130 of a golf hole 122 as indicated by box 302.

Once the operator, such as a greenskeeper or the like, reaches the general area on the green near the existing cup 130', a new location for the cup 130 may be selected by the operator and a single locator puck 126 may be selected and removed from the vehicle (and from any protective case or container that it may be disposed within), and the actuator interface 132 thereof actuated. In some cases, the actuator interface 132 may include a spring loaded recessed button and actuation of such an actuator interface may include pressing and holding the button 132 until a color coded light, such as a green light of a multicolored LED light 134, blinks. The selected locator puck 126 may then be placed on the ground of the green at or near the planned new position of the cup 130. The operator may then move the cup 130' from the existing position to the new position on the green of the golf course hole 122 as indicated by box 304 of FIG. 51.

At this point, the locator puck 126 which has been actuated at or near the new position of the cup 130 may capture the new location using the GPS module of the controller. The illumination sequence pattern of the indicator light 134 may be an automatic series of single blinks, followed by a series of 2 blinks, followed by a series of 3 blinks. After these blinking series, the indicator light 134 may remain on continuously for 10 seconds before turning off, in some cases. In some instances, the illumination sequence pattern may be a visual indicator of progress of the capture of the position of the locator puck 126 adjacent the new location of the cup 130 using the GPS receiver 182. The time period required to capture the new position may be approximately similar to the time required for the groundskeeper to physically move the cup 130' from the previous position to the new position adjacent the locator puck 126 during the position capture process as indicated by box 306.

When the selected or "master" locator puck 126 location capture sequence is complete, and the position data for the new position of the cup 130 of the distance display system 115 has been stored in the cup position memory 166 of the locator puck 126, the locator puck 126 may be returned to the storage container in the vehicle by the groundskeeper. The groundskeeper may then drive the vehicle and the locator puck 126 back to the tee hitting area 136 as indicated by box 308.

Once the groundskeeper has arrived at the tee hitting area 136, the position of one or more tee hitting positions 124 and associated tee box indicators 128 may be selected and placed. The greenskeeper may then place each of the one or more locator pucks 126 that has a puck indicator 138 that matches that of the respective tee box indicator 128, adjacent that respective tee box indicator 128. After so placing a locator puck 126, a short press of the actuator interface button 132 results in a flashing of a blue light from the light indicator 134 of that locator puck 126. This same process is carried out for the remainder tee hitting positions 124 and associated tee box indicators and locator pucks 126. Once all of the locator pucks 126 have been actuated with a short press of the respective actuator interfaces 132 and are confirmed to have light indicators 134 blinking blue lights, the greenskeeper may then proceed to position the primary display 120 of the distance display system 120 at the entrance to the tee hitting area 136 or at any other suitable position that would be readily visible to a golfer 78 approaching the tee hitting area 136 as indicated by box 310 in FIG. 51.

As the greenskeeper is approaching and/or placing the primary display 120, each of the locator pucks 126 will be obtaining its position using its GPS module 182. The progress of the position data capture may be indicated by light sequence pattern that includes an automatic series of single blinks, followed by a series of 2 blinks, followed by a series of 3 blinks, with the blue light then remaining solid as discussed above. This position acquisition process and progress display sequence is represented by box 312.

Once the primary display 120 has been positioned at the entrance to the tee hitting area 136, the actuator interface 144 of the primary display 120 is actuated by pressing on the button of the actuator interface 144. The initiation of data acquisition by the primary display 120 may be indicated by an arrow being shown in the display site 146 of the primary display 120 corresponding to a first tee hitting position 124 as indicated by box 314.

The display controller 222 of the primary display 120 will then collect position data from each of the locator pucks 126 of the distance display system 115 which have been actuated as shown in box 310 and discussed above. Once the position data of each of the actuated locator pucks 126 has been received, the display controller 222 of the primary display 120 will calculate and display the distance between each of the locator pucks 126 and the new position of the cup 130 in a respective display site 146 of the primary display. In some instances, the tee box indicator 128 of each tee hitting position 124 will have the same visual distinction as that of the puck indicator 138 of the respective locator puck 126 disposed on or adjacent the tee box indicator 128 as well as that of the display indicator 147 disposed adjacent the display site 146 of the primary display which is displaying the distance from the locator puck 126 to the new position of the cup 130. The display site 146 may further date codes and other information that may be useful to determine the time and accuracy of the distance information being displayed in each display site 146. Once the location data from each of the actuated locator pucks 126 has been obtained and associated calculated distances displayed at respective display sites 146 of the primary display 120, the controller of the primary display may issue a command to turn off all actuated locator pucks 126 and then turn itself off with the displayed distances on the display sites 146 still being displayed as shown in box 316. The process is then complete as indicated in box 318. Suitable elements of the method above, or any subset thereof, may be combined with elements of any other method embodiment discussed herein. In addition, any suitable elements of other method embodiments discussed herein may be combined with the above method elements.

Figure 52:
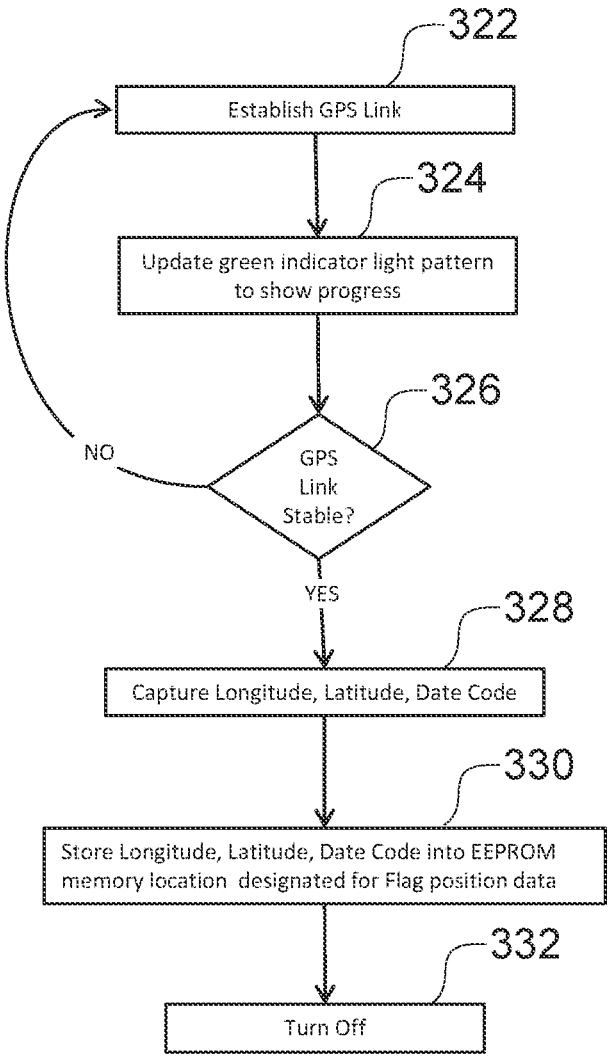
FIG. 52 is a flow chart representation of a method embodiment of capturing cup location data with a locator puck embodiment which is disposed adjacent thereto.

FIG. 52 shows a flow chart representation of an embodiment of a method of position data capture by a GPS module of the locator puck embodiments 126 related to the position, such as a new position, of the cup 130. In this method, the GPS receiver 182 of a locator puck 126 first establishes a GPS link as indicated in box 322 with a corresponding visual indicator such as a green light pattern being shown in the light indicator 134 once the link is established to show progress as indicated by box 324. Once the GPS link is established, the puck controller 154 or, in some instances, the GPS receiver 182, of the locator puck 126 determines whether the GPS link is stable as indicated in box 326. In some instances, the GPS receiver may transmit data to the controller indicating that the GPS link is stable and that the GPS position information being sent by the GPS receiver to the controller is valid. If so, the GPS receiver 182 goes on to capture longitude, latitude, date code data etc. of the locator puck 126 associated with the position of the cup 130 as indicated in box 328. If a GPS link is not stable, the puck controller 154 of the locator puck 126 instructs the GPS receiver to once again establish a GPS link and the process begins again. Once the position data is captured, the longitude data, latitude data, and date code data is stored into the main memory 160 of the controller 154 as indicated by box 330. In some instances, the latitude data and longitude data may be stored in a cup position memory 166 of the main memory 160 of the controller 154, which may include an EEPROM type memory. Once the position data has been properly stored in the appropriate memory 166, the controller 154 of the locator puck 126 turns itself off as indicated by box 332 of FIG. 52. Suitable elements of the method above, or any subset thereof, may be combined with elements of any other method embodiment discussed herein. In addition, any suitable elements of other method embodiments discussed herein may be combined with the above method elements.

Figure 53:
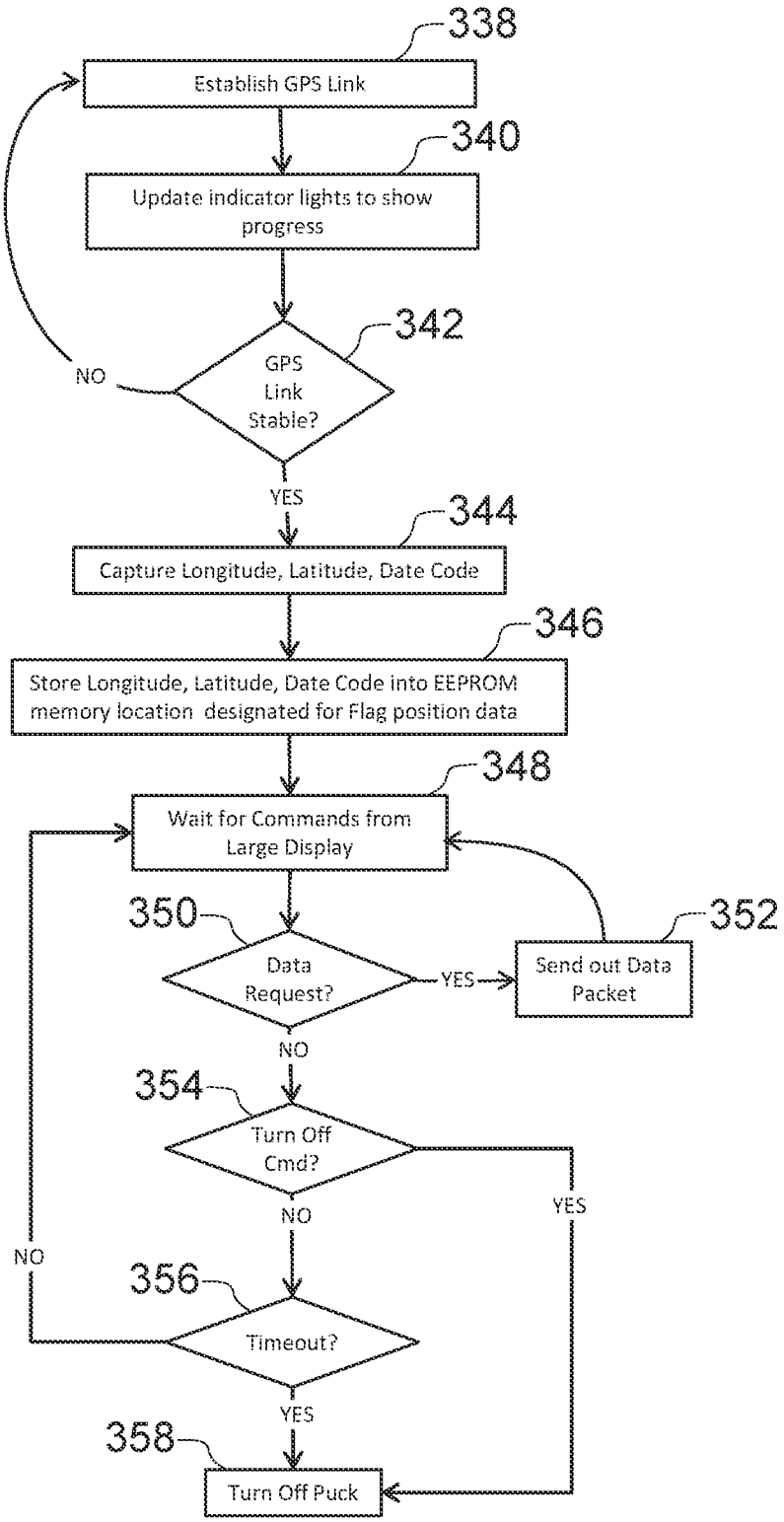
FIG. 53 is a flow chart representation of a method embodiment of capturing tee hitting position data with a locator puck embodiment disposed adjacent thereto.

FIG. 53 also shows a flow chart representation of an embodiment of a method of position data capture by a GPS receiver 182 of the locator puck embodiments 126 related to the position, such as a new position, of the cup 130. In this method, the GPS receiver 182 of a locator puck 126 first establishes a GPS link as indicated in box 338 with a corresponding visual indicator such as a green light pattern being shown in the light indicator 134 once the link is established to show progress as indicated by box 340. Once the GPS link is established, the controller 154, or in some instances the GPS receiver 182, of the locator puck 126 determines whether the GPS link is stable as indicated in box 342, if so, the GPS module goes on to capture longitude, latitude, date code data etc. of the locator puck 126 associated with the position of the cup 130 as indicated in box 344. If a GPS link is not stable, the controller 154 of the locator puck 126 instructs the GPS receiver 182 to once again establish a GPS link and the process begins again. Once the position data is captured, the longitude data, latitude data, and date code data is stored into the main memory 160 of the controller 154 as indicated by box 346. In some instances, the latitude data and longitude data may be stored in the cup position memory 166 of the main memory 160 of the controller 154, which may include an EEPROM type memory.

Once the position data of the cup 130 has been properly stored in the appropriate memory 166, the controller 154 of the locator puck 126 waits for wireless commands from the wireless interface 242 of the primary display 120 as indicated by box 348 of FIG. 53. While the controller 154 is waiting for wireless commands from the primary display 120, the light indicator 134 of the locator puck 126 may be flashing in a predetermined color, such as a red color. If data is requested of the controller 154 of the locator puck 126 by the controller 222 of the primary display 120 as indicated by box 350, a data packet may be sent out by the controller 154 of the locator puck 126 to the controller 222 of the primary display 120 as indicated by box 352. Thereafter, the controller 154 of the locator puck 126 may again wait for further commands from the controller 222 of the primary display 120 as indicated by box 348. If no data request is received by the controller 154 of the locator puck 126 but a "turn off" command is received, as indicated by box 354, the controller 154 of the locator puck 126 turns itself off as indicated by box 358. If no data request is received or "turn off" command received by the controller 154 of the locator puck 126, but a "time out" state is reached as indicated by box 356, the controller 154 of the locator puck 126 turns itself off as again indicated by box 358 of FIG. 53. If a "time out" state has not been reached as indicated by box 356, the controller 154 of the locator puck 126 will again wait for further commands from the controller 222 of the primary display 120 as indicated by box 348. Suitable elements of the method above, or any subset thereof, may be combined with elements of any other method embodiment discussed herein. In addition, any suitable elements of other method embodiments discussed herein may be combined with the above method elements.

Figure 54:
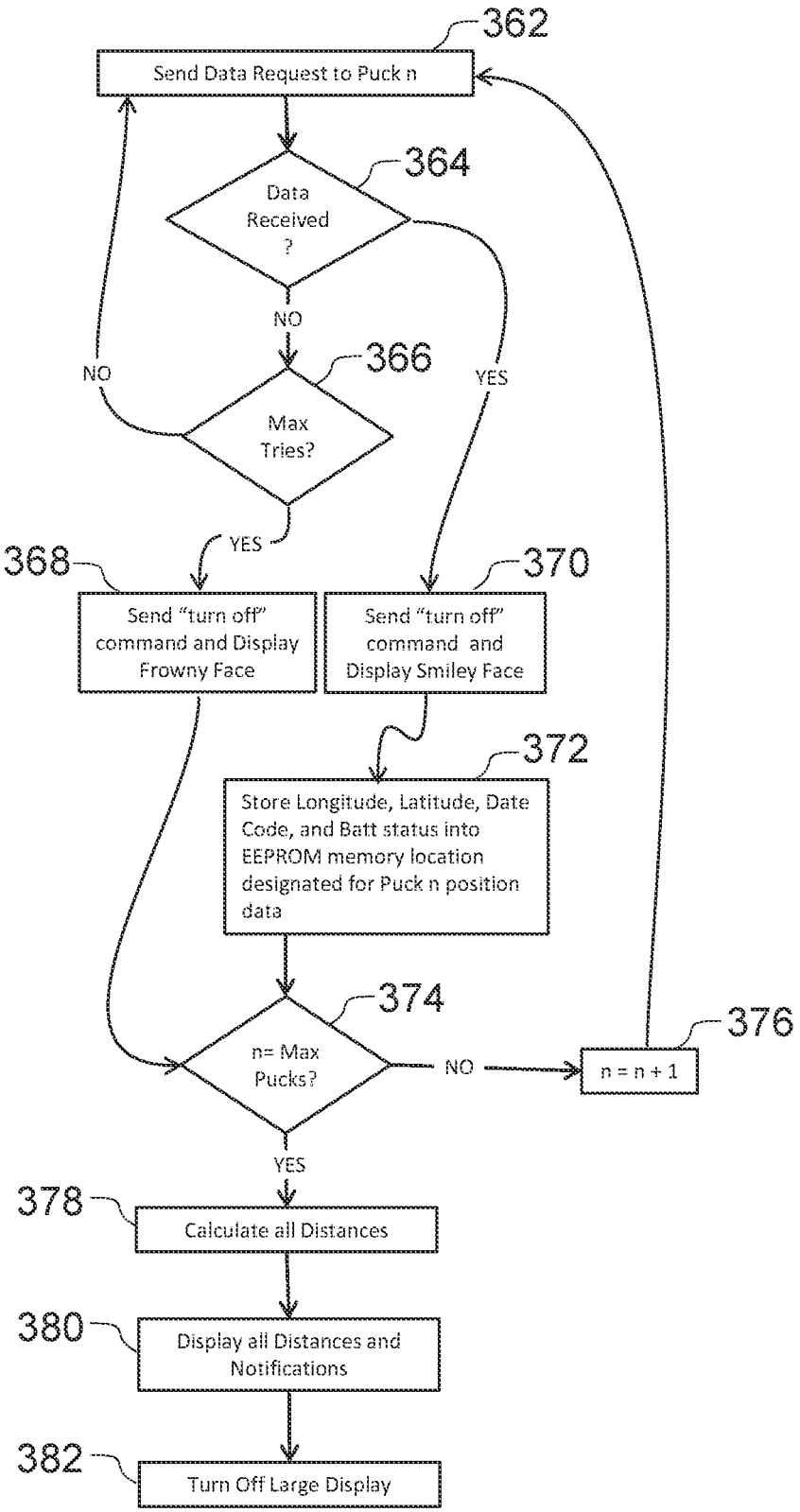
FIG. 54 is a flow chart representation of a method embodiment of displaying distance data between tee hitting positions and a cup position of a golf hole of a golf course with a distance display system embodiment.

FIG. 54 is a flowchart representation showing an embodiment of a method of data acquisition, distance calculation and distance information display by embodiments of the primary display 120 of the distance display system 115. Initially, the controller 222 of the primary display 120 sends a data request signal to a first locator puck 126 as indicated in box 362. If the controller 154 of the recipient first locator puck 126 properly receives the request and replies with transmission of the requested data from the controller 154 of the first locator puck 126 through the wireless module 174 to the wireless module 176 and ultimately the controller 222 of the primary display 120, as indicated in box 364, the controller 222 of the primary display 120 may then send a command signal to the controller 154 of the first locator puck 126 to shut off. In addition, the controller 222 of the primary display 120 may then display a visual indicator in the display site 146 corresponding to the recipient first locator puck 126 that confirms proper receipt of the requested data. In some cases, such a visual indicator may include a "smiley face" icon 150 or the like. These steps are indicated by box 370 in FIG. 54. At this stage of the data acquisition process, the properly received data, which may include position data of the first locator puck 126 in addition to other data, may then be stored into the main memory 228 of the controller 222 of the primary display 120 in a memory location specific to the first locator puck 126 as indicated by box 372. For some embodiments, the main memory 228 as well as any other subsections of the main memory 228 may include EEPROM type memory or the like.

In some cases, storage of the acquired data may include storage of the longitude of the first locator puck 126, storage of the latitude of the first locator puck 126, a date code or codes 274, 276 for the date of data acquisition for the first locator puck 126, a battery status 280 of the first locator puck 126 and the like. Once the requested data has been stored by the controller 222 of the primary display 120, the controller 222 of the primary display 120 then determines whether the distance display system 115 includes additional locator pucks 126 other than the first locator puck 126 as indicated in box 374. If the distance display system embodiment 115 includes additional locator pucks 126 as indicated by box 376 (8), the data request and acquisition process begins again for the additional locator puck(s) 126 as indicated by box 362 and discussed above.

If the distance display system embodiment 115 does not include any additional locator pucks 126, the controller 222 of the primary display 120 will calculate the distance between each of the one or more locator pucks 126, including the first locator puck 126, and the new position of the cup 130 as indicated in box 378 and display the calculated distances in a respective display site 146 of the primary display 120 as indicated by box 380. In some instances, the tee box indicator 128 of each tee hitting position 124 will have the same visual distinction as that of the puck indicator 138 of the respective locator puck 126 disposed on or adjacent the tee box indicator 128 as well as that of the display indicator 147 disposed adjacent the display site 146 of the primary display which is displaying the distance from the locator puck 126 to the new position of the cup 130. The display site 146 may further display date codes and other information that may be useful to determine the time and accuracy of the distance information being displayed in each display site 146. Once the location data from each of the actuated locator pucks 126 has been obtained and associated calculated distances displayed at respective display sites 146 of the primary display 120, the controller 222 of the primary display 120 may issue a command to turn off all actuated locator pucks 126 and then turn itself off with the displayed distances on the display sites 146 still being displayed as shown in box 382.

Referring back to box 364, if the requested data from the first locator puck 126 is not properly received, the controller 222 of the primary display 120 then calculates whether the maximum number of data acquisition attempts or tries has been made as indicated in box 366. If not, the process is reinitiated with a new data request as indicated in box 362 as discussed above. If the maximum number of data request tries have been made, the controller 222 of the primary display 120 may then transmit a signal through the wireless transceiver 176 to the controller 154 of the first locator puck 126 to shut the controller 154 of the first locator puck 126 down as indicated in box 368. A visual indicator in the display site 146 corresponding to the recipient first locator puck 126 that indicates failure to properly requested data may be displayed. In some cases, such a visual indicator of data receipt failure may include a "frowny face" or the like also as indicated by box 368. In other cases, a previously displayed distance may be displayed in the display site 146 with a corresponding date code that indicates from the previous distance information capture corresponding to the previously displayed distance. Such a date code corresponding to a previously displayed distance will be indicative of an out of date data capture and indicative of the present data receipt failure. The controller 222 of the primary display 120 then determines whether the distance display system 115 includes additional locator pucks 126 other than the first locator puck 126 as indicated in box 374 with the same process options as those discussed above with regard to the inquiry indicated at box 374. Suitable elements of the method above, or any subset thereof, may be combined with elements of any other method embodiment discussed herein. In addition, any suitable elements of other method embodiments discussed herein may be combined with the above method elements.

Embodiments illustratively described herein suitably may be practiced in the absence of any element(s) not specifically disclosed herein. Thus, for example, in each instance herein any of the terms "comprising," "consisting essentially of," and "consisting of" may be replaced with either of the other two terms. The terms and expressions which have been employed are used as terms of description and not of limitation and use of such terms and expressions do not exclude any equivalents of the features shown and described or portions thereof, and various modifications are possible. The term "a" or "an" can refer to one of or a plurality of the elements it modifies (e.g., "a reagent" can mean one or more reagents) unless it is contextually clear either one of the elements or more than one of the elements is described. Thus, it should be understood that although embodiments have been specifically disclosed by representative embodiments and optional features, modification and variation of the concepts herein disclosed may be resorted to by those skilled in the art, and such modifications and variations are considered within the scope of this disclosure.

With regard to the above detailed description, like reference numerals used therein refer to like elements that may have the same or similar dimensions, materials and configurations. While particular forms of embodiments have been illustrated and described, it will be apparent that various modifications can be made without departing from the spirit and scope of the embodiments of the invention. Accordingly, it is not intended that the invention be limited by the forgoing detailed description.

What is claimed is:

1. A distance display system for simultaneously displaying respective distances from a cup of a golf hole to a plurality of tee hitting positions of the golf hole, comprising:

a primary display that includes a plurality of display sites, a display indicator disposed adjacent each of the respective display sites, a processor, an actuator interface, and a communication interface in operative communication with the processor; and a plurality of locator pucks, each locator puck including a position measuring system configured to determine the position of the locator puck, a cup position memory, a tee hitting position memory, an actuator interface and a communication interface configured to communicate with the communication interface of the primary display.

2. The distance display system of claim 1 wherein each of the plurality of locator pucks further comprises a power source.

3. The distance display system of claim 2 wherein the power source of each of the plurality of locator pucks comprises a battery.

4. The distance display system of claim 1 wherein the primary display further comprises a power source.

5. The distance display system of claim 4 wherein the power source of the primary display comprises a battery.

6. The distance display system of claim 1 wherein the position measuring system of each of the plurality of locator pucks comprises a global positioning system receiver which determines a position of the respective locator puck by receiving global positioning system satellite signal data.

7. The distance display system of claim 1 wherein the primary display further comprises a housing.

8. The distance display system of claim 1 wherein each of the plurality of locator pucks further comprises a housing.

9. The distance display system of claim 1 wherein the actuator interface of the primary display comprises a button.

10. The distance display system of claim 1 wherein the actuator interface of each of the plurality of locator pucks comprises a button.

11. The distance display system of claim 1 wherein each of the plurality of locator pucks further comprises a secondary display site.

12. The distance display system of claim 1 wherein each display indicator comprises a color coded emblem.

13. The distance display system of claim 12 wherein each color coded emblem corresponds to a color coding of a tee hitting position corresponding to a stored tee hitting position for which a display distance has been displayed.

14. The distance display system of claim 1 wherein each display indicator comprises a written character that represents a matching written character of a corresponding tee hitting position.

15. The distance display system of claim 14 wherein the written characters comprise numbers.

16. The distance calculator of claim 14 wherein the written characters comprise letters.

17. The distance display system of claim 1 wherein each display indicator comprises a distinct shape.

18. The distance display system of claim 1 wherein each of the display sites comprises a screen that continues to display a display distance after power to the display site has been stopped.

19. The distance display system of claim 18 wherein each of the display sites comprises a microencapsulated electrophoretic display.

20. The distance display system of claim 1 wherein the plurality of locator pucks comprises about 2 locator pucks to about 10 locator pucks.

21. The distance display system of claim 1 wherein the plurality of locator pucks comprises about 2 locator pucks to about 4 locator pucks.

22. The distance display system of claim 1 wherein the communication interface of the primary display comprises a wireless communication interface and the communication interface of each of the plurality of locator pucks comprises a wireless communication interface.

23. A method of displaying distances from a plurality of tee hitting positions to a cup of a golf course hole, comprising:

selecting a primary display and a plurality of locator pucks of a distance display system and placing a first locator puck on the ground adjacent to a cup position on a green of the golf course hole;

actuating a GPS module of the first locator puck and capturing cup position data;

storing the cup position data into a puck memory of the first locator puck;

transporting the first locator puck to a tee hitting area corresponding to the cup of the golf course hole;

placing the first locator puck adjacent a first tee hitting position of the tee hitting area;

actuating the GPS module of the first locator puck and capturing first tee hitting position data with the GPS module;

storing the first tee hitting position data into a tee hitting position memory of the first locator puck;

placing the second locator puck adjacent a second tee hitting position of the tee hitting area;

actuating a GPS module of the second locator puck and capturing second tee hitting position data with the GPS module of the second locator puck;

storing the second tee hitting position data into a tee hitting position memory of the second locator puck;

positioning a primary display of the distance display system in a desired position near the first and second tee hitting positions;

actuating an actuator interface of a controller of the primary display which then queries the first locator puck and second locator puck for position data, transmitting cup position data from the first locator puck to the controller of the primary display;

transmitting first tee hitting position data from the first locator puck to the controller of the primary display;

transmitting second tee hitting position data from the second locator puck to the controller of the primary display;

storing the transmitted position data in a display memory of the primary display;

calculating a first distance from the first tee hitting position to the cup with the controller of the primary display and displaying the first distance on a first display site of the primary display; and calculating a second distance from the second tee hitting position to the cup with the controller of the primary display and displaying the second distance on a second display site of the primary display.

24. The method of claim 23 wherein selecting a plurality of locator pucks of a distance display system comprises selecting about 2 locator pucks to about 10 locator pucks.

25. The method of claim 24 wherein selecting a plurality of locator pucks of a distance display system comprises selecting about 2 locator pucks to about 4 locator pucks.

26. The method of claim 23 wherein placing a first locator puck on the ground adjacent to a cup position on a green of the golf course hole comprises placing a first locator puck on the ground adjacent to a new cup position on a green of the golf course hole wherein the new cup position is disposed a desired distance and direction away from an existing cup position.

27. The method of claim 26 further comprising filling an existing cup at the existing cup position and drilling a new cup at the new cup position while the first locator puck is capturing cup position data.

28. The method of claim 23 wherein placing the first locator puck adjacent a first tee hitting position of the tee hitting area comprises placing the first locator puck adjacent a first tee hitting position having a tee hitting position indicator which matches a puck indicator of the first locator puck and wherein placing the second locator puck adjacent a second tee hitting position of the tee hitting area comprises placing the second locator puck adjacent a second tee hitting position having a tee hitting position indicator which matches a puck indicator of the second locator puck.

29. The method of claim 23 wherein positioning the primary display of the distance display system in a desired position near the first and second tee hitting positions comprises positioning the primary display at eye level adjacent a path leading to the tee hitting area of the first and second tee hitting positions.

30. The method of claim 23 wherein capturing cup position data and storing the cup position data into the puck memory of the first locator puck is carried out automatically by a controller of the first locator puck.

31. The method of claim 23 wherein capturing first tee hitting position data with the GPS module and storing the first tee hitting position data into the tee hitting position memory of the first locator puck is carried out automatically by a controller of the first locator puck.

32. The method of claim 23 wherein capturing second tee hitting position data with the GPS module and storing the second tee hitting position data into the tee hitting position memory of the second locator puck is carried out automatically by a controller of the second locator puck.

33. The method of claim 23 wherein the primary display queries the first locator puck and second locator puck wirelessly for position data.

34. The method of claim 23 wherein transmitting cup position data from the first locator puck to the controller of the primary display comprises wirelessly transmitting cup position data from the first locator puck to the controller of the primary display.

35. The method of claim 23 wherein transmitting first tee hitting position data from the first locator puck to the controller of the primary display comprises wirelessly transmitting first tee hitting position data from the first locator puck to the controller of the primary display.

36. The method of claim 23 wherein transmitting second tee hitting position data from the second locator puck to the controller of the primary display comprises wirelessly transmitting second tee hitting position data from the second locator puck to the controller of the primary display.

* * * * *